US006152205A

United States Patent [19]

Toti

[11] Patent Number: 6,152,205

[45] **Date of Patent: *Nov. 28, 2000**

[54] WINDOW COVERING SYSTEM

[76] Inventor: Andrew J. Toti, 311 W. River Rd., Modesto, Calif. 95351

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/773,888

[22] Filed: Dec. 27, 1996

Related U.S. Application Data

[63] Continuation of application No. 08/570,755, Dec. 12, 1995, abandoned, which is a continuation of application No. 08/100,112, Jul. 30, 1993, abandoned, which is a continuation-in-part of application No. 07/934,989, Aug. 25, 1992, Pat. No. 5,301,733.

[51] Int. Cl.[7] ..... E06B 3/94

[52] U.S. Cl. ..... 160/84.04; 160/89; 160/172 V

[58] Field of Search ..... 160/84.01–84.09, 160/89, 126, 172 R, 172 V, 176.1 V, 166.1 V, 341, 345

[56] References Cited

U.S. PATENT DOCUMENTS

| | | | |
|---|---|---|---|
| 2,210,652 | 8/1940 | Dennett | 160/135 |
| 2,253,606 | 8/1941 | Boltz . | |
| 2,607,411 | 8/1952 | Van Vliet . | |
| 2,617,481 | 11/1952 | Frohnapel . | |
| 2,690,799 | 10/1954 | Gerstenmaier . | |
| 2,874,612 | 2/1959 | Luboshez | 88/60 |
| 2,914,122 | 11/1959 | Pinto | 160/89 |
| 2,978,020 | 8/1961 | Paulsrude . | |
| 2,994,370 | 8/1961 | Pinto | 160/89 |
| 3,116,784 | 1/1964 | Dwyer | 160/349 |
| 3,132,432 | 5/1964 | Yee | 160/135 |
| 3,335,784 | 8/1967 | Risk | 160/199 |
| 3,369,589 | 2/1968 | Benkert, Jr. | 160/84 |
| 3,382,507 | 5/1968 | Micheau | 4/149 |
| 3,844,330 | 10/1974 | Hyman . | |
| 3,851,699 | 12/1974 | Shapiro . | |
| 3,946,789 | 3/1976 | Tolle . | |
| 4,123,820 | 11/1978 | Hamilton . | |
| 4,202,395 | 5/1980 | Heck | 160/84 |

(List continued on next page.)

FOREIGN PATENT DOCUMENTS

| | | | |
|---|---|---|---|
| 56179 | 8/1891 | Germany . | |
| 723769 | 12/1939 | Germany . | |
| 8401183 | 3/1984 | WIPO | 16/225 |

*Primary Examiner*—Blair M. Johnson
*Attorney, Agent, or Firm*—Philip A. Dalton

[57] ABSTRACT

Window cover systems include window cover material in the form of pleated panels or slats. The window cover material is suspended from a traverse track and is traversed along the track for opening and closing the window system. Arrangements for maintaining spacing and alignment of pleats or slats are provided. The alignment maintaining arrangements include traverse tapes which are substantially rigid in longitudinal and lateral directions in the plane of the tape, and are flexible in a direction perpendicular to the tape. The arrangements also include attaching the window cover material to vertical edge members and providing foldable spacer-members between adjacent edge-members. In one arrangement, a box-pleated panel of window cover fabric is suspended from a traverse track on slide-members. The slide-members are each attached to a spacer-tape at regular intervals along the spacer-tape. The spacer-tape is substantially rigid in the traverse direction and in a vertical direction perpendicular to the traverse direction. The window cover system is opened and closed by rolling and unrolling the panel and the spacer-tape around a roller located at one end of a window frame. Other arrangements include combined, tape-supported vertical slat blinds and vertical pleated drapes in which the tape(s) are supported by sprockets or wheels/pulleys.

10 Claims, 27 Drawing Sheets

U.S. PATENT DOCUMENTS

| | | | |
|---|---|---|---|
| 4,344,475 | 8/1982 | Frey . | |
| 4,473,101 | 9/1984 | Langeler | 160/84 |
| 4,582,109 | 4/1986 | Fairbanks | 160/84 |
| 4,724,885 | 2/1988 | Chang | 160/89 |
| 4,758,042 | 7/1988 | Liu | 296/97 |
| 4,858,668 | 8/1989 | Toti | 160/84.1 |
| 4,862,941 | 9/1989 | Colson | 160/84.1 |
| 4,915,153 | 4/1990 | Toti | 160/84.1 |
| 5,083,598 | 1/1992 | Schon . | |
| 5,205,334 | 4/1993 | Judkins | 160/89 |
| 5,588,180 | 12/1996 | Chester | 16/DIG. 13 |

FIG. 3
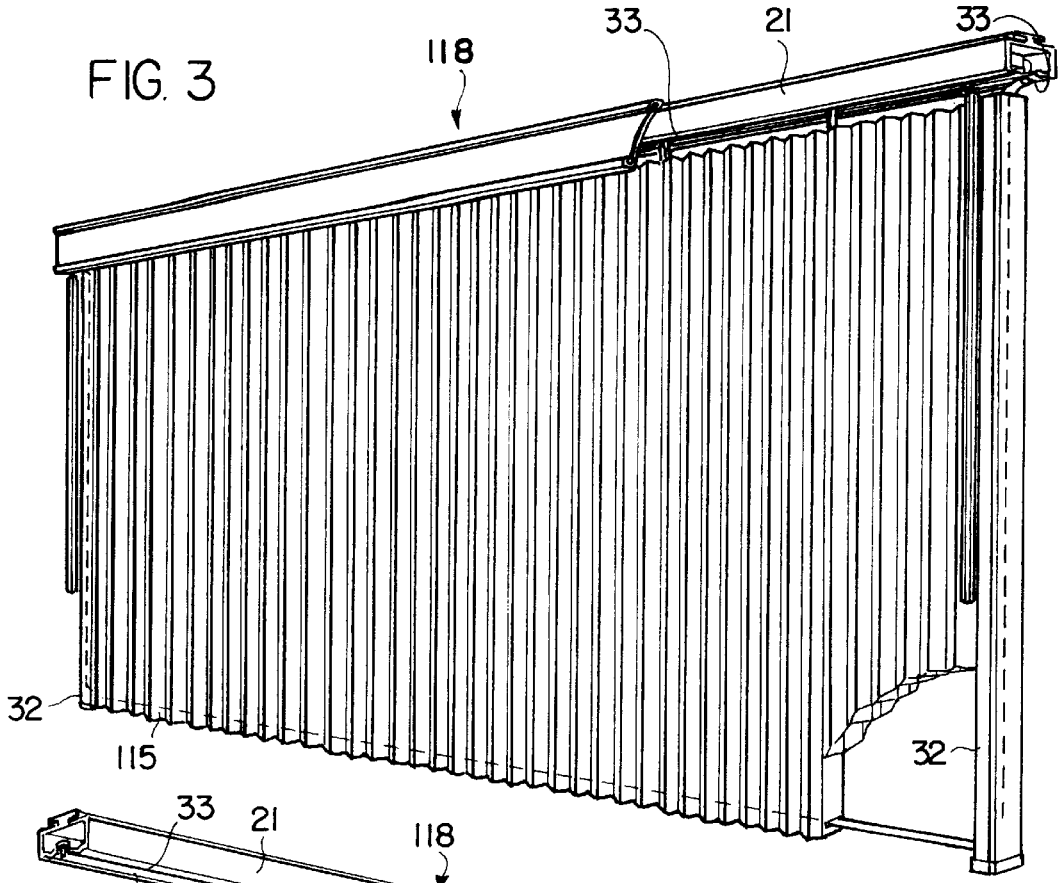
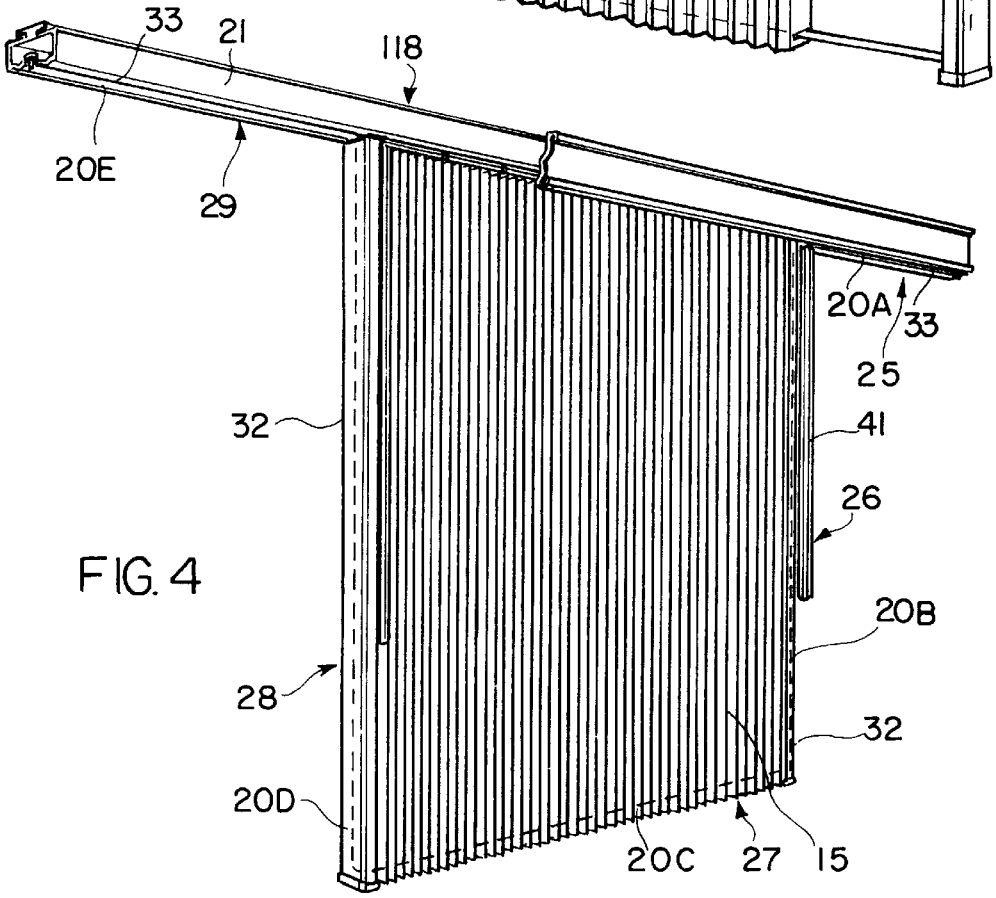
FIG. 4

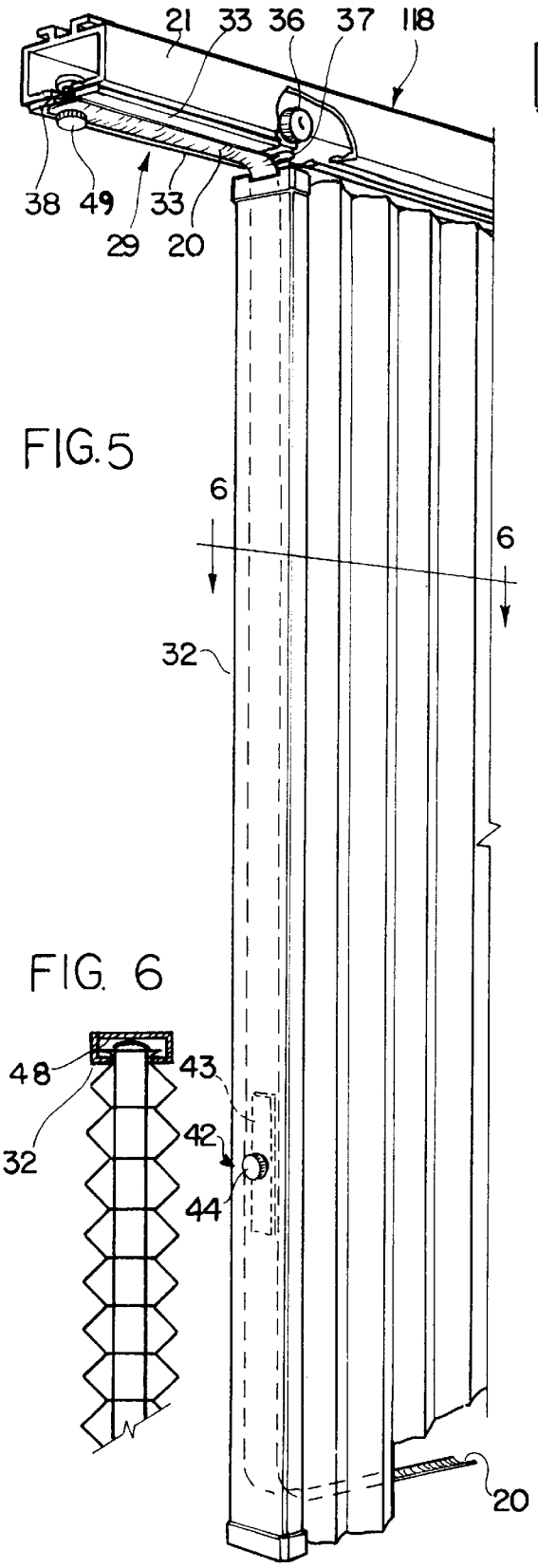
FIG. 5
FIG. 6
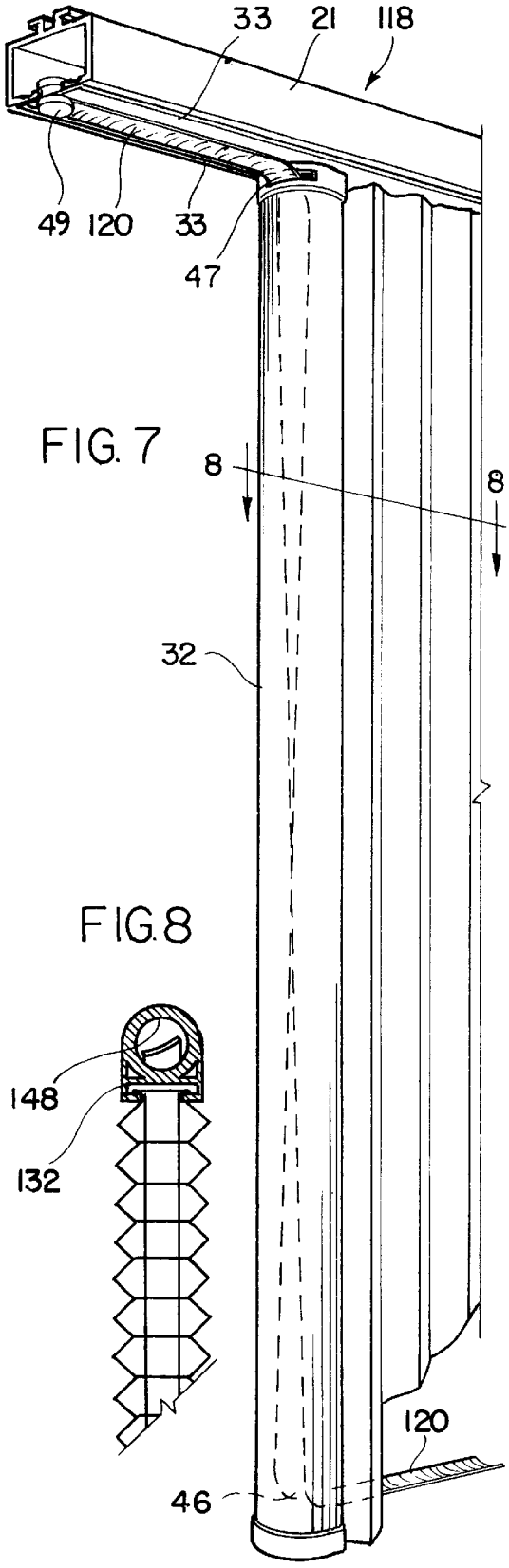
FIG. 7
FIG. 8

FIG. 13
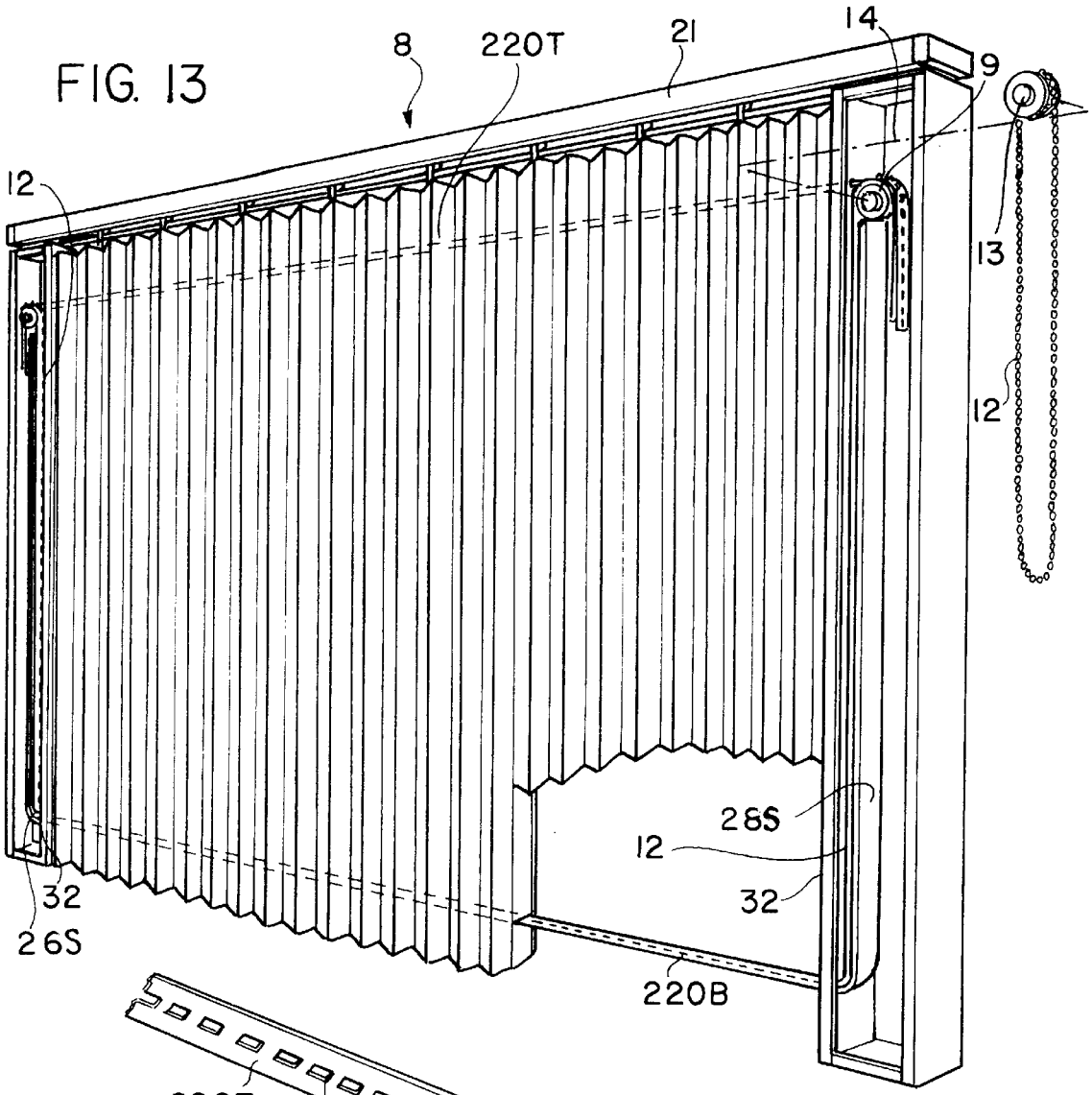
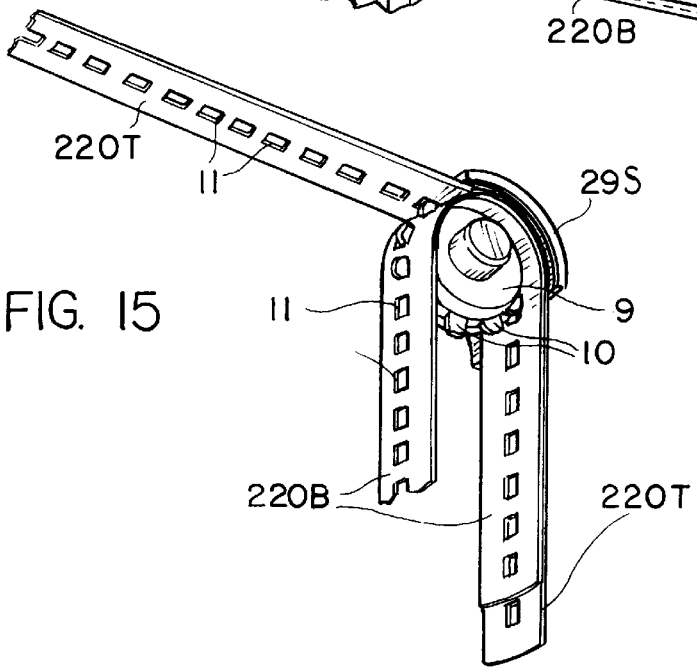
FIG. 15

FIG. 24
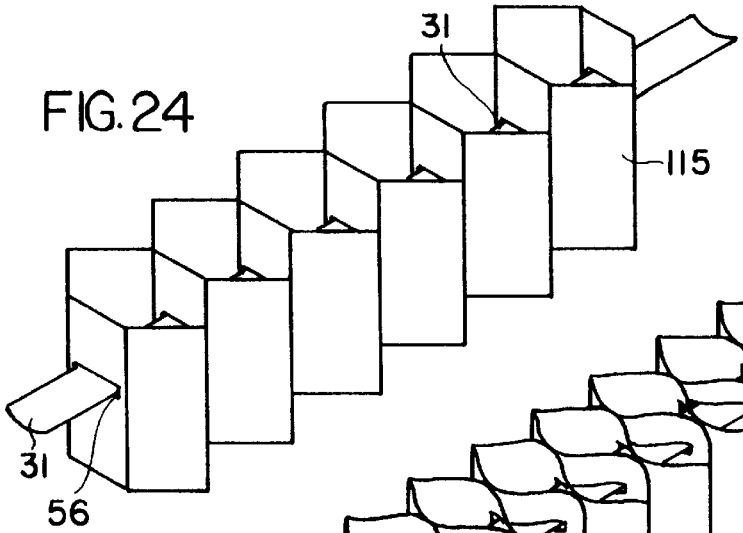
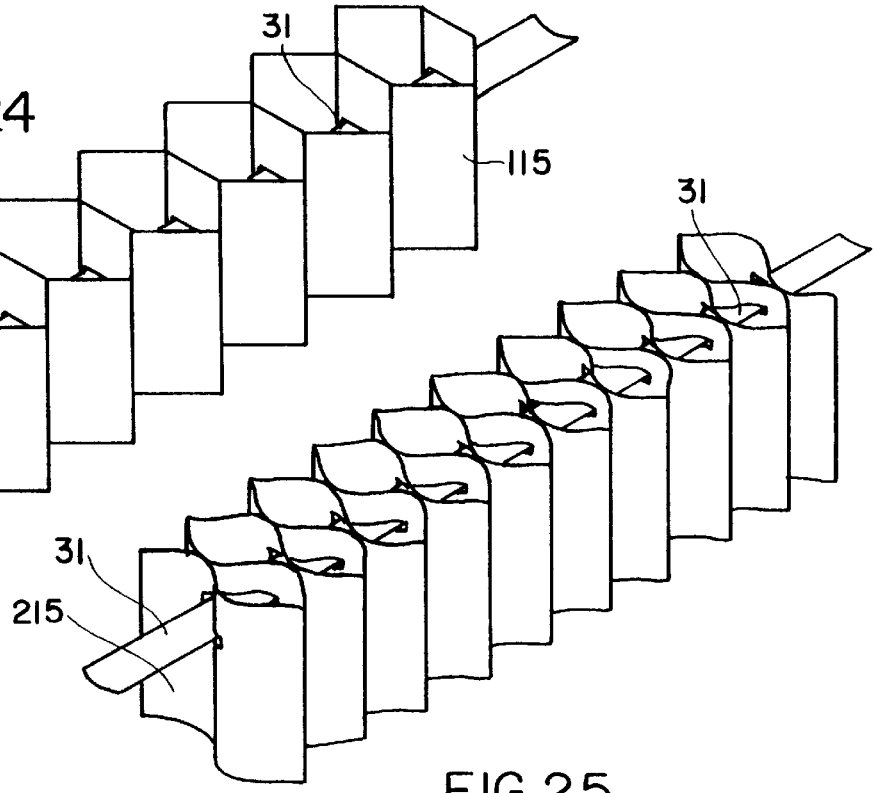
FIG. 25
FIG. 26
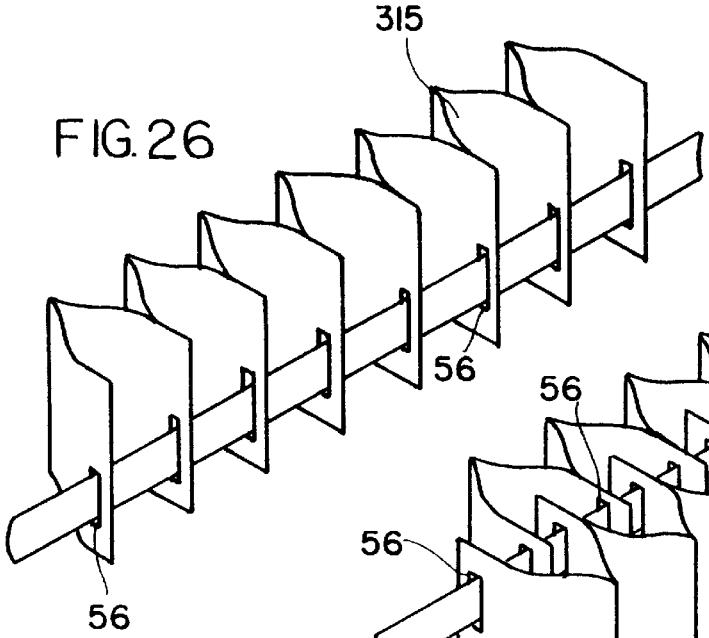
FIG. 27
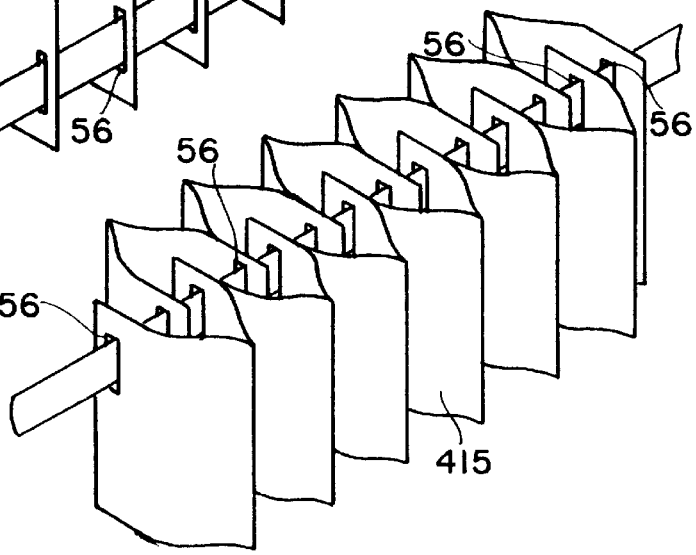

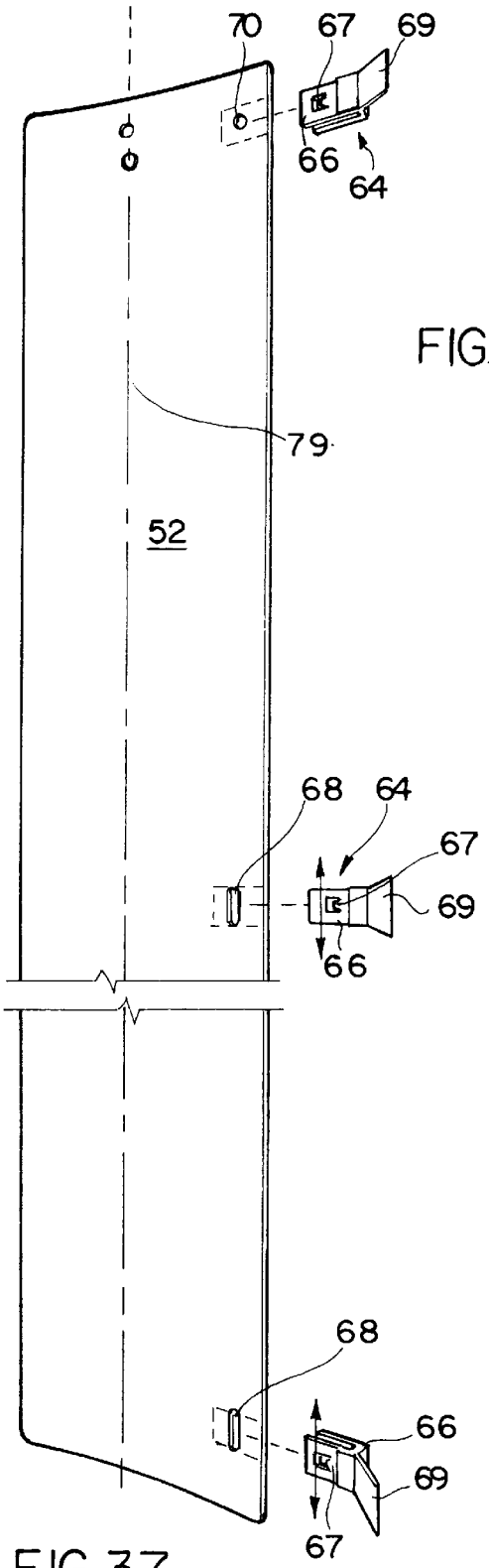
FIG. 37
FIG. 43
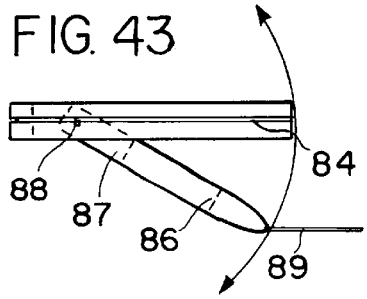
FIG. 44
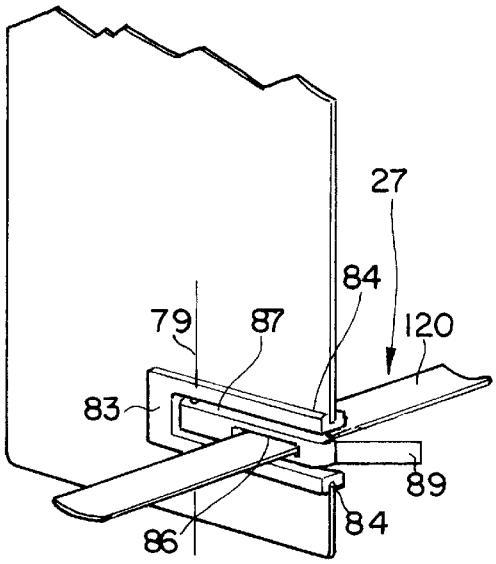
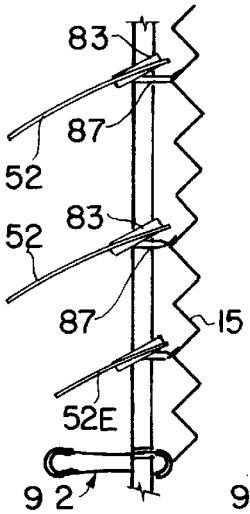
FIG. 45
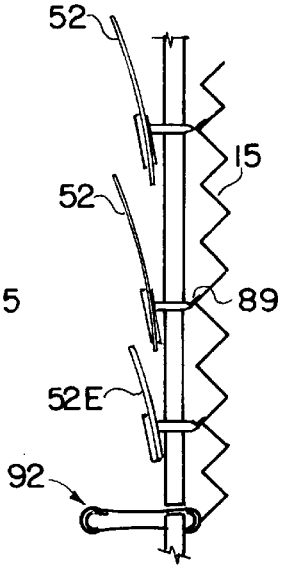
FIG. 46

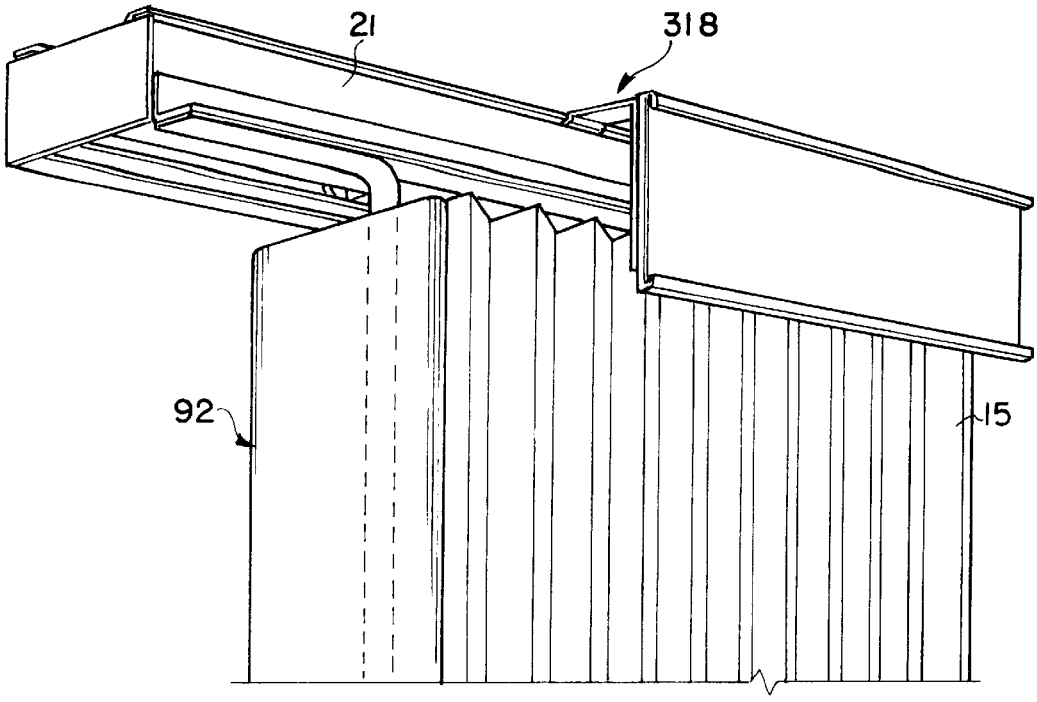
FIG. 38
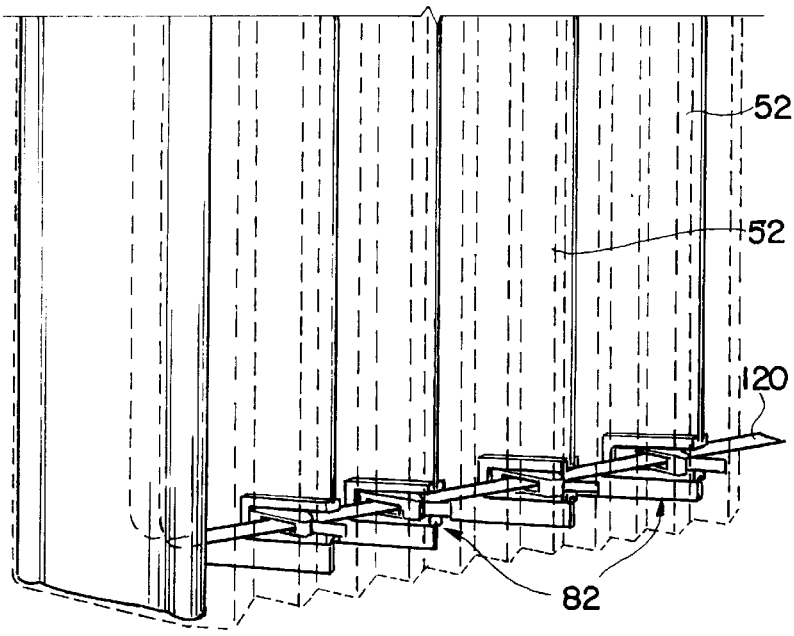
FIG. 40
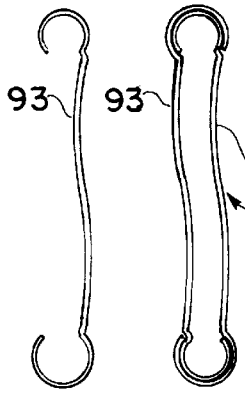
FIG. 39
FIG. 42
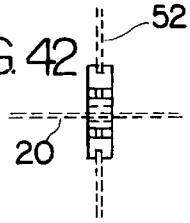
FIG. 41
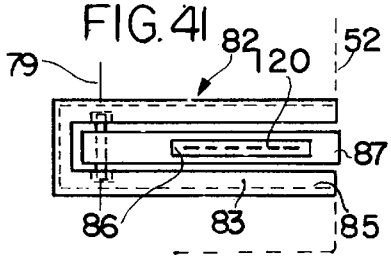

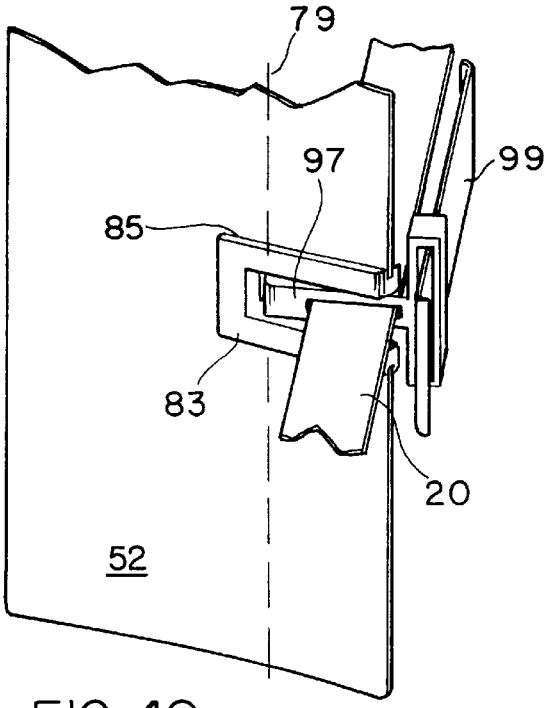
FIG. 49
FIG. 51
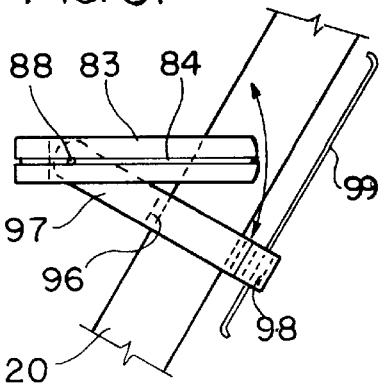
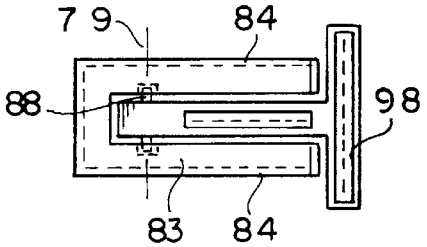
FIG. 50
FIG. 52
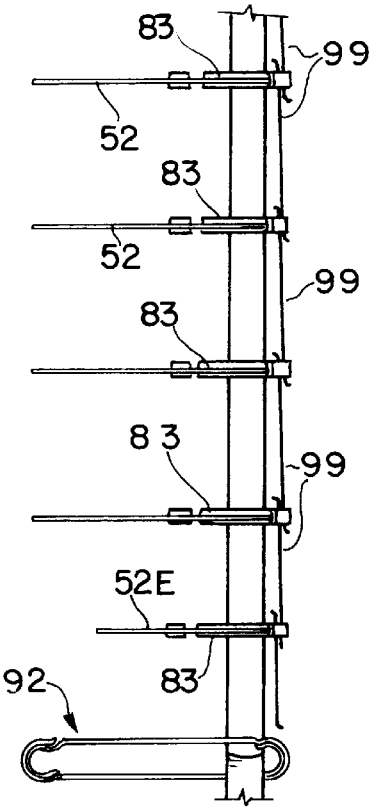
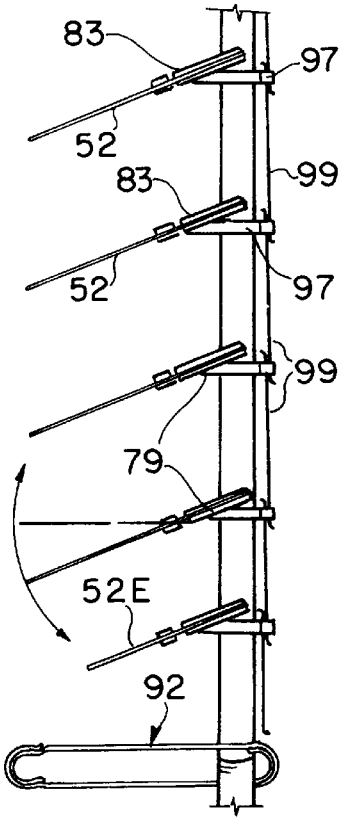
FIG. 53
FIG. 54
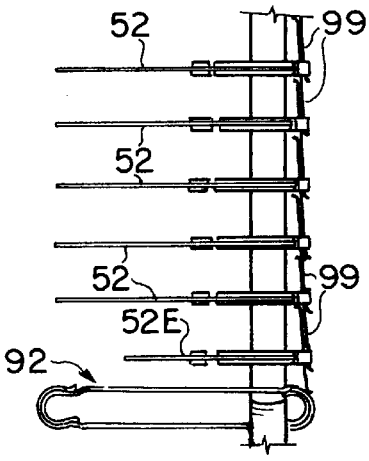

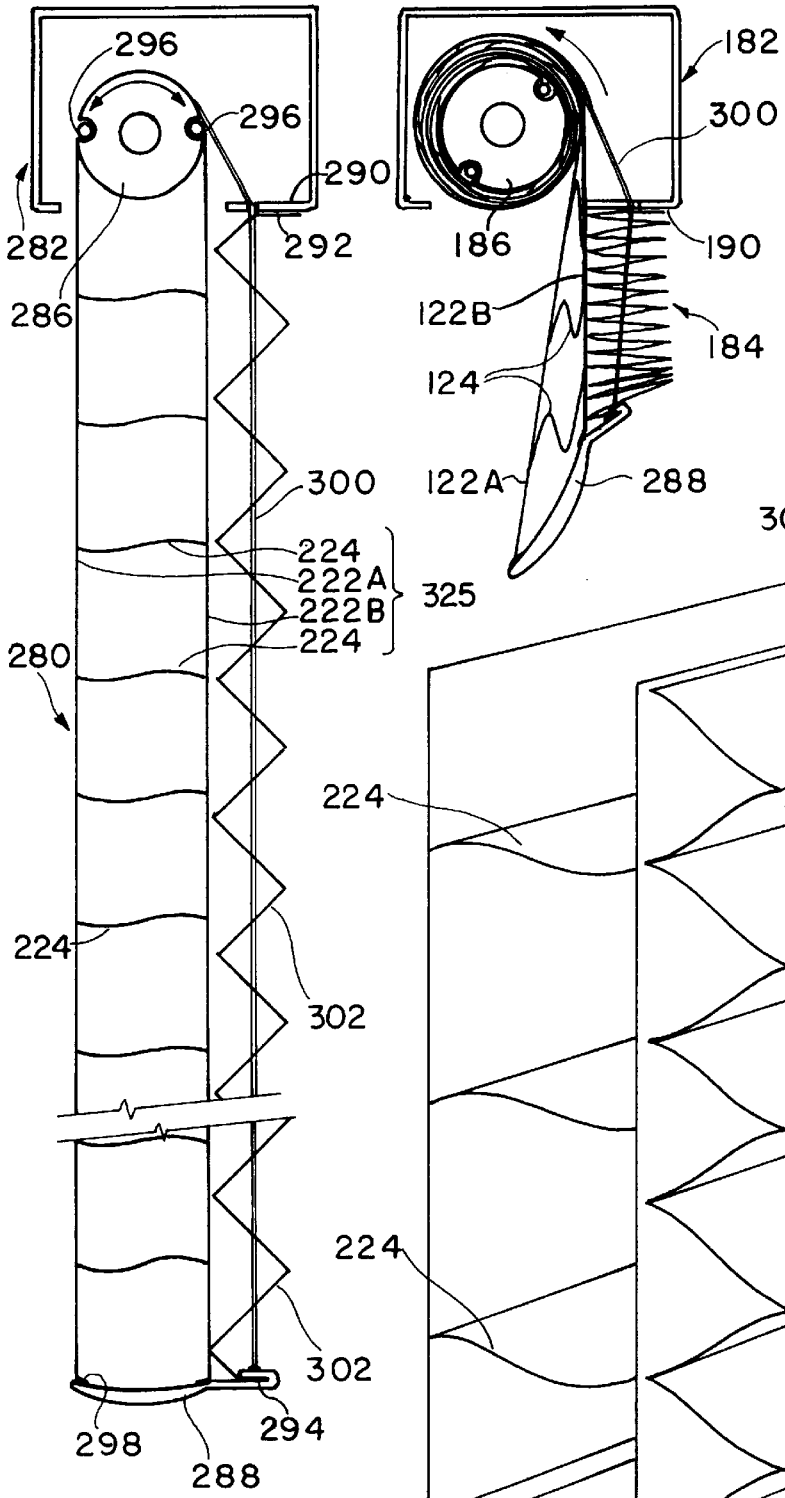
FIG. 77
FIG. 78
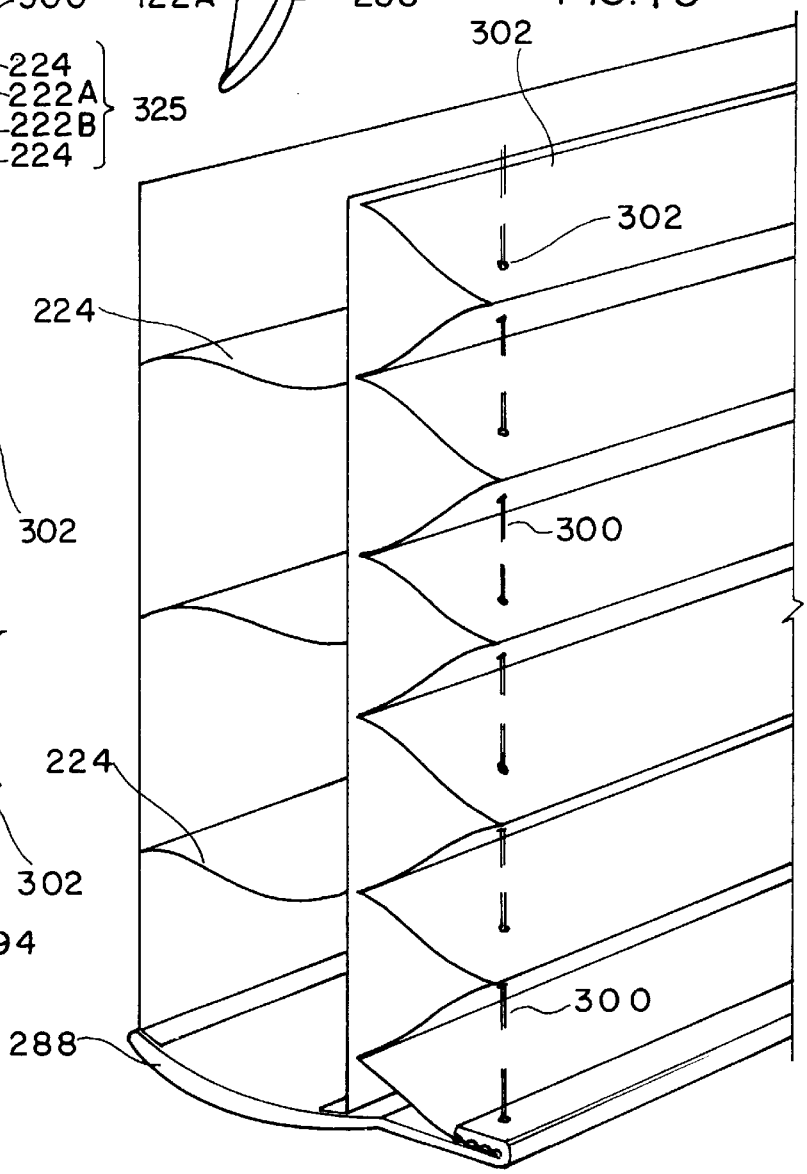
FIG. 79

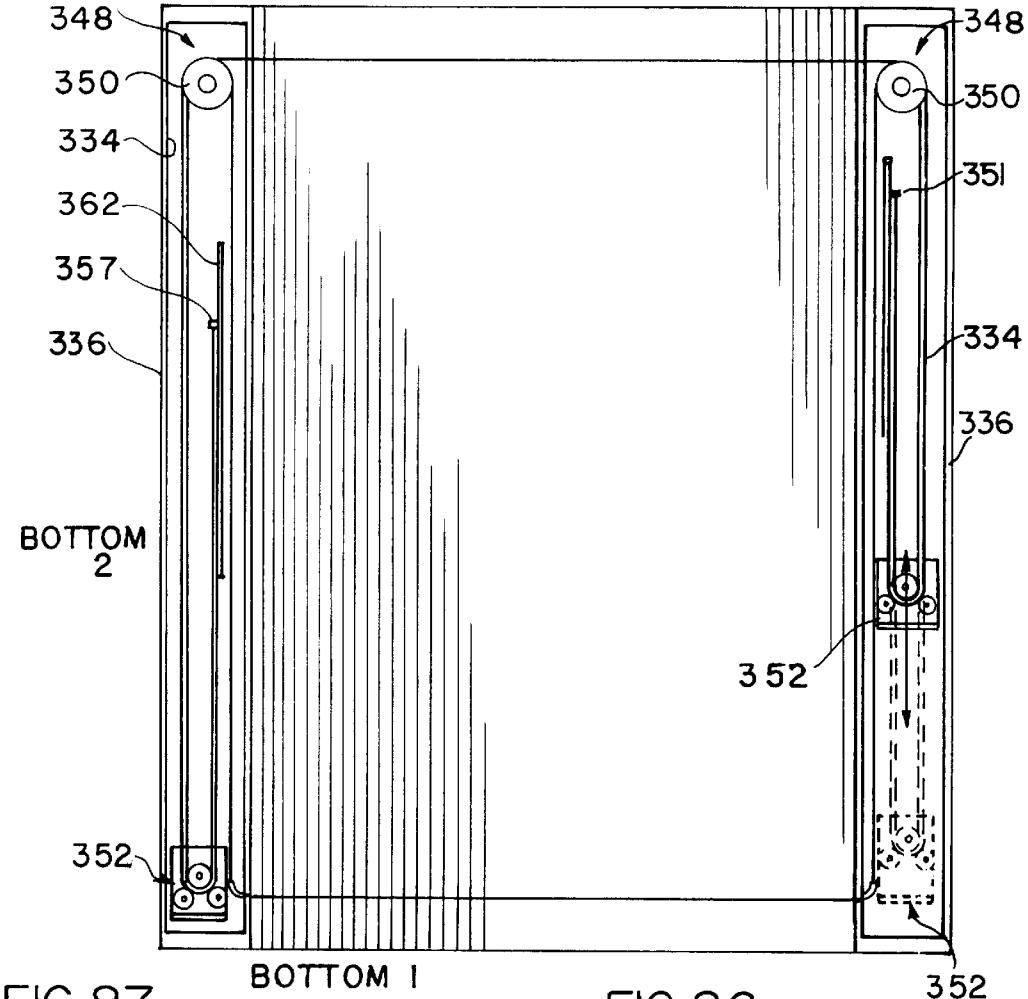
FIG. 86
FIG. 87
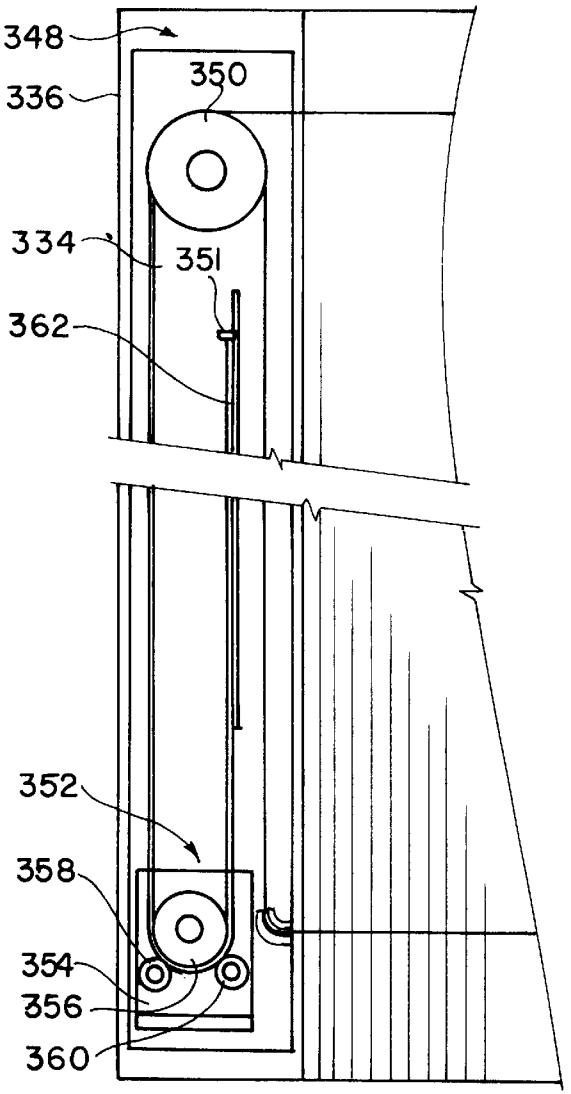

WINDOW COVERING SYSTEM

1. CROSS-REFERENCE TO RELATED APPLICATION

This is a continuation of application Ser. No. 08/570,755, filed Dec. 12, 1995, now abandoned; which is a continuation of application Ser. No. 08/100,112, filed Jul. 30, 1993, now abandoned, which is a continuation-in-part of application Ser. No. 07/934,989, filed Aug. 25, 1992, entitled TAPE-SUPPORTED WINDOW COVER SYSTEM, now U.S. Pat. No. 5,301,733, issued Apr. 12, 1994.

2. BACKGROUND OF THE INVENTION a. Field of the Invention

This invention relates generally to window cover systems, to window cover systems using various cover materials such as pleated or non-pleated fabrics or slats or blinds, and to vertically and horizontally oriented cover systems, that is, those in which the pleats or blinds or slats are oriented vertically or horizontally.

The term "window cover" is used here for convenience, but with the understanding that my invention can be used to cover other areas or openings, such as doorways. Also, for convenience frequent reference is made to pleated fabric window cover systems, but this reference is exemplary and not limiting, for as indicated above the invention is applicable to various materials, including non-pleated fabrics and blinds. As shown in FIG. 2, the terms "longitudinal width" (or simply "width") and "height" of a window cover refer to the dimensions "w" and "h", respectively.

b. Current State of the Relevant Art

Over the past several years, pleated shade systems have become a popular form of window treatment. One version of a pleated shade system available from Verosol USA, Inc. of Pittsburgh, Pa., under the trademark RIDEAU, utilizes a prepleated fabric with strong, permanently set pleats which pack very tightly. The Verosol fabric pleats are single pleats. Another version of prepleated fabric is a dual pleated "hollow" fabric recently introduced by the Window Fashion Division of Hunter Douglas, Inc. of Broomfield, Colo., under the trademark DUETTE. Graber, Inc. markets a CRYSTAL PLEAT brand, dual hollow pleated fabric window cover. A seamed pleated fabric cover is available from Verosol, USA, Inc. under the trademark FINALE.

Several of these pleated fabrics work very well in pleated shade systems because the pleats run horizontally and the regularity of the pleats is controlled by the weight of a board or other length of rigid material fastened to the bottom edge of the area of pleated fabric.

A major problem associated with attempting to use the prepleated material in vertical orientations is the difficulty in providing uniform hanging of the pleats. Because of the strongly set pleats, the material tends to behave like a tension spring. The pleats have a spring inherent bias toward the packed-together or closed state of the fabric. When used in a vertical drape, this spring force makes the material hang with uneven draping when the drape is closed (i.e. the open state of the pleated fabric) because the bottom portion of the material which is not mechanically constrained tends to draw together. Thus the pleats do not hang straight and the appearance is unacceptable.

An additional problem occurs when the drape is being traversed open (closed or packed state of the fabric) after being left in a closed position for a length of time. The pleats of the drape do not always pack consistently and tend to distort out of the plane of traverse of the drape. This makes it difficult to obtain a uniform pleating of the drape as it closes and requires hand adjustment of the individual pleats of the fabric.

Vertical blind systems are also popular window covers and share some of the same problems. It would be preferable to use the same string ladder spacing and confining system in a vertical blind that is used in horizontal blind. However, if a string ladder is used, the weight of the ladder itself tends to distort the shape of the overall blind, especially at the edges where the bottom portions of the edge slats tend to be pulled inward. Furthermore, when the vertical blind is traversed from a closed to an open position, the slats tend to distort out of the plane of traverse due to unevenness in the folding of the string ladder material between slats.

My two recent patents, U.S. Pat. No. 4,858,668, issued Aug. 22, 1989, entitled VERTICAL WINDOW COVERING SYSTEMS, and its continuation-in-part, U.S. Pat. No. 4,915,153, issued Apr. 10, 1990, also entitled VERTICAL WINDOW COVERING SYSTEMS, disclose vertical cover support systems which are especially adapted to overcome the above problems associated with vertically mounted draperies and blinds. The '668 and '153 patents are incorporated by reference. Referring to FIGS. 1 and 55, in one preferred embodiment, the vertical cover support systems disclosed in these patents include an elongate mounting platform 2, which is adapted for easy traverse along the system track 1, and means 4 which extends through a slot in the bottom of the traverse track for mounting a vertical drapery edge stabilizer 3. The end of the window cover 5 is attached to the rigid edge stabilizer member 3, which in turn is rigidly mounted to the platform 2 by member 4 and is held by the platform in a rigid vertical orientation to thereby maintain the end of the drapery 5 or other cover in a precise vertical orientation. A cord tensioning arrangement 6 maintains the cover in the vertical plane of the system (the vertical plane extending downward from the traverse track 1). Preferably the platform 2 is elongate along the direction of the traverse track 1 and includes spaced wheels 7—7 which are captured between top and bottom rails of the track, thereby providing the combination of a stable horizontal mounting platform for the vertical edge stabilizer 3 and easy, finger-tip traversal along the track. Other features may include a torque release arrangement (not shown) for releasably mounting the edge stabilizer to the platform 2 and allowing the edge stabilizer to pivot when a predetermined sideways force is applied, to prevent damage to the system.

Like all thing conceived by humans, the vertical cover support systems disclosed in my above patents are not perfect. Specifically, although the systems are quite effective, it is desirable to have a system of even greater simplicity and lighter weight which provides the stability, ease of traverse and other improved characteristics described in my above-described patents.

In addition to the vertical string ladder venetian blind systems mentioned above, there are available non-ladder, vertical blind cover systems comprising vertical slats which typically are suspended from a top traverse track (the slats are free at the bottom). These slats traverse open and closed along the longitudinal width of the track and the individual slats pivot about vertical mounting axes so that when the blind array is partially or wholly closed across the window opening, the slats can be pivoted open and closed in unison, similar to the horizontal opening and closing of horizontal venetian blinds.

The above vertical slat blind systems are not stable and move undesirably, for example, when subjected to air currents associated with heating or air conditioning outlets or wind. The movement includes longitudinal swaying (along their width, w, FIG. 2), distortion, which is in and out movement transverse to the plane of the cover (the plane of FIG. 2), and flutter, which is vibration about the vertical slat axis. Quite obviously, such movements detract from the proper function and enjoyment of the blinds, as well as their durability. For example, vibration can cause rapid deterioration of the blind mounting apparatus, damage to adjacent walls, etc.

3. SUMMARY OF THE INVENTION

In one aspect, the present invention is embodied in a window cover system which incorporates a longitudinally rigid, transversely flexible support tape for providing full displacement and automatic alignment, typically without rigid, heavy support structures such as edge stabilizers.

In another aspect, the present invention is embodied in a window cover system comprising: means, including an elongated traverse track, for supporting window cover means; a window cover means suspended from the traverse track and having at least one end freely suspended for traversing along the track; a support tape means, preferably longitudinally rigid and transversely flexible, having opposite ends and routed longitudinally therebetween through the cover means; and means for containing the tape against transverse movement. This arrangement provides full displacement and automatic alignment and squaring of the cover, typically without rigid, heavy support structures such as edge stabilizers.

Preferably the tape is relatively rigid along its length in the longitudinal direction generally parallel to the plane of the window cover, is relatively rigid along a transverse axis orthogonal to the length of the tape and to the plane of the cover, and is relatively flexible along another transverse axis which is orthogonal to the length of the tape and is in the plane of the cover. The window cover and containment means capture the tape which in turn supports and aligns the window cover.

In still another embodiment, the present invention is embodied in a window cover system, which comprises: means for supporting window cover means, comprising an elongated traverse track; a plurality of trolleys mounted on the track for traversing along the track; a window cover means suspended from the trolleys and having at least one free end for traversing along the track; at least one longitudinally rigid, transversely flexible support tape having two ends and being routed longitudinally therebetween along the cover in the general direction of traverse for supporting the cover; and means for securing or containing the tape against transverse displacement.

In yet another embodiment, the tape is routed and contained along the bottom section of the cover, is routed vertically along the free end of the cover, and is routed and releasably contained along the track external to the free end of the cover, thereby enabling the tape to push and pull the cover and provide full displacement of the cover, and maintaining the desired vertical orientation of the free end.

In certain embodiments, the window cover system comprises end immobilizing means for fastening the end or ends of the tape(s) associated with the free end(s) of the window cover means. The immobilizing means fastens the tape end(s) to one another (where more than one tape is used) or fixedly relative to the means for supporting the cover, to stabilize the tape against slippage and thereby enhance alignment. The tied tape ends can be coiled or controlled by magnetic containment means. Immobilizing the ends is optional or not used in certain embodiments, such as sprocket versions, where the sprockets prevent slippage of the tape and provide uniform movement of the tape(s).

The present invention is also embodied in and applicable to flat and curved support tapes, to drape covers, to blind covers and, to combinations thereof.

Coved tapes may be preferred for long or heavy drapes or blinds because of the great push and pull energy which they provide, and in particular because of the push energy. This effects both opening and closing the cover and facilitates positive full displacement of the tape and the associated cover and maintaining the desired orientation of the cover, including during traversal. Please note, in addition to metal, such as steel, and magnetizable metal, the tape(s) used in these and in other embodiments can be other flexible materials having the desired transverse and longitudinal stiffness, including plastic and plastic coated metal.

Sprocket mounting arrangements such as the following permit simplified containment. A tape can be routed longitudinally through the window cover means and over a mating sprocket wheel at the free end, preferably mounted in or on an edge support member that is attached to end supports to the free/traversing end of the window cover means.

A plurality of tapes, typically upper and lower tapes, and associated sprocket(s) can be used.

In one dual tape, single sprocket embodiment of the present invention, a lower tape is routed through the window cover means, and vertically through containment means in or on an edge support member mounted along the free end of the window cover means, then is routed with the upper tape over the associated sprocket. This arrangement eliminates the third, magnetic containment means. Drive means such as a motor or a manual pull chain coupled to the single, upper sprocket drives the upper and lower tapes in unison, preferably at the same speeds and with the same top and bottom displacement of the tapes and the window cover means.

In a two tape, two sprocket embodiment, lower and upper sprockets are used and the lower tape is wound around the lower sprocket, then is routed with the upper tape around the upper sprocket. The sprockets can be coupled together by means such as a gear arrangement or an endless belt or chain so that the upper and lower sprockets and tapes move uniformly, at the same or selected speeds. Drive means coupled to the sprocket-coupling means, or to one of the sprockets, drives the sprockets and tapes in unison as described above. Alternatively, the tapes can be routed completely separately, with each having its end stored or coiled adjacent the associated lower or upper sprocket.

In presently preferred embodiments, the second and third containment means are eliminated in the two tape, two sprocket system, and in the single tape, single sprocket system in particular where the sprocket is substantially colinear with the single tape.

The system may include a fender mounted adjacent the sprocket for retaining the tape on the sprocket.

The various tape support systems can be used at both ends of the window cover means to provide a dual free end, dual traversing system.

Heavy, very sturdy tape(s) can be used with the above sprocket support systems. The sprockets assist the tapes in effecting the push and pull functions.

In one presently preferred arrangement of a support wheel drive system, a vertical support member such as a housing depends from the movable trolley(s) mounted to the traverse track for supporting the free end of the window cover means. Two tapes are routed through the window cover means and together over a support pulley, typically mounted in the upper section of the vertical support member. Elongated magnetic strip containment means is mounted within or to the vertical support member, typically in near-vertical orientation for controlling the winding and unwinding of the tape, in the manner of the other, previously mentioned third containment means. A movable weighted traveler unit is mounted over the tapes intermediate the support wheel and the magnetic containment means for maintaining the tapes in a generally U-shaped configuration within the vertical support member, to facilitate winding and unwinding movement. Preferably, the ends of the tapes are fastened (together) to the end of the magnetic containment means opposite the support wheel to prevent slippage and ensure movement in unison and to prevent detachment from the magnetic containment means.

The above support wheel arrangement is especially suited to pleated window covers and can be applied to both ends of the window cover. Where both edge support members are mounted for traversing movement, the result is a window cover which is easily moved at either or both ends, but maintains its alignment at rest and during movement (as do the other embodiments). In addition, the inherent stability and resistance to unwanted movement is such that, in combination with the ease of deliberate movement and the inherent alignment stability and positive displacement, the window cover system can be mounted in virtually any orientation, that is, with the support members and the window cover pleats oriented vertically, or horizontally, or at intermediate orientations.

In an alternative plural tape arrangement which permits simplified containment, the ends of the tapes are fastened together causing the tapes to move in unison and eliminating the need for the third magnetic containment means. This approach is used, for example, for tapes supported over non-sprocket wheels or pulleys. For example, the lower tape is routed through the window cover means, vertically through containment means in or on an edge support member that is mounted to the free end of the window cover means, then is routed together with the upper tape over the associated upper pulley or wheel. Preferably, a fender is mounted adjacent the wheel or pulley for retaining the tape thereon. Again, the support arrangement can be used at either or both ends of the window cover means.

The window cover system according to the present invention is also embodied in a tape-supported, combined blind and drape embodiment, in which the window cover means comprises an assembly of vertical slats pivotally suspended by trolleys from the traverse track for opening and closing movement along the traverse track. The system further comprises a drape; and hinge means mounting the drape to the assembly of slats for opening and closing movement therewith. The first containment means comprises sleeve members having slots for receiving the tape and being mounted proximate the bottom of the slats and pivotal therewith for supporting and routing the tape along the slat assembly. Preferably, the slats are mounted to the trolleys off-center for offsetting the weight of the drape. In another aspect, the second containment means comprises a vertical edge support member suspended from the track and adapted for routing the tape therethrough between the traverse track and the first containment means; said drape being attached to the vertical edge support member.

The window cover system according to the present invention is also embodied in another tape-supported, combined blind and drape system comprising a drape and an assembly of vertical slats pivotally suspended by trolleys from the traverse track for opening and closing translational traversing movement along the traverse track. Here, the first containment means comprises containment housings mounted proximate the bottom of the slats and arms pivotally mounted within the containment housings for pivotal movement about vertical axes proximate the pivot axes of the slats. The pivot arms have horizontal slots therein for routing and containing the tapes. A plurality of hinge means are provided mounting the drape to the pivot arms for opening and closing translational movement therewith and permitting pivotal movement of the slats independent of the drape. Again, preferably, the slats are mounted to the trolleys off-center for offsetting the weight of the drape. In another aspect, the second containment means comprises a vertical edge support member suspended from the track and adapted for routing the tape therealong between the traverse track and the first containment means. The free end of the drape is attached to the vertical edge support member and the plurality of hinge means attach the drape to the slat pivot arms such that the position of the drape is substantially unaffected by pivotal movement of the slats.

In a link-controlled, tape-supported blind embodiment of the present invention, the window cover means comprises an assembly of vertical slats pivotally suspended by trolleys from the traverse track for opening and closing translational traversing movement along the traverse track; the first containment means comprises containment housings mounted proximate the bottom of the slats and arms pivotally mounted within the containment housings for pivotal movement about vertical axes proximate the pivot axes of the slats; the pivot arms have horizontal slots therein for routing and containing the tape; and the system also includes link means attached to the pivot arms and spanning adjacent slats for limiting the spacing between the adjacent slats and such that the position of the links is substantially unaffected by pivotal movement of the slats.

Another tape-supported embodiment of the present invention includes a plurality of edge members. Each of the edge members has first and second edges and includes means for attaching a window cover material thereto. The edge members are suspended, as by trolleys, vertically from a traverse track, and are moveable in a horizontal direction for opening and closing the cover system. Adjacent ones of the edge members are spaced-apart and held in a generally parallel relationship to each other by at least first and second foldable spacer-members.

The foldable spacer members each include first and second plate members, each of the plate members having first and second generally parallel edges. The plate members are attached together at the first edges thereof by first hinge means. The first hinge means is arranged such that the plates can be folded together in a generally face to-face relationship for opening the window cover, and opened to a predetermined maximum angle to each other for closing the window system. The second edge of each of the plate-members is attached to a corresponding one of the adjacent edge-members by second hinge means.

The first hinge means includes a hook-shaped slot formed on the first edge of the first plate member and a bead formed on the first edge of the second plate member. The first and second plate members are attached together by pressing the bead into the hook-shaped slot.

The first spacer member is located between the adjacent edge members at an upper portion thereof, and the second spacer member is located between the adjacent edge members at a lower portion thereof. The system further includes first and second support or traverse tapes. As mentioned, these tapes are rigid in a first. longitudinal direction in the plane of the tape and in a second, lateral direction transverse to the plane of the tape, and are flexible in a third direction in the plane of the cover, perpendicular to the other two directions. The first tape extends horizontally through the edge-members and the first spacer-members via horizontal slots therein, and the second tape extends horizontally through the edge-members and the second spacer members via horizontal slots therein.

In another aspect, the window cover material is in the form of a plurality of elongated slats, one thereof attached to the first edge of each of the edge-members. The slats are attached to the edge-members by third hinge means. The third hinge means provides for adjustable inclination of the slats with respect to the edge-members. In this aspect the invention takes the form of a vertical slatted or shutter blind.

In yet another aspect, a flexible window cover material is arranged in the form of a series of accordion-like vertical pleats. A plurality of edge-members, each thereof having first and second edges, are suspended vertically from a traverse track and are traversable in a horizontal direction for opening and closing the cover system. Each of the edge-members is attached, proximate the first edge thereof, to a particular one of the pleats.

An elongated slat is attached to the second edge of each of the edge-members. The slats are attached to the edge-members by hinge means. The hinge means provides adjustable inclination of the slats with respect to the edge-members.

First and second support or traverse tapes are provided, each tape is rigid in lateral and longitudinal directions in the plane of the tape and flexible in a direction perpendicular to the tape. The first support tape extends freely through each of the edge-members via a horizontal slot in an upper portion thereof, and the second traverse tape extends freely through each of the edge-members via a horizontal slot in a lower portion thereof.

In both of the above described embodiments of the present invention, the first and second traverse tapes, arranged as described, are particularly effective in restricting in-and-out distortion motion of the cover system. The foldable spacer-members are particularly effective in limiting side-to-side swaying motion, as well as in maintaining parallelism and spacing of the edge-members and cover material attached thereto, and in restricting flutter.

The present invention is embodied in a window cover system which is suitable for vertical mounting of a cover such as the SILHOUETTE blind and comprises a generally rectangular frame having an upper horizontal frame-member and first and second vertical frame-members. Roller means are attached to the upper horizontal frame-member proximate the first vertical frame-member. The roller means extends vertically downward from the upper horizontal frame-member.

The system includes an elongated traverse track. The traverse track is pivotally attached at a first end thereof to a first point on the upper horizontal frame-member proximate said second vertical frame-member, and is attached in translatable fashion proximate a second end thereof to the upper horizontal frame-member at a second point on the horizontal frame-member between the first point and the roller means.

An exemplary box pleat blind comprises first and second generally rectangular fabric panels attached together in a face-to-face relationship and separated by a plurality of vertically-oriented fabric strips. The first and second panels are attached at one end thereof to respectively first and second edges of a rigid vertical edge member. The edge member is suspended in slidable and rotatable fashion from the traverse track by a first slide member. The fabric panels are attached at the other end thereof to the roller means, and are suspended from the traverse track by a plurality of second slide members, each thereof free to slide in the traverse track and attached to a particular one of the fabric strips.

A spacer tape is attached, at one end thereof, to the first slide-member. The spacer tape is attached at the other end thereof to the roller means, and attached at generally regular intervals therealong to each of the second slide-members. The spacer tape may be the same as the support tape, that is, the spacer tape may be substantially rigid longitudinally along the tape and transverse to the plane of the tape and flexible in the plane of the tape transverse to the tape.

Drive means are provided for operating the roller means and traversing the edge-member, for rolling and unrolling the panels onto and from the roller means, thereby opening and closing the window cover system.

When the edge-member is traversed between open and closed positions the edge-member is rotated such that the separation between the first and second panels is minimized. A downward-extending stop-member is attached to the upper horizontal frame-member proximate the second vertical frame-member. The stop-member is configured and positioned such that when the edge-member is traversed in a direction towards a closed position, the first edge thereof contacts the stop-member. If the edge-member is traversed further in the same direction, the edge-member is caused to rotate such that separation between the fabric panels is increased.

In another embodiment, the present invention is embodied in a horizontal roller blind system, comprising a track means; a box blind comprising a plurality of longitudinal vanes or box pleats extending generally horizontally and opposite, top and bottom ends; a roller having a top end of the box blind attached thereto; means rotatably mounting the roller to the track in a generally horizontal orientation, for winding the box blind on the roller and unwinding the box blind from the roller to raise and lower the box blind; a pleated blind having opposite, top and bottom ends and generally horizontal oriented pleats, the pleated blind being mounted at the top end thereof to the track adjacent the box blind such that the plane of the pleated blind and the plane of the box blind are generally side by side; an elongated rail attached to and positioning the bottom ends of the box blind and the pleated blind side by side; and at least one cord means attached at one end to the roller and at an opposite end to the rail and routed through or along the pleated drape, for winding and unwinding the cord to raise and lower the box blind and the pleated drape. The elongated rail is of or includes sufficient weight to lower the box blind and the pleated drape in unison when the cord means is unwound. The arrangement orients the vanes generally horizontally in the dimension transverse to the longitudinal dimension of the vanes, and the rail pivots and flattens the box pleats during raising of the blinds, thus facilitating flat storage of the box blind on the roller.

In yet another embodiment, the present invention is embodied in a tape supported, wheel assisted window cover system, comprising a horizontal track; a window cover having at least on free end; means for mounting the window cover to the track for traversing the at least one end open and closed along the track; at least one transverse housing member having an internal compartment and mounted along the free end of the window cover and extending transverse to the track; tape means comprising first and second, upper and lower tapes routed through the upper and lower sections of the window cover and into the compartment of the transverse housing member; containment means for routing the tapes through the cover in the direction of elongation of the traverse track; and upper and lower support wheels rotatably mounted within the compartment of the transverse housing member. The lower tape can be routed over the lower support wheel and the tapes then routed together over the upper support wheel and the ends of the tape are tied together, for ensuring movement of the tapes in unison into and out of the compartment, to effect push and pull action by the tapes and provide positive traversing displacement of the cover and maintain the alignment of the cover relative to the track as the tapes move into and out of the compartment. In a related aspect, the supporting tape arrangement is adapted for widening the length of traverse of the cover in that sections of the tapes at the ends thereof comprise magnetizable material; elongated magnetic containment means is mounted within the housing compartment for releasably capturing the ends of the tapes when the tapes are wound into the compartment and releasing the tapes when the tapes are withdrawn from the compartment; and a traveler unit slidably captures the tied tapes intermediate the containment means and the support wheel, and pulls the intermediated section of the tapes downward for maintaining the tapes in an elongated configuration to facilitate capture and release by the containment means.

The present invention is also embodied in a tape supported, dual sprocket-assisted window cover system, comprising a horizontal track; a window cover having at least on free end; means for mounting the window cover to the track for traversing the at least one end open and closed along the track; at least one transverse housing member having an internal compartment and mounted along the free end of the window cover and extending transverse to the track; tape means comprising first and second, upper and lower tapes routed through the upper and lower sections of the window cover and into the compartment of the transverse housing member; containment means for routing the tapes through the cover in the direction of elongation of the traverse track; and upper and lower sprockets rotatably mounted within the compartment of the transverse housing member. The tapes contain slots therein and the lower tape is routed over the lower sprocket and the upper tape is routed over the upper socket such that the slots are engaged by the sprockets for moving the tapes into and out of the compartment, to effect push and pull action by the tapes and reversibly traverse the free end of the window cover along the track. The system includes means interconnecting the upper and lower sprockets; and means for reversibly rotating the interconnecting means to rotate the sockets in unison for driving the tapes into and out of the compartment in unison, such that the associated free end of the window cover is traversed reversibly along the track, whereby the tapes maintain positive displacement of the cover during traversal and maintain the alignment of the cover relative to the track. In related aspects, the system may comprise transverse housing members mounted along each end of the window cover; both ends of the window cover are free to traverse along the track; and upper and lower sockets, interconnection means and drive means are mounted on each of the transverse housing members.

In the present invention, the tape provides the support and alignment functions previously supplied by hardware if at all. As a result, hardware can be eliminated and the system including edge support or containment members can use lightweight components of material such as plastic. The lightweight, simplified, readily manufacturable and assembled system is easy to install and to operate, yet is resistant to flutter, vibration, etc. and provides complete displacement or transfer of top and bottom sections and vice versa and thus accurate squaring and alignment during traversal of the window cover.

4. BRIEF DESCRIPTION OF THE DRAWINGS

The accompanying drawings, which are incorporated in and constitute a part of the specification, schematically illustrate preferred and alternative embodiments of the invention and, together with the general description given above and the detailed description of the preferred embodiment given below, serve to explain the principles of the invention.

FIG. 1 is a schematic front elevation view, and FIG. 55 is an enlarged partial section thereof, depicting a vertical cover system disclosed in my incorporated patents, U.S. Pat. Nos. 4,858,668 and 4,915,153.

FIGS. 3 and 4 are front and rear perspective views, respectively, of a vertical hollow pleat embodiment of the present invention.

FIG. 5 is a partial perspective view depicting a flat tape version of the hollow vertical pleat drapery embodiment of FIGS. 3 and 4.

FIG. 6 is a horizontal sectional view taken along line 6—6 in FIG. 5.

FIGS. 7 and 9 are, respectively, a partial perspective view and a partial front elevation view which depict a curved tape version of the hollow vertical pleat drapery embodiment of the present invention.

FIG. 8 is a horizontal sectional view taken along line 8—8 in FIG. 7.

FIG. 13 is a perspective view of a dual traverse sprocket-assisted system embodiment of my tape-supported cover system.

FIG. 15 is a relatively enlarged, perspective view of the sprocket arrangement of FIGS. 13 and 14.

FIGS. 24 through 27 depict the use of my tape support in conjunction with vertical drapery systems which incorporate various pleated materials.

Figures 31, 32, 33, 34, 35, 36:
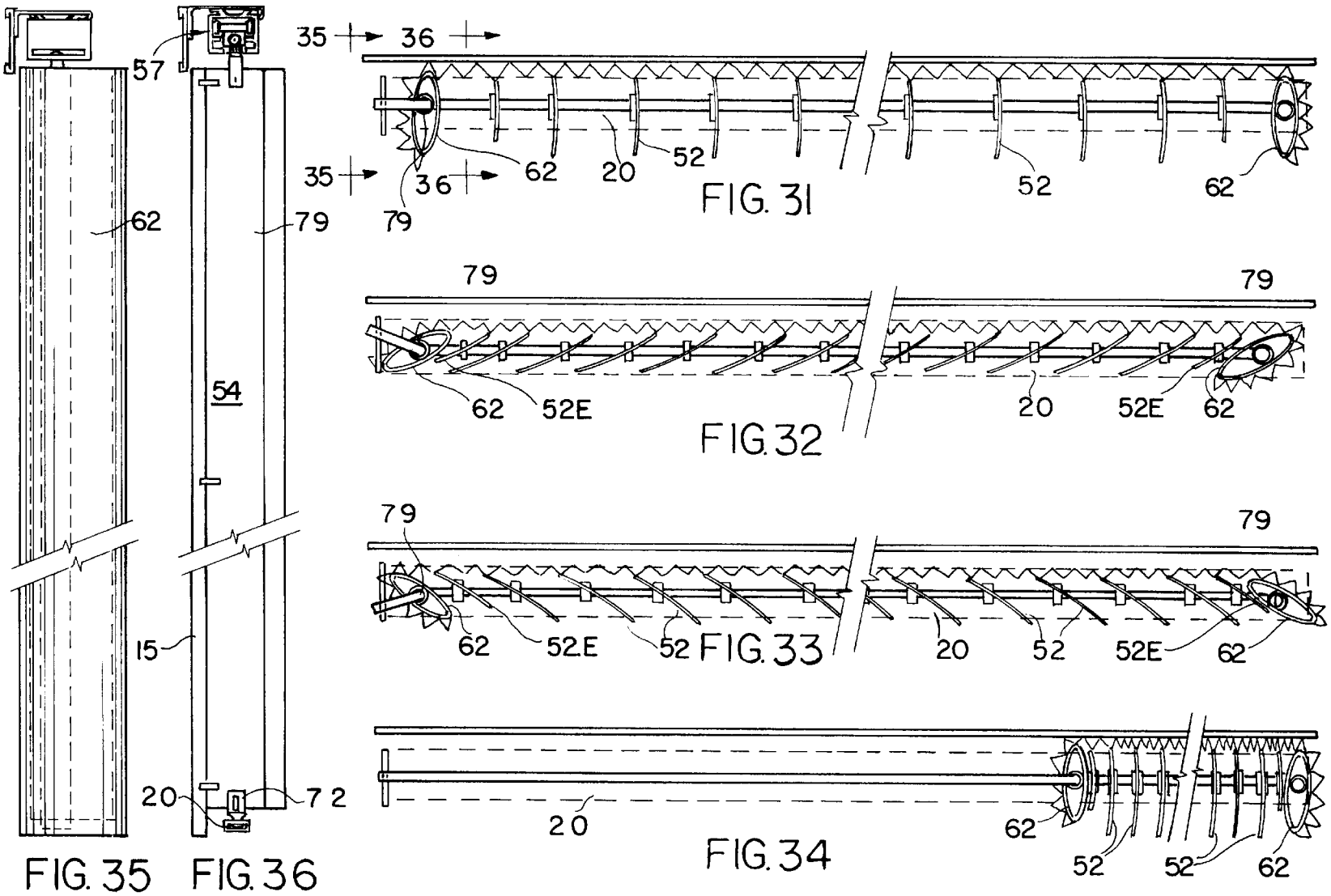
FIGS. 31 through 34 are top plan views of the combined vertical pleated silhouette blind system shown in FIG. 28, with the traverse track removed, showing the operation of the system.

FIGS. 35 and 36 are vertical sections (FIG. 35 is essentially an end view) taken along lines 35—35 and 36—36 in FIG. 31.

Figure 28:
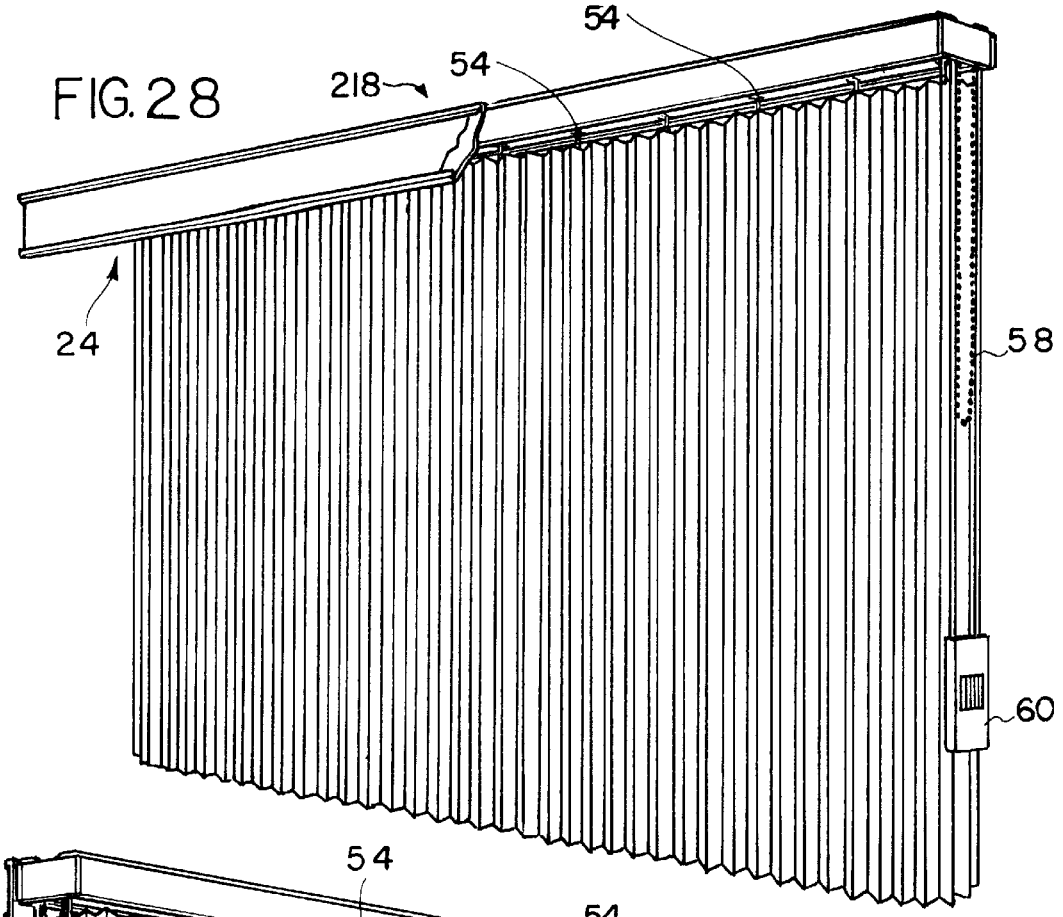
FIGS. 28, 29 and 30 are, respectively, a front perspective view, a rear perspective view and a relatively enlarged, partial front perspective view, partially cut away, all of an embodiment in which a tape support system and a vertical pleated silhouette drape are combined with a conventional vertical blind system to form a vertical pleated silhouette blind system.
Figure 29:
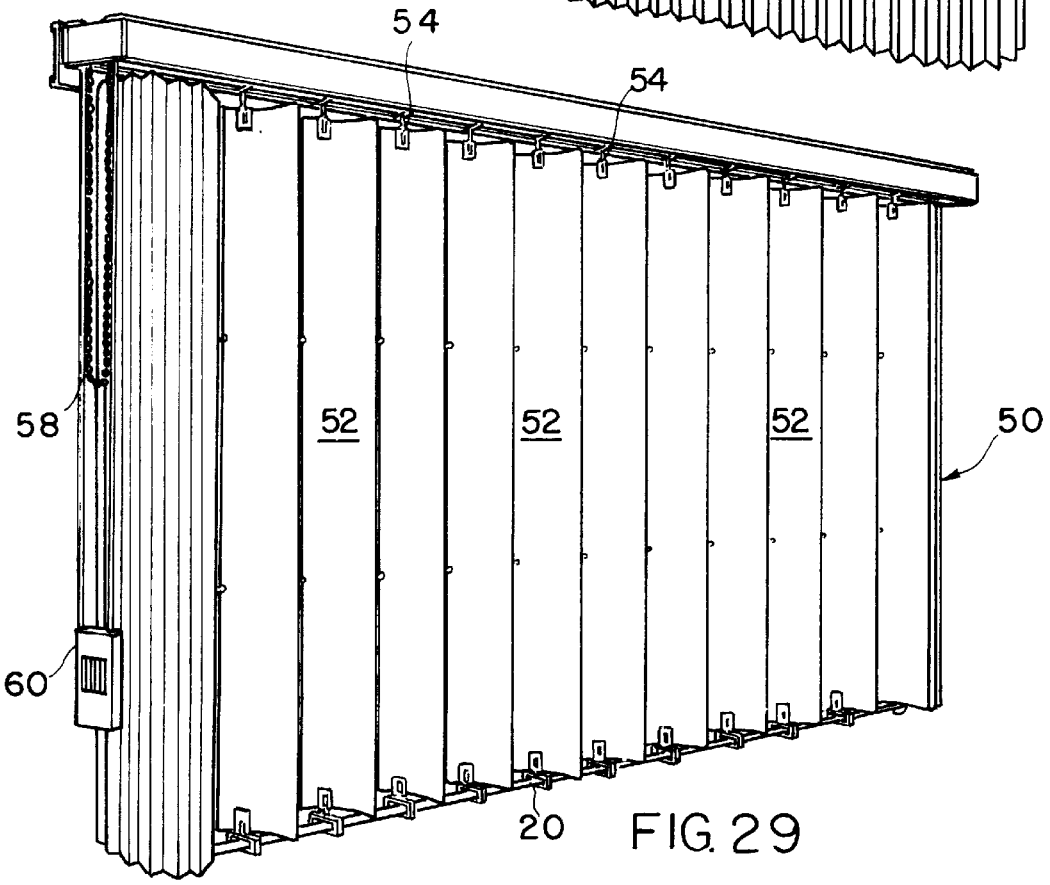
Figure 30:
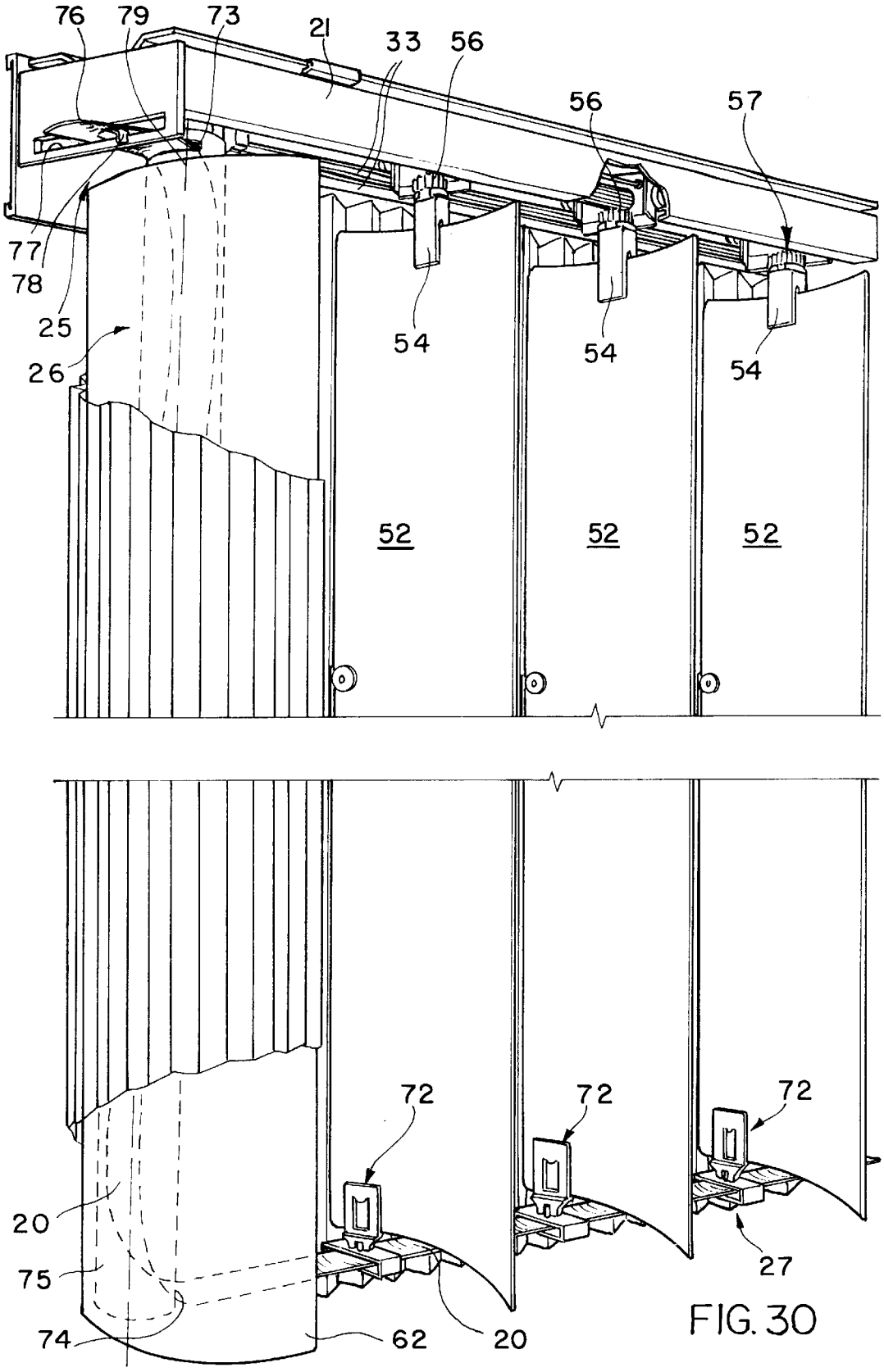

FIG. 37 depicts a representative slat from the system of FIGS. 28–30 and associated mounting details.

FIG. 38 is a partial front elevation view, partially cut away, of an alternative embodiment of the combined vertical pleated silhouette blind system shown in FIG. 30, which incorporates a pivotal-link tape-support arrangement for routing the tape through the blinds.

FIGS. 39 and 40 are horizontal sectional views of an end stiffener useful in the system of FIG. 38.

FIGS. 41 and 42 are side and end elevation views of a pivotal link support member.

FIG. 43 is a top view of the member of FIG. 41.

FIG. 44 is a partial perspective view of a slat illustrating the mounting relationship of the slat, the pivotal link support member and the tape.

FIG. 45 and 46 are horizontal views of different open and closed conditions of the system of FIG. 38, illustrating the pivotal operation of the pivotal link support members during opening and closing of the off-center-mounted slats.

Figure 47:
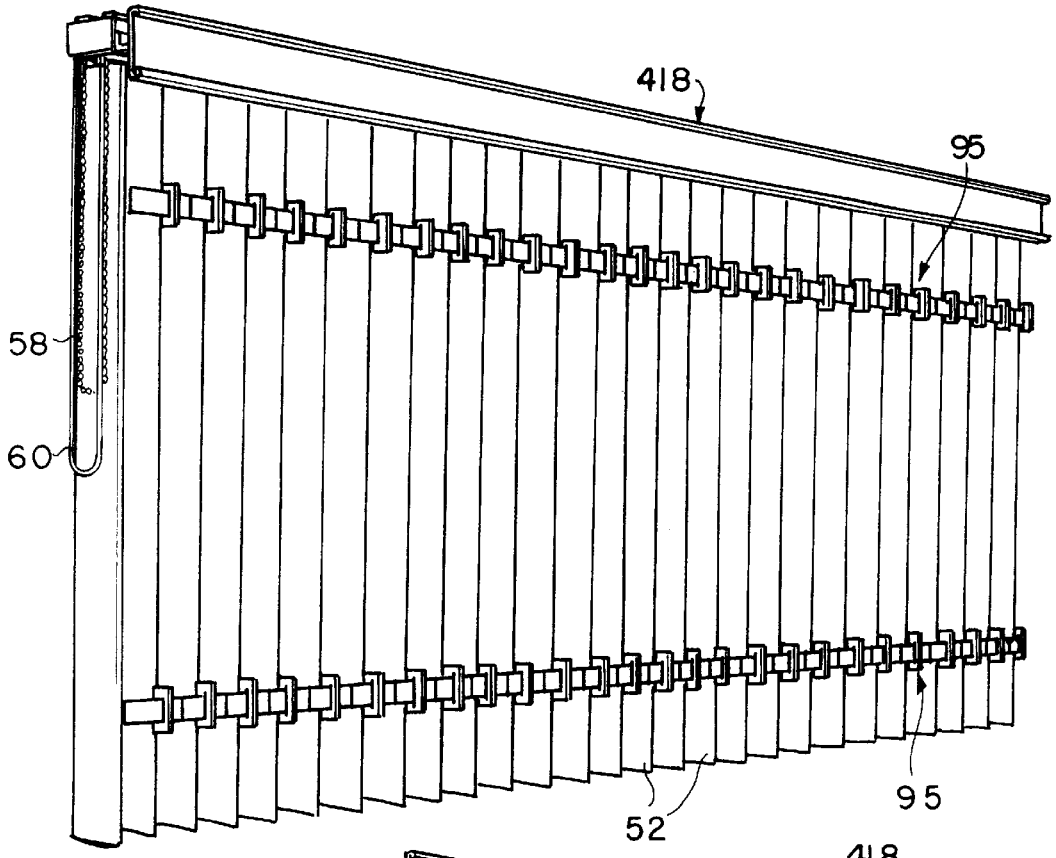
Figure 48:
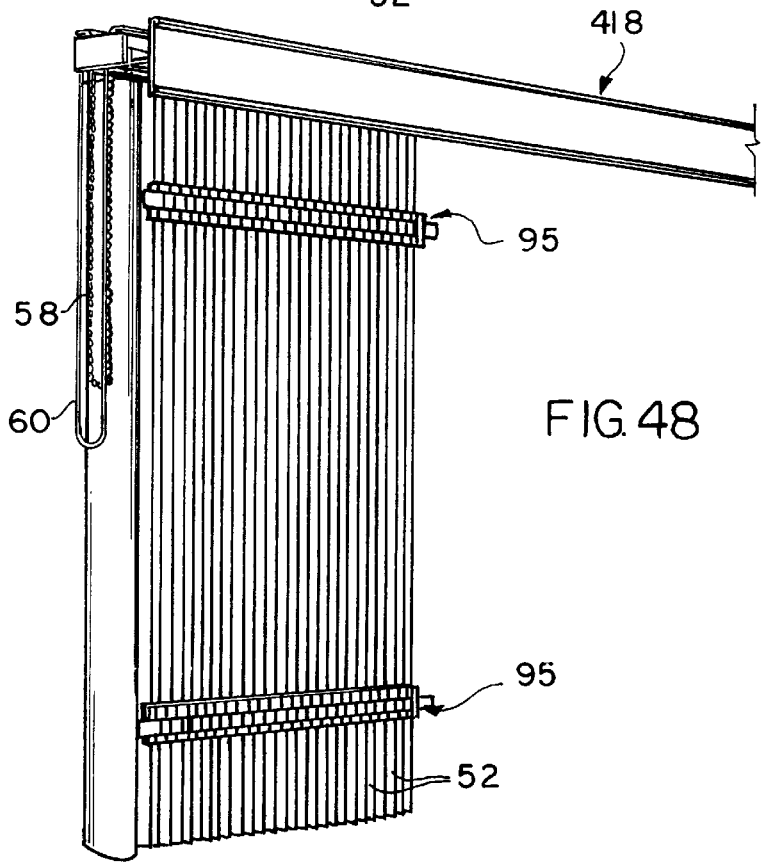

FIGS. 47 and 48 are front perspective views illustrating the closed and open condition of a vertical blind which incorporates a combination tape and telescopic link support system.

FIG. 49 is a partial perspective view of a slat of FIG. 47 and 48, illustrating the mounting relationships among the slat, the pivotal support member, the tape and the link(s).

FIG. 50 is a side elevation view of one of the pivotal support members of FIG. 47, illustrating the mounting relationships among the member, the tape and the link(s).

FIG. 51 is a top view of the pivotal support member of FIG. 50.

FIGS. 52, 53 and 54 are partial horizontal views (in the manner of horizontal section views) of different open and closed conditions of the system of FIGS. 47 and 48, illustrating: both the blind system and the slats in an open condition (FIG. 54); the blind system closed (extended) and the slats open (FIG. 52); and both the blind system and the slats closed (FIG. 53).

Figure 56:
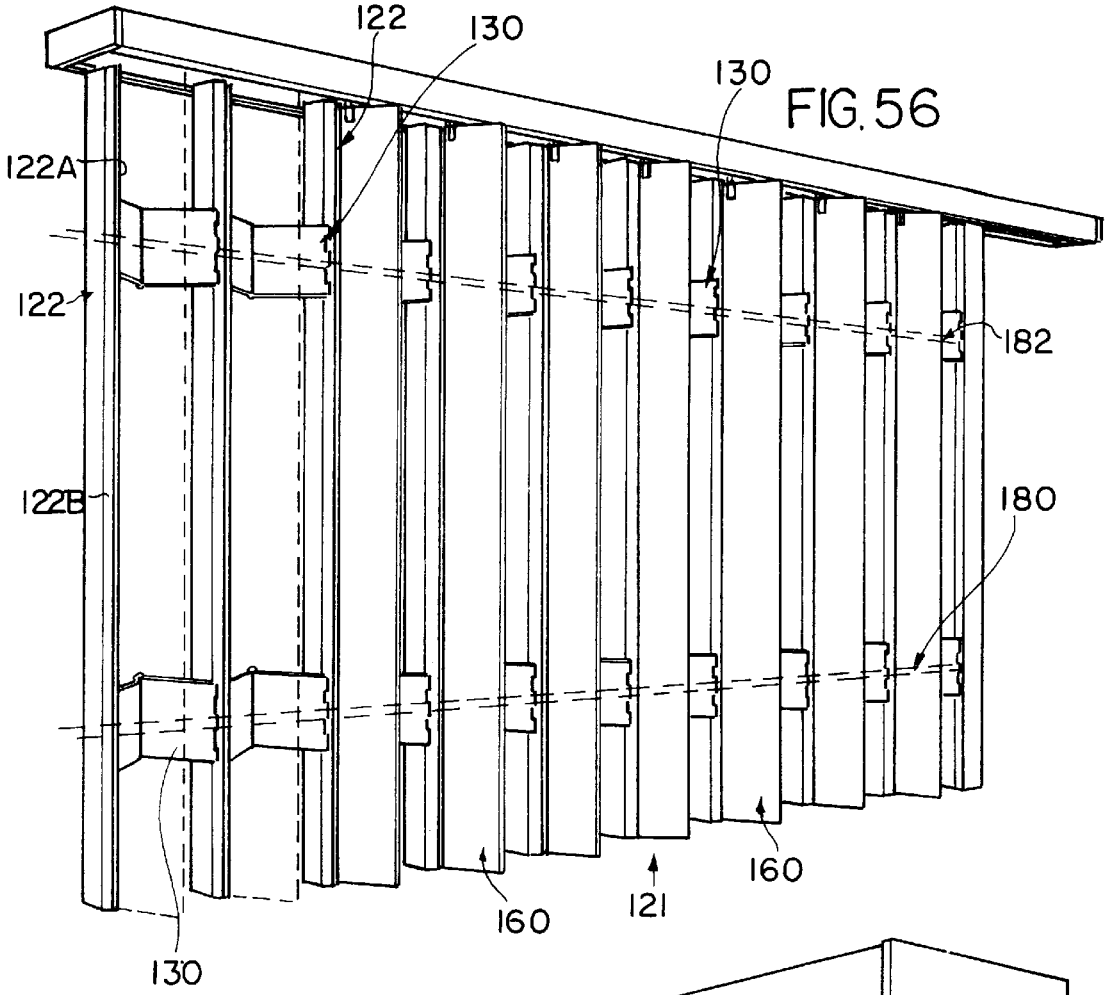

FIG. 56 is a perspective view schematically illustrating one embodiment of a Shutter Drape window cover system in accordance with the present invention.

Figure 57:
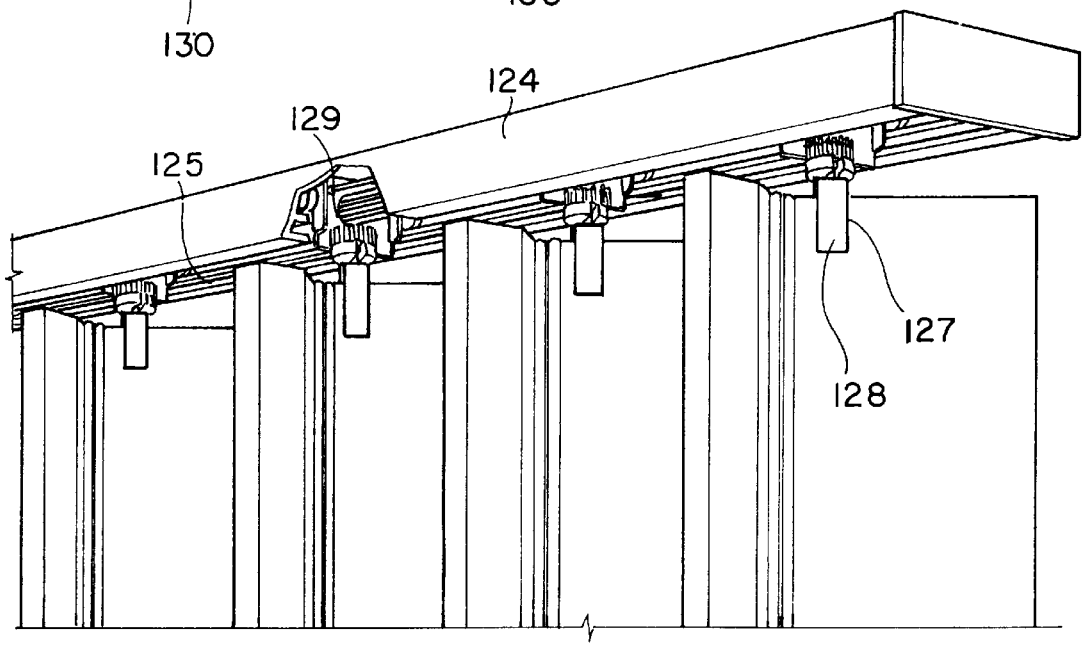

FIG. 57 is a rear perspective view, partially cut away, of FIG. 56 illustrating an arrangement for suspending an edge member from a traverse track in the Shutter Drape window cover system of FIG. 56.

Figure 58:
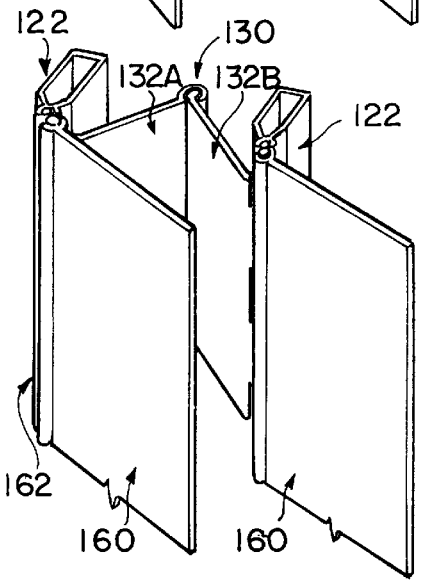
Figure 59:
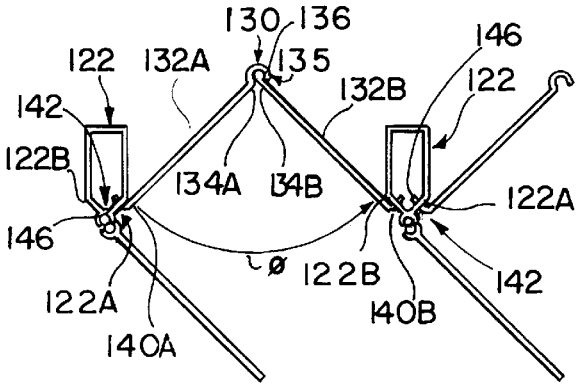

FIGS. 58 and 59 are respectively perspective and plan views schematically illustrating a foldable, hollow spacer-member attached to adjacent edge-members of the Shutter Drape cover system of FIG. 56.

Figure 60:
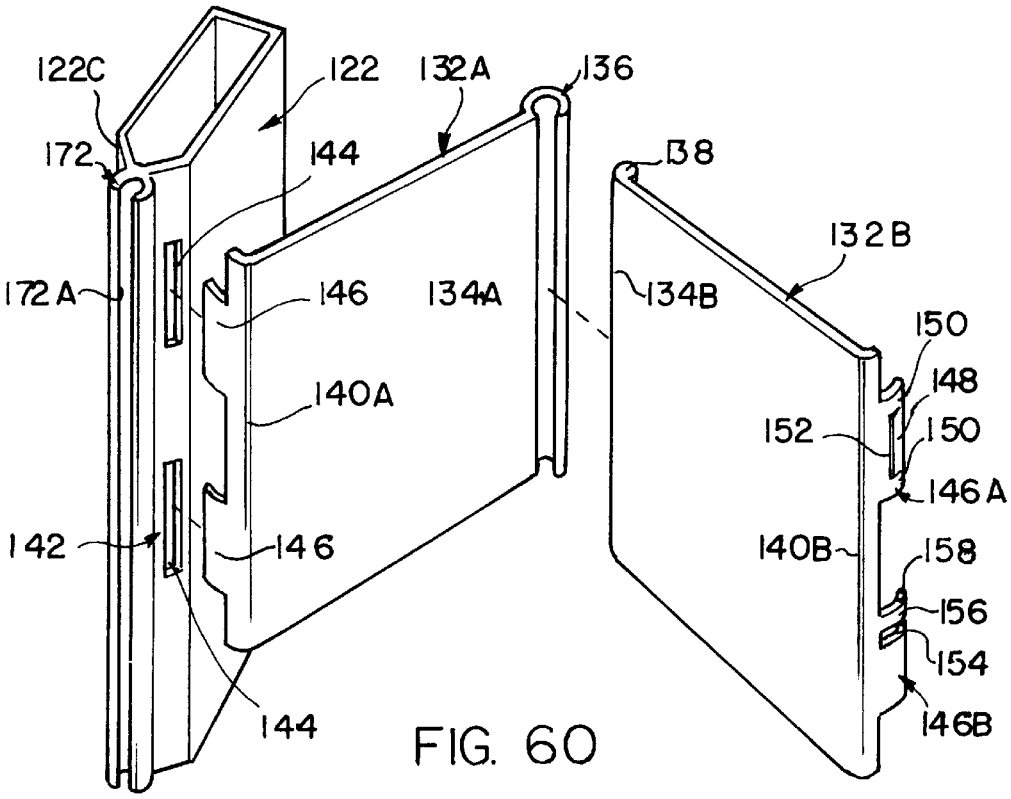

FIG. 60 is an exploded perspective view schematically illustrating the spacer member of FIGS. 58 and 59.

Figure 62:
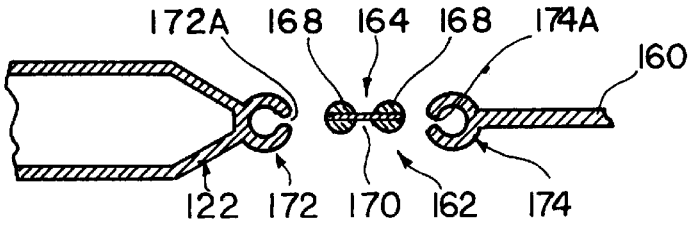
Figure 61:
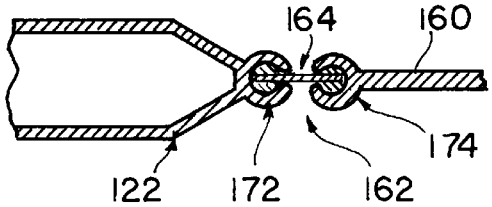

FIGS. 61 and 62 are respectively assembled and exploded cross-section views seen generally in the direction 61—61 of FIG. 58 and schematically illustrating a hinge arrangement for attaching a slat to an edge-member of FIG. 58.

Figure 63:
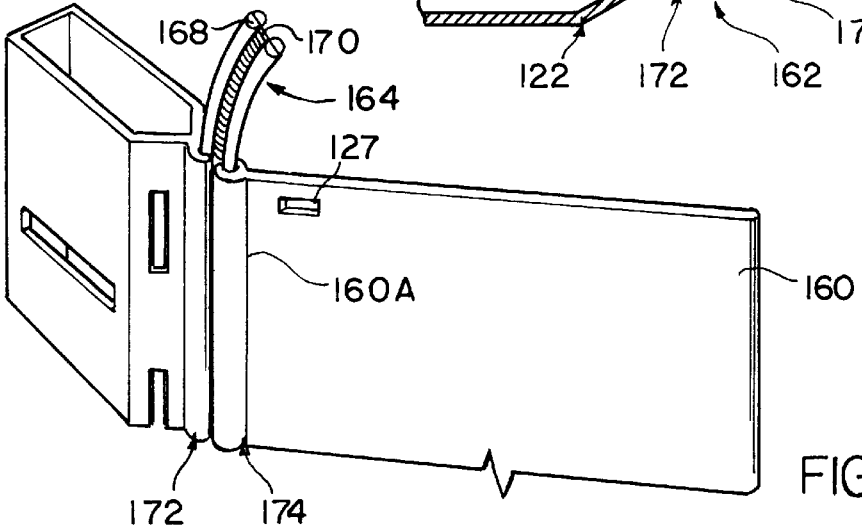

FIG. 63 is a perspective view schematically illustrating the hinge arrangement of FIGS. 61 and 62.

Figure 64:
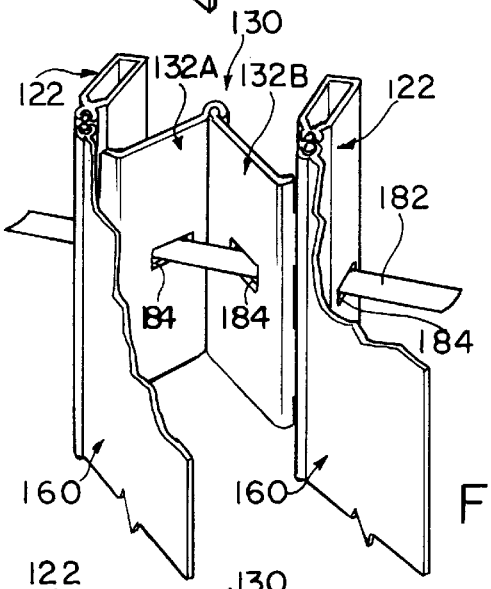
Figure 65:
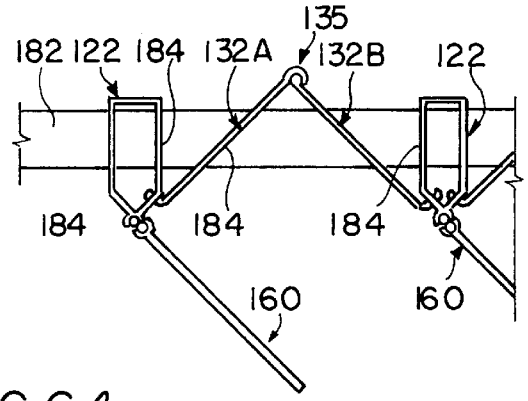

FIGS. 64 and 65 are respectively perspective and plan views schematically illustrating a preferred arrangement of traverse tapes extending through horizontal slots in the edge-members and foldable spacer-member of FIG. 58.

Figure 66:
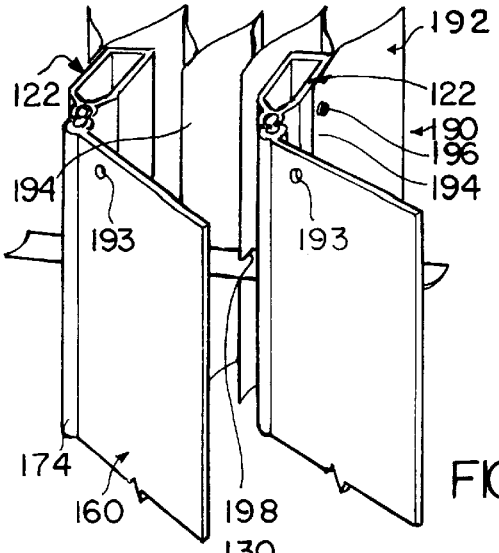
Figure 67:
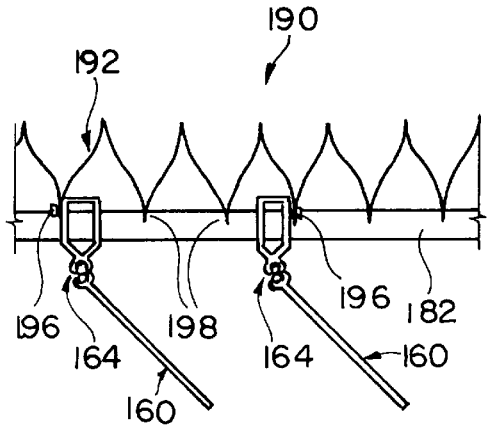

FIGS. 66 and 67 are respectively perspective and plan views schematically illustrating a Shutter Silhouette pleated window cover material attached to edge-members of FIG. 58.

Figure 68:
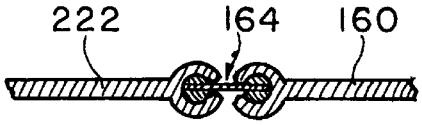
Figure 69:
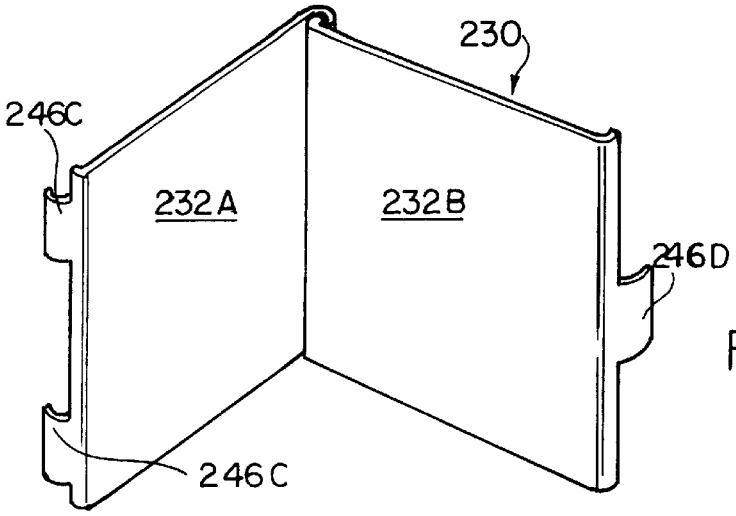

FIG. 68 is a horizontal cross-section view of the assembly of a slat to an alternative flat edge member and FIG. 69 is a perspective of an alternative foldable hinged spacer member adapted for attachment to the flat edge member.

Figure 70:
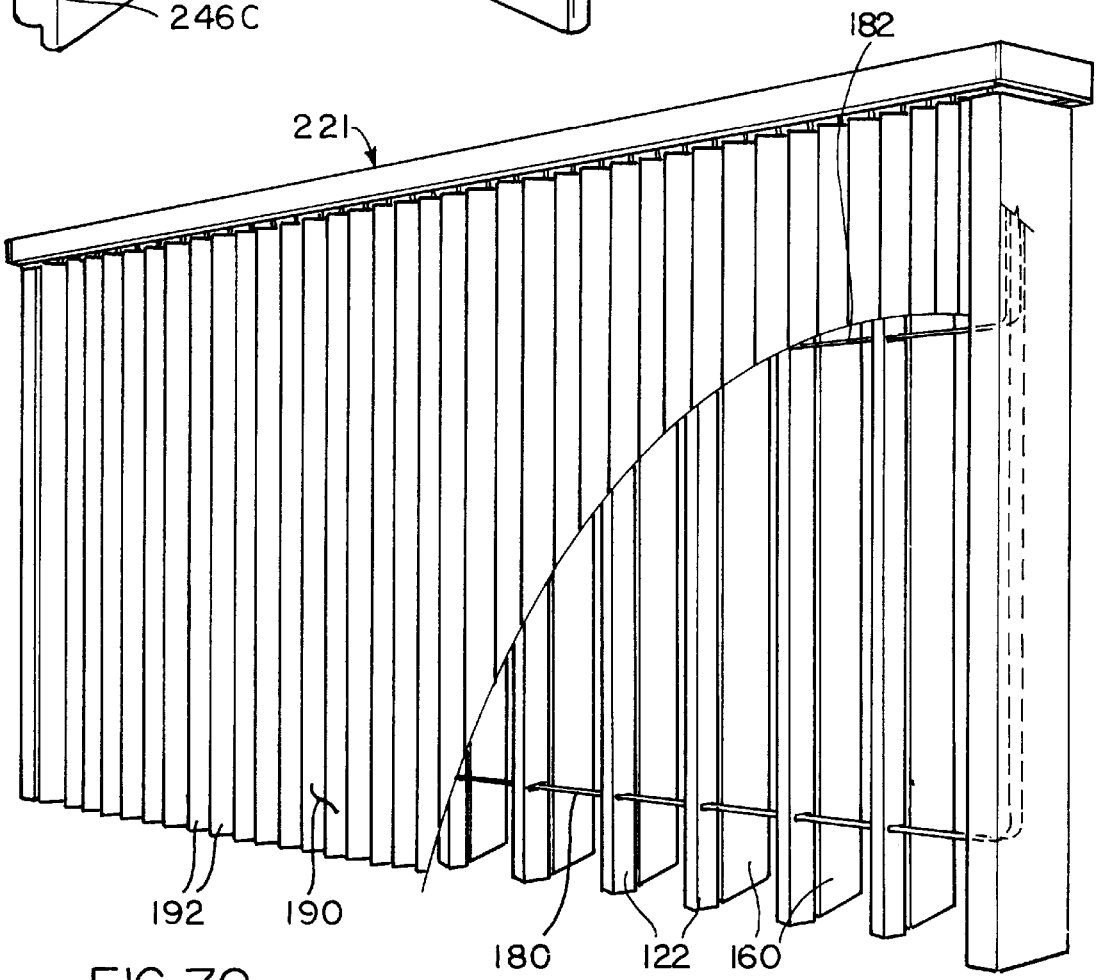

FIG. 70 is a perspective view schematically illustrating another embodiment of a Shutter Drape window cover system in accordance with the present invention.

Figure 71:
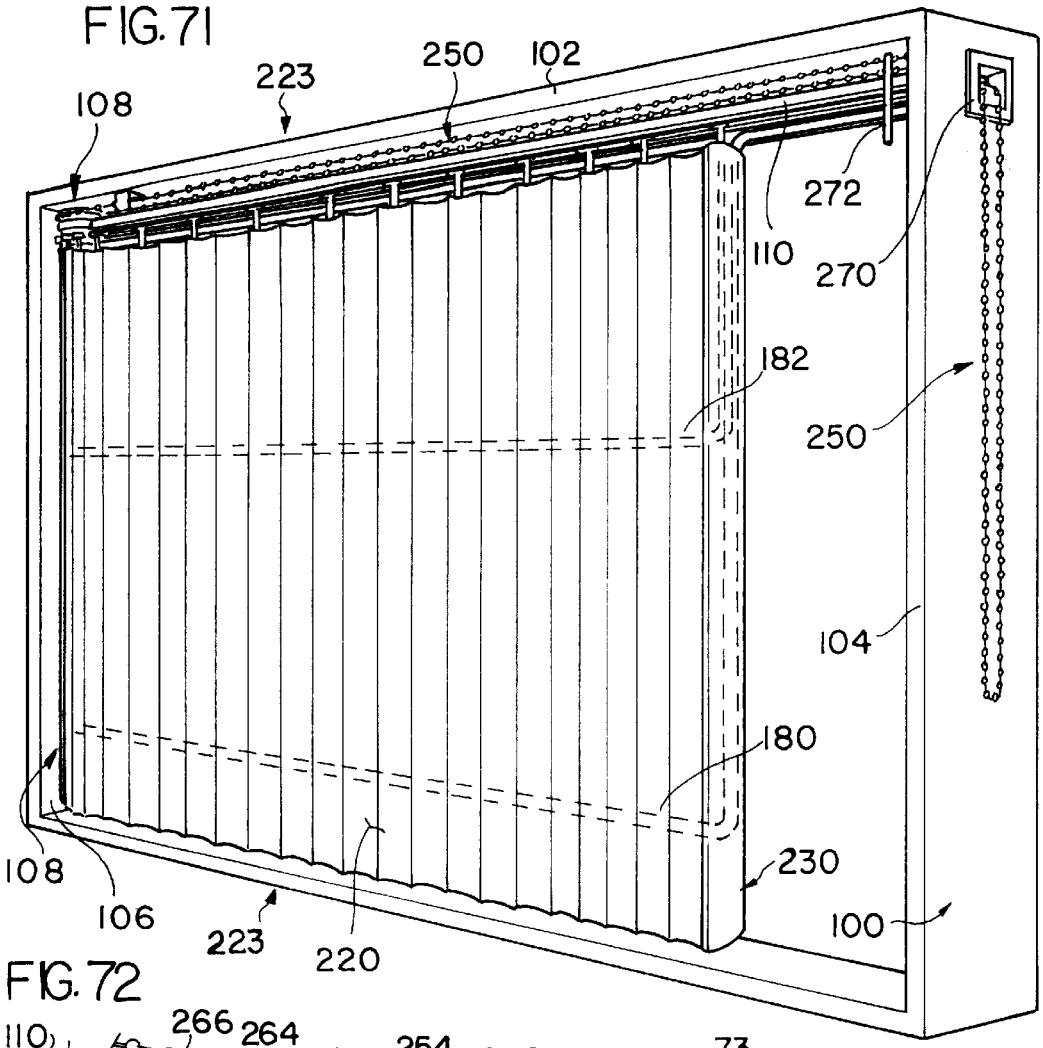

FIG. 71 is a perspective view schematically illustrating yet another embodiment of a window cover system in accordance with the present invention, a Vertical Silhouette cover system comprising a vertical box pleat drape.

Figure 72:
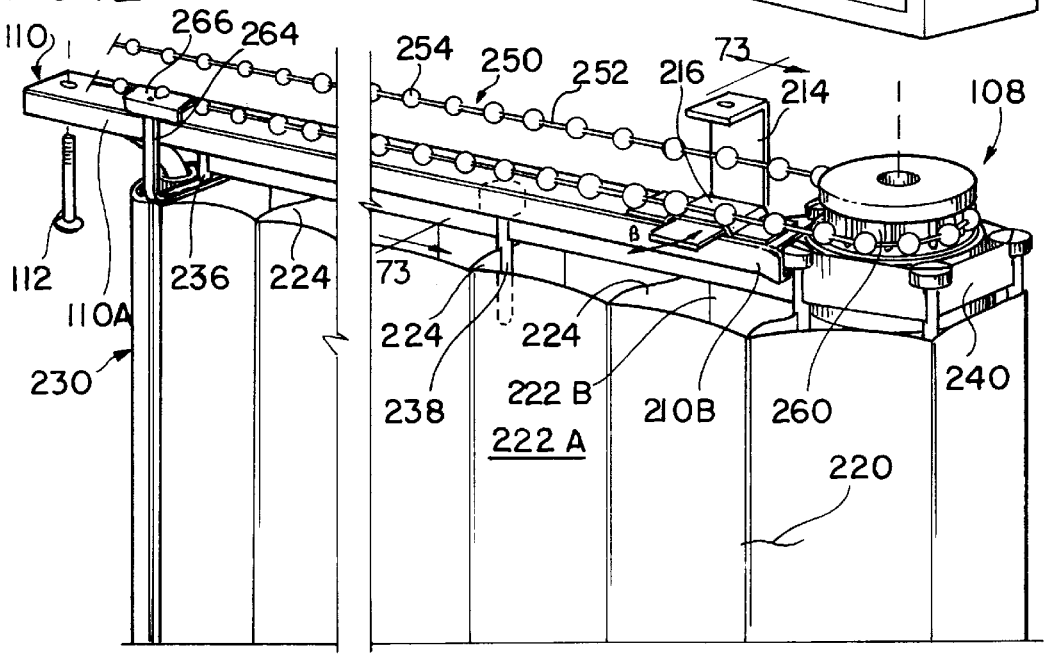

FIG. 72 is a perspective view schematically illustrating details of a drive mechanism and a traverse track mounting method for the Vertical Silhouette window cover system of FIG. 71.

Figure 73:
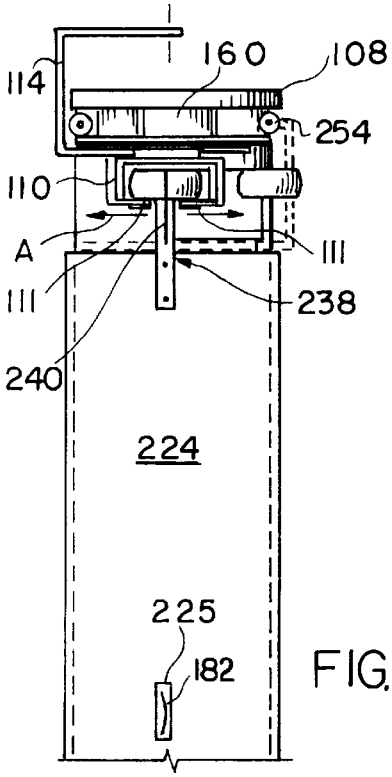

FIG. 73 is a cross-section view seen generally in the direction 73—73 of FIG. 8 schematically illustrating further details of the drive mechanism of FIG. 72.

Figure 74:
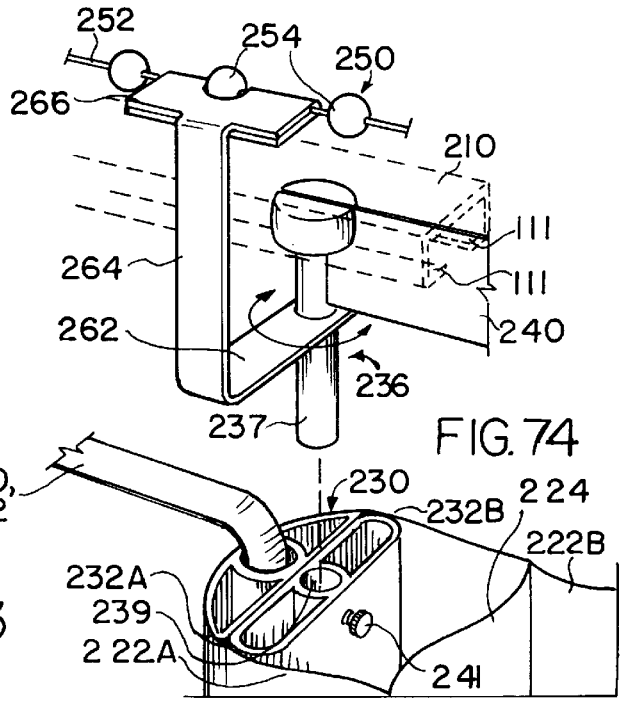

FIG. 74 is an exploded perspective view schematically illustrating details of attaching an edge-member of the Vertical Silhouette window cover system of FIG. 71 to the drive mechanism of FIG. 72.

FIGS. 75A–F are plan views schematically illustrating operating details of the drive mechanism of FIG. 72.

Figure 76:
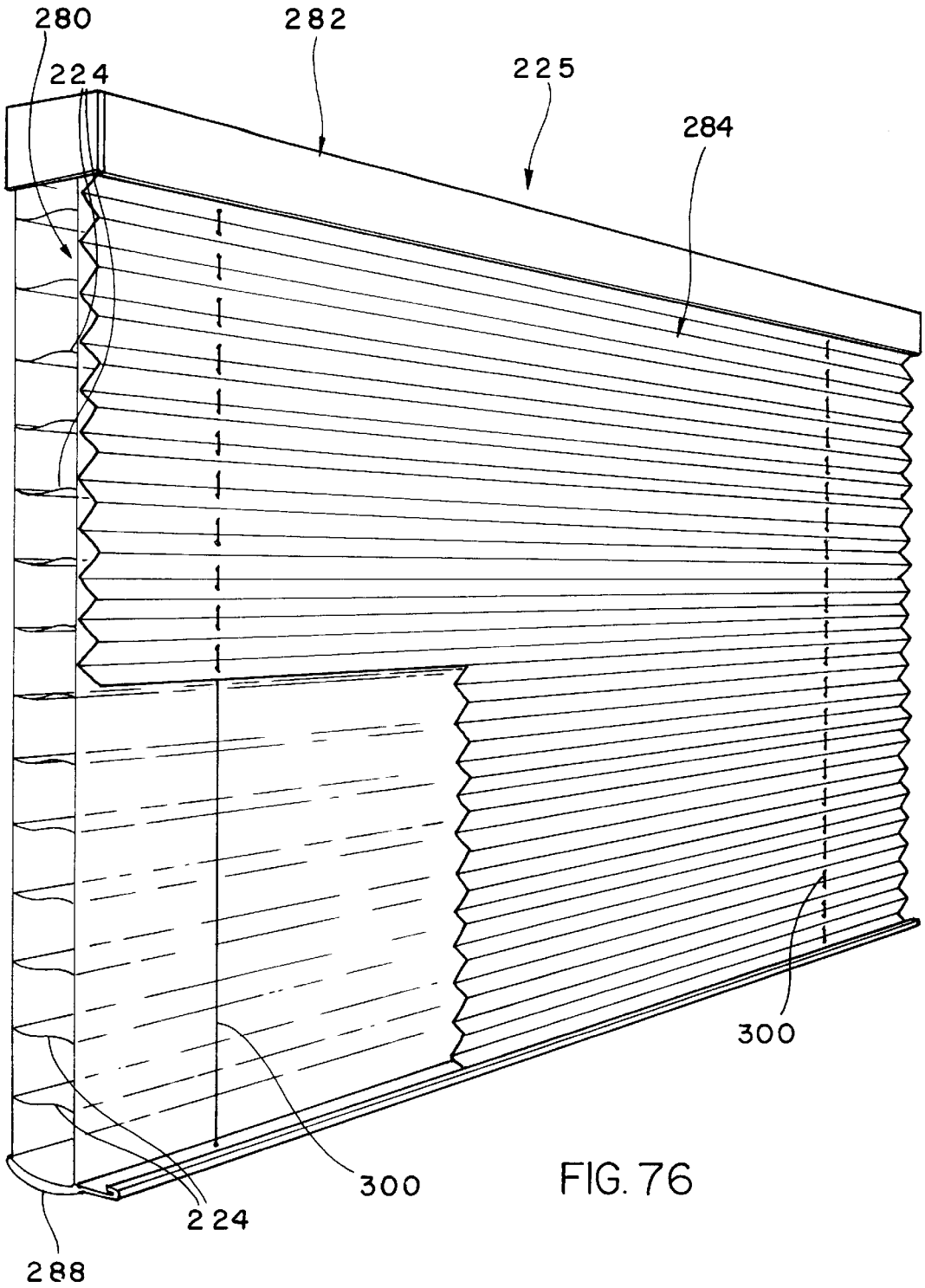

FIG. 76 is a perspective view schematically illustrating yet another embodiment of a window cover system, a Horizontal Pleated Silhouette window cover system, in accordance with the present invention.

FIGS. 77 and 78 are vertical cross-section views of the FIG. 76 Horizontal Pleated Silhouette window cover system.

FIG. 79 is an enlarged partial perspective view of the Horizontal Pleated Silhouette window cover system of FIG. 76.

Figure 80:
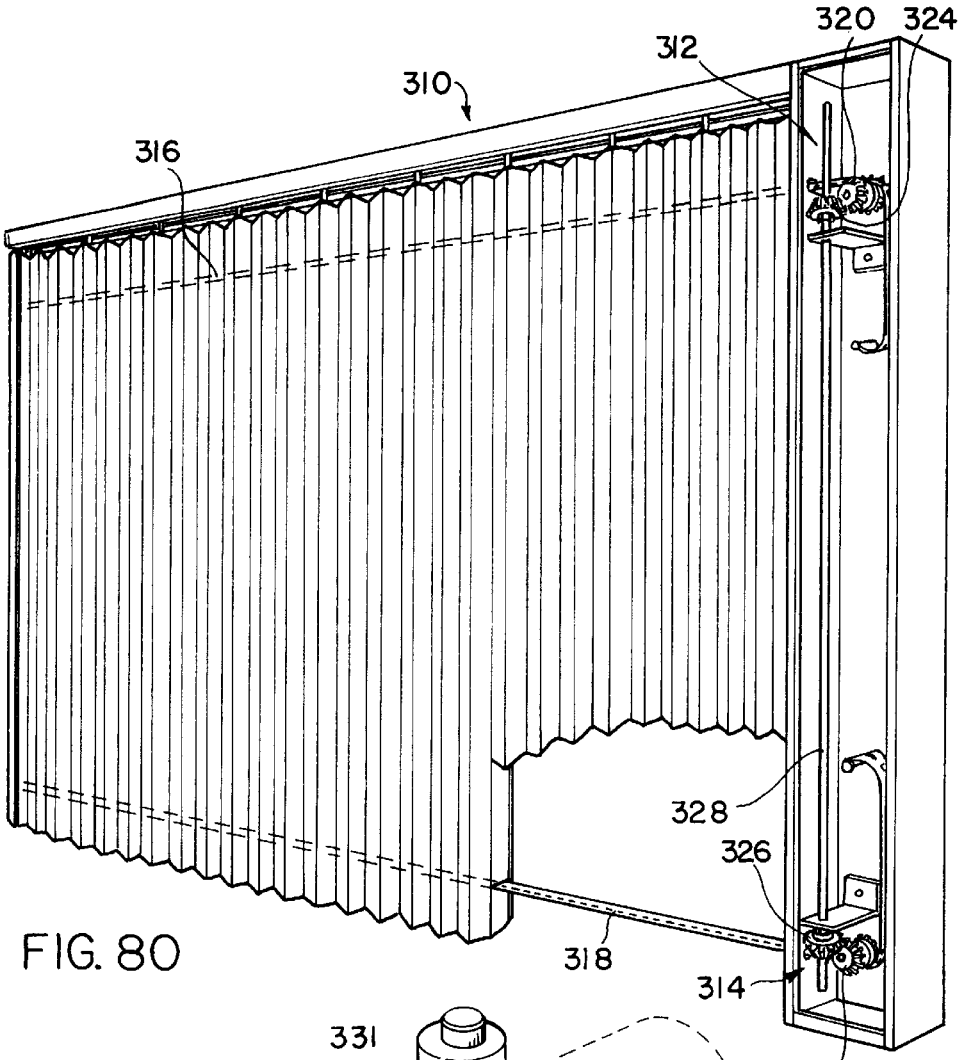

FIG. 80 is a front perspective view, partially cut away, of a window cover system incorporating a dual sprocket tape drive system in accordance with the present invention.

Figure 81:
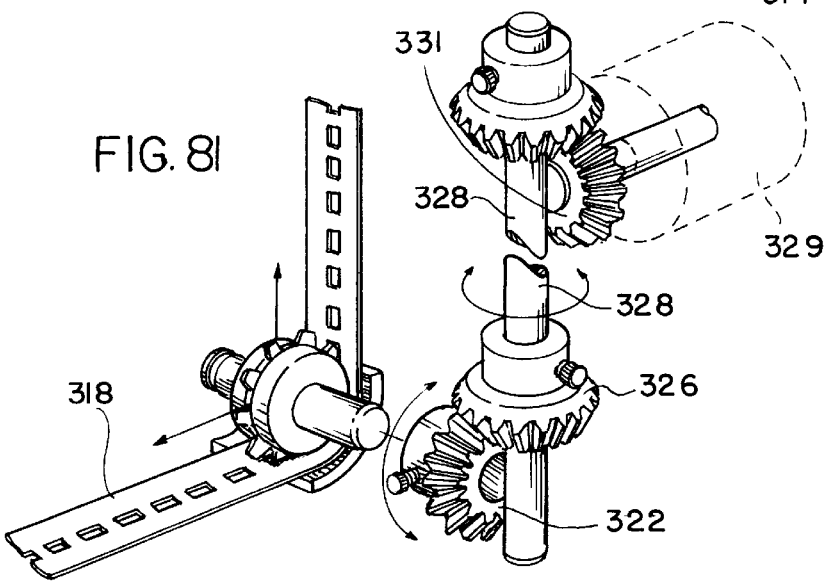

FIG. 81 is an enlarged view of the bottom right side of the dual sprocket tape drive system of FIG. 80.

FIGS. 82–85 depict alternative embodiments of the dual sprocket tape drive system of FIG. 80.

FIG. 86 is a front elevation view, partially cut away, of an end section of a window cover system including a dual tape drive system in accordance with the present invention.

FIG. 87 is an enlarged front elevation view of an end section of A window cover system including a dual tape drive system of FIG. 86.

5. DETAILED DESCRIPTION OF THE PREFERRED EMBODIMENT(S)

a) Overview of Tape-Supported Window Cover System 18

Figure 2:
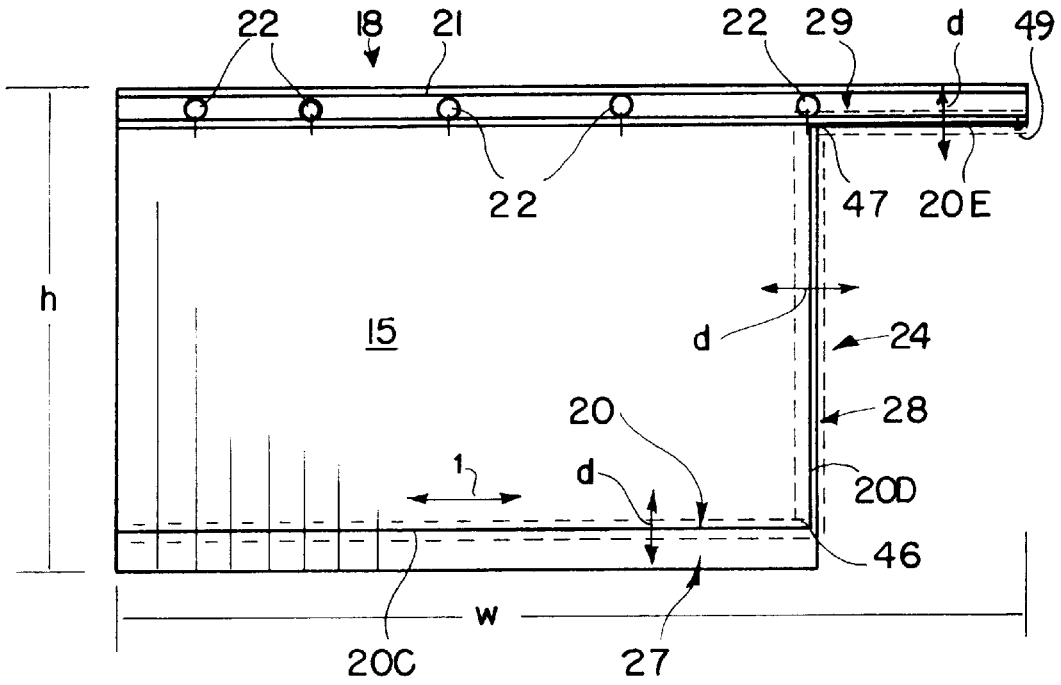
FIG. 2 is a schematic front elevation view which depicts a vertical cover system incorporating features of the present invention.

FIG. 2 is a schematic depiction of certain basic features of my new tape-based PLEATOUETTE window cover system, which is an improvement of the vertical window cover system disclosed in my above referenced '668 and '153 patents. FIG. 2 illustrates a single traversing system 18 in which the left end of the window cover 15 (such as a single pleat or hollow pleat drape) is immobile and the right end of the window cover is free to bidirectionally traverse between open and closed positions. (Please note, when the drapery or other cover is open, exposing the window, the material itself is closed (bunched); when the cover is closed, cover the window, the material itself is open. A member such as a flat support tape 20 which preferably is longitudinally rigid (along direction 1), transversely rigid orthogonal to 1 and the plane of the cover, and transversely flexible (along direction d) can replace a number of components of the systems disclosed in the '668 and '153 patents. These include the cord alignment system 6, FIG. 1, and the edge stabilizer system, including the horizontal platform 2 and the spaced support wheels 7—7 or other elongate support captured at spaced points by the traverse track, and the rigidly mounted edge stabilizer member 3. The exemplary system 18 includes means such as standard trolleys 22 for mounting the cover 15 at spaced intervals for traversal along track 21 and tape containment means 24 which constrains movement of the flexible tape in the transverse direction d.

In the exemplary single traversing embodiment depicted in FIG. 2, the overall tape containment means 24 comprises three constituent containment means or sections 27, 28, and 29 for the three sections 20C, 20D, and 20E of the S-shaped path of the tape. Each of the containment means performs at least two functions. The illustrated lower horizontal containment means 27 comprises support means such as horizontal slots 31—31 (see FIGS. 24 and 25) formed in the drapery material or in tabs attached to the material for capturing and routing the lower horizontal tape section 20C through the drape generally in the direction of traverse. Typically, the slots can be spaced apart several inches, which is the maximum spacing between adjacent pleats. In capturing the tape 20, the containment means 27 also contains the tape. The contained tape maintains the drape or other cover 15 in the desired vertical plane, extending downward from the traverse track 21 and prevents distortion. That is, the tape performs the alignment function of the cord alignment system 6.

The exemplary containment means 28 depicted in FIG. 2 comprises a vertical, elongated hollow housing member or stiffener 32, FIG. 5 (also called an edge or end support member), preferably of lightweight material such as plastic, which is attached proximate the free (right) end of the cover material. The containment means 28 routes the vertical tape section 20D between the bends 46 and 47 which separate lower horizontal section 20C, vertical section 20D and upper horizontal section 20E, and contains the vertical section 20D of the tape. This containment means maintains the traversing (free) end of the cover material 15 in an accurate vertical orientation and cooperates with the containment means 27 to maintain the alignment of the cover material 15 within the desired plane extending vertically downward from the track 21.

Containment means 29 releasably contains the upper horizontal section 20E of the tape 20 along the traverse track 21. In a preferred embodiment, the upper horizontal containment means 29 comprises suitable means for providing a force of sufficient magnitude to normally hold the magnetic or magnetizable tape 20 (that is, a tape of material which is attracted to the magnetic containment strips) flat against the traverse track 21, but small enough that the tape is easily released. Preferably, this containment means is adhesive magnet tapes or adhesive magnet strips 33—33, FIG. 5, which are mounted along the bottom of the track 21 for magnetically holding the tape 20 adjacent the track, for releasing the tape when the window cover is traversed to the right, that is toward or into a closed condition, and for re-engaging the tape when the window cover is moved to the left, toward or into an open condition. The adhesive magnets 33—33 may be a commercially available type which are marketed for mounting on appliances such as refrigerators for displaying or attaching messages.

Referring further to FIG. 2, the longitudinally relatively rigid, transversely relatively flexible tape 20 and the containment means 24, especially the releasable containment means 29, permit easy bidirectional traverse and positive, accurate, "100% displacement" between the horizontal sections 20C and 20E of the tape. A length of the horizontal section 20C or 20E of the tape which is adjacent the bend 46 or 47 and is equal in length to the distance traveled by the traversing end of the window cover 15 is accurately and fully transferred from one horizontal section 20C or 20E to the other section 20E or 20C. Thus, as the window cover 15 is traversed to the right (or to the left) a given distance/dimension, the length of upper horizontal tape section 20E decreases (increases) and the length of the bottom horizontal section 20C increases (decreases), both by that dimension. This accurate and full transfer or displacement maintains the accurate vertical orientation of the tape 20D, and, thus, of the free end of the window cover material, maintains the bottom and side of the tape square, and precisely preserves the containment and alignment functions of the containment means 27.

In addition, unlike cord systems, which are able only to pull a window cover, because of its longitudinal rigidity, the contained tape 20 both pushes and pulls the window cover. The containment 24 means keeps the tape from "exploding" like a speedometer cable or a tape measure, that is, from displacing transversely, and enables the push and pull power. In combination, the tape and containment means provide light weight, simple, easy traversing construction without components such as the cord alignment system 6, FIG. 1, and the edge stabilizer system, FIG. 1 (the elongated horizontal platform 2 with spaced support points 7—7 captured by the traverse track 1 and the rigid, rigidly mounted elongated edge stabilizer member 3).

Preferably the tape 20 and the other tapes discussed here are magnetizable metal tapes and, in fact, steel tapes of the type used in retractable tape measures have been used. Other types of tape include but are not limited to plastic coated metal tapes and plastic tapes.

To date, and referring for example to FIGS. 5 and 7, I have used flat tapes 20 (tapes of straight or flat profile in the transverse plane perpendicular to the longitudinal direction, 1; see FIG. 5), as well as tapes 120 which are coved (of concave transverse profile; see FIG. 7). The coved tapes (also called cupped or concave tapes) are preferred in part because they bend more easily than flat tapes and with less resistance to movement around bends when the cove faces radially inward at the bend. Coved tapes also provide great push and pull energy. This effects both opening and closing the cover and facilitates positive full displacement of the tape and the associated cover and maintaining the desired vertical orientation at all times, including during traversal.

For example, I have used steel tapes 1/41" (inches) to 1" in width by 0.006" to 0.010" thick to support hollow pleat DUETTE window covers about 96" long by 120" wide (or greater).

b) Tape-Supported Hollow Pleat (DUETTE) System 118

FIGS. 3–8 depict various embodiments of a hollow pleat window cover system constructed in accordance with my invention. FIGS. 3 and 4 illustrate a dual traversing mounting arrangement 118 in which both ends of the prepleated hollow pleat drape 115 are free to traverse. Illustratively, the tape 20 is flat and the ends of the window cover are attached to housing or stiffening members 32. As shown in FIG. 4, in this embodiment, the tape containment means 24 comprises five sections 25–29. Containment means section 25 is the equivalent of previously discussed section 29. Both comprise the magnet strips 33—33 which are attached to the bottom side of the track 21 on opposite sides of the window cover 115. Containment means section 26 is the equivalent of section 28, and comprises the hollow housing members 32. Containment section 27 comprises horizontal slots 31—31 (FIG. 24) formed in the hollow pleat fabric, as described previously. The containment means 27 functions as described previously in cooperation with the left and right containment means 26 and 28 to provide full displacement between tape sections 20A and 20E, respectively, and the horizontal tape section 20C, when the left or right end of the window cover 115 is traversed.

As alluded to previously regarding the FIG. 2 embodiment, the metal tape push and pull and the full displacement keeps the window cover such as 15 and 115, 90° square when the cover is in repose (stationary), yet effects flexible support for the window cover such that the window cover can be displaced laterally and in and out of the vertical plane without damage.

FIG. 5 also depicts a standard trolley 22 of the type which may be used in the various embodiments of my invention. The trolley 22 comprises a roller carriage portion 36 which includes a pair of wheels spaced apart transversely across the width of the track 21, and a hanger 37 which extends vertically from the carriage 36 through the bottom slot 38 in the generally C-shaped track 21 cross-section, and attaches to a stabilizing strip 39 (not shown) mounted on the window cover material 118. Note, typically the trolley 22 need not be elongated, and need not comprise longitudinally spaced support points such as wheels.

FIGS. 5 and 6 also depict various details of the system 118 including immobilizing means 41 such as set screws which secure the opposite ends of the dual traversing tape to the bottom side of the traverse track 21. Strip magnets 33—33 are adhered to the bottom side of the traverse track 21 on opposite sides of the tape. A tape brake arrangement 42 comprises a magnetic or non-magnetic brake pad 43, the position and associated braking action of which is controlled by a thumb screw 44 extending through the sidewall of the housing 32.

As shown in FIG. 6, the end of the fabric 15 is attached by attachment means such as a snap-on to the housing 32. Also, the housing 32 conveniently has a rectangular bore 48 to accommodate the flat tape 20.

FIGS. 7 and 8 depict relevant details of a version of the hollow pleat system 118 which incorporates a curved or coved tape 120. As mentioned previously, the concave tape 120 is oriented with the cup facing radially inward at the bottom and top turns such as 46 and 47. To accomplish this, the tape is rotated or twisted 180° within the hollow member or stiffener 132 and that member preferably has an internal passageway or bore 148 of circular cross-section to permit the tape to continuously reorient without obstruction during traversing movement.

Figure 9:
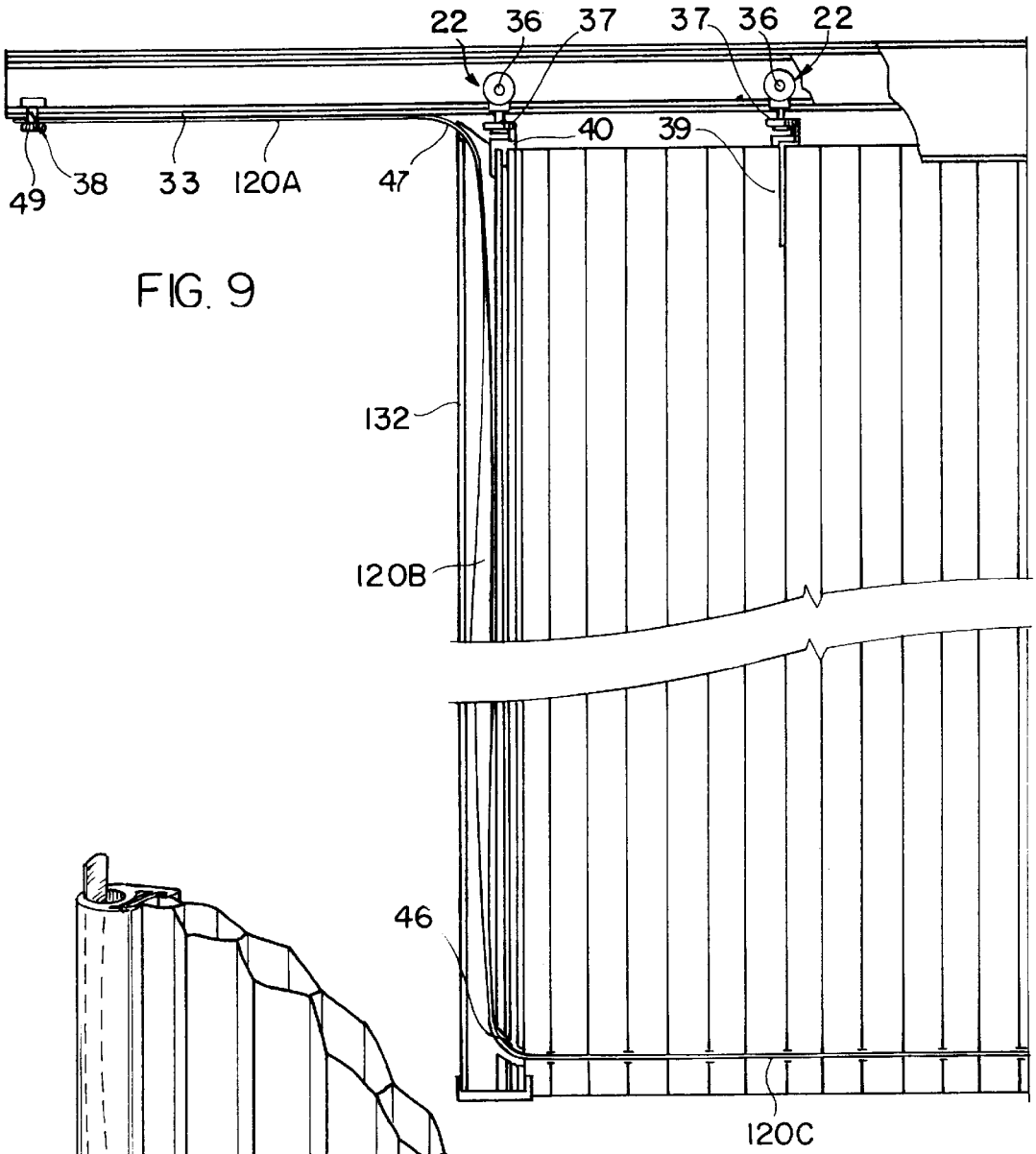

FIG. 9 illustrates additional details of the construction of the trolleys 22. The trolleys 22 which support the intermediate sections of the cover 15 are constructed as described previously. The end trolley 22 preferably includes or is mounted to a clip 40 which is mounted over the upper end of the housing sidewall. Please note, as illustrated in FIG. 9, end trolley 22 need only support the vertical edge housing member 32 or 132 for traversing along the traverse track 21. It is unnecessary for end trolley 22 to provide a stable horizontal platform or to rigidly orient a rigid edge stabilizer member to achieve the desired stable vertical orientation. As discussed above, the tape and the tape containment means perform these functions.

Figure 10:
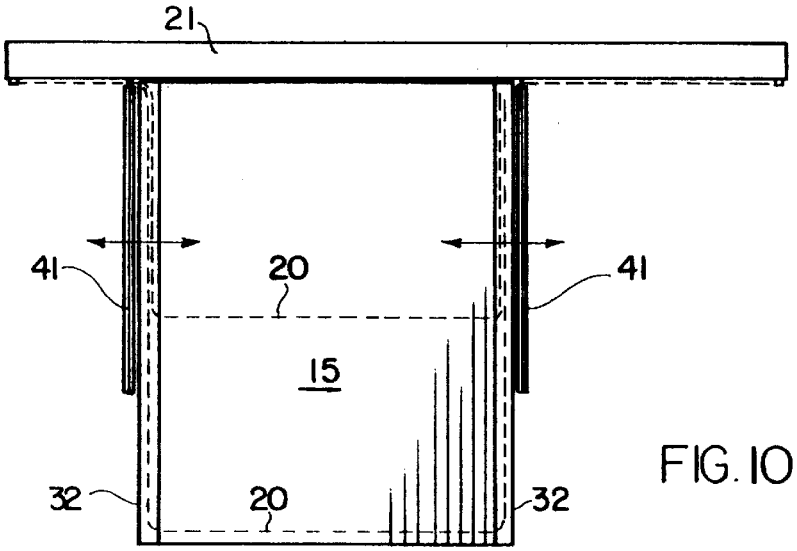
FIGS. 10, 11 and 12 are front elevation views showing additional features and other embodiments of the present invention.
Figure 11:
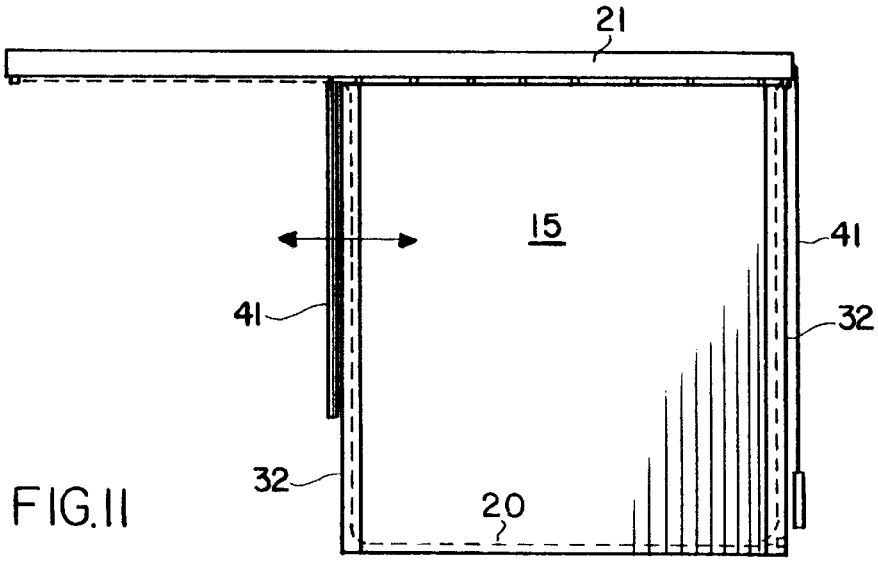
Figure 12:
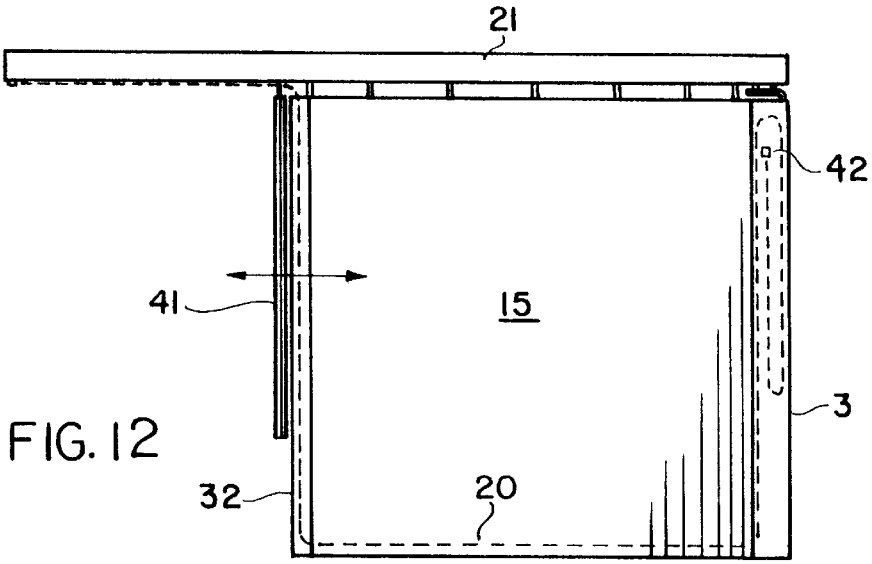

FIGS. 10, 11 and 12 disclose additional details and embodiments of the cover systems such as 18 and 118 and the systems described subsequently. Specifically, FIG. 10 depicts a dual traversing arrangement which uses separate top and bottom tapes 20 (or 120 or 220). Each tape comprises five sections 25–29. This two-tape system provides additional stabilization of the drape 15 intermediate the top and the stabilized bottom. Wands 41 are used for opening and closing the two free ends of the cover. The drape depicted in FIG. 11 is fixed at the right end and incorporates an S-tape, a three-section tape containment means, and a wand 41 for traversing the left end. Finally FIG. 12 depicts a dual traversing system comprising a single tape and a four-section tape containment means. The tape 20 (120) is coiled within the right side upright 3 of the type depicted in prior art FIG. 1 and is secured at its end within the upright, for example by a peg or screw 42. The tape coils and uncoils during traversal of the right upright 32 relative to the left upright 32, which is also free to traverse. Alternatively, of course, one of the uprights could be stationary.

Figure 23:
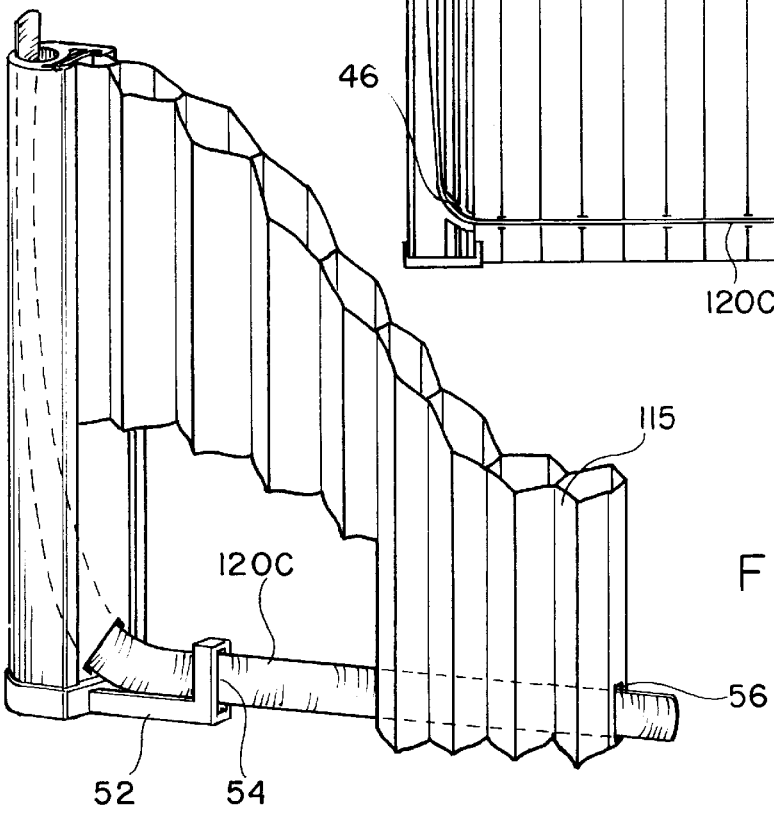
FIG. 23 depicts an embodiment in which the tape is oriented on edge (vertically) in the section routed through the drapery material.

FIG. 23 illustrates an alternative tape mounting arrangement in which the tape is held on edge, vertically, by the containment means 27, for example by a bracket or tape guide 52 mounted to the bottom of the housing 32 and having a vertical slot 54 therein, and by vertical slots 56—56 in the fabric. This embodiment is particularly useful for covers having relatively narrow pleats. Alternatively, in such situations I have used a relatively narrow, plural ply (plural layer) tape or a relatively thick narrow tape.

c) Sprocket-Controlled, Tape-Support Cover System 8

FIGS. 13 through 22 depict a dual traverse (both ends free to traverse) embodiment 8 of my tape-supported cover system which uses top and bottom tapes 220T and 220B and a pair of opposite end top sprockets 9—9 which ensure that both tapes are displaced in unison at the same velocity. This maintains the accurate vertical orientation of the bidirectionally traversing drape support uprights/housings/edge members/end members 32 and 132 and 232 and the cover drape 15 which is attached to the uprights.

Figure 14:
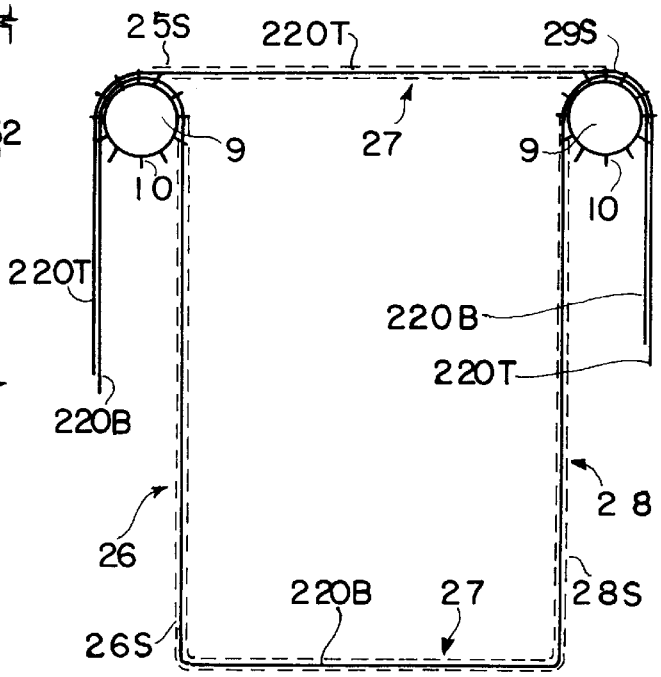
FIG. 14 is a simplified schematic depiction of the sprocket-timed dual tape support system used in the cover system of FIG. 13.

As shown in particular in FIG. 14, one sprocket 9 is mounted for rotation in the top interior of each housing 32. The bottom tape 220B forms a generally U-configuration which bends around the sprockets at each end, with an overhanging section at each end. This tape is contained by: left side vertical tape containment section 26 (channel 12 defined between the medial side wall of upright 32 and a spaced upright member 13); horizontal drape containment section 27 (drapery slots 31—31); and right side vertical tape containment section 28 (channel 12). The top tape 220T forms a generally inverted U-configuration which is supported at the bends of the U by the sprockets and is contained along the base by the horizontal drape-defined containment section 27 (drapery slots 31—31). Each sprocket 9 is mounted on a shaft or the like which allows free rotation of the socket.

Containment means 25S and 29S in the form of curved fenders or guides having an interior configuration which closely matches the external periphery of the sprockets, are mounted adjacent the sprockets, for retaining the tapes on the sprockets. The guides 25S and 29S may have grooves formed along their internal periphery which allow the sprocket teeth to rotate 10—10 therealong and thus permit a snug fit between the guides and the sprockets and the two tapes.

As indicated in particular in FIGS. 14 and 15, the top tape 220T overlies the bottom tape 220B. Slots 11—11 formed in each tape are of equal pitch/spacing and are engaged by teeth 10 of the sprockets 9—9 so that movement of either end vertical housing member 32 (typically manually controlled movement utilizing a wand, not shown, on the chain 12, FIG. 13, described below) in either the cover opening or closing direction causes the tapes 220T and 220B to wind and unwind in unison at equal velocity over the associated sprocket 9. As the result of this equal velocity movement, the tapes are maintained taut along the sections of the containment means. The push and pull force exerted by the tapes maintains the desired vertical orientation of the upright 32 and the attached drape 15 during movement. That is, the top and bottom tapes 220T and 220B displace equally, and there is no movement of the top of the upright 32 and attached drape 15 relative to the bottom thereof, or vice versa. That is, square orientation is maintained without the releasable magnetic containment means and without tying the tape ends together or to a fixture.

FIG. 13 also depicts an optional, preferred drive arrangement comprising a second sprocket mounted to the sprocket 9 on the rotational axis 14 of the latter sprocket and having a drive chain 12 mounted thereon. Pulling in opposite directions (on opposite sides) of the chain 12 drives the sprocket 9 and the tapes together, in opposite directions, to open and close the cover. A low ratio gear arrangement provides very easy, smooth opening and closing movement. Alternatively, a motor drive can be used and a remote controlled, time controlled, etc. drive can be used.

Figure 17:
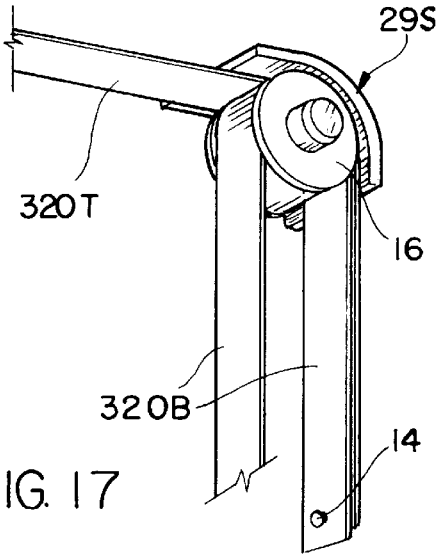
FIG. 17 is partial, perspective view of an alternative, wheel or pulley control arrangement.
Figure 16:
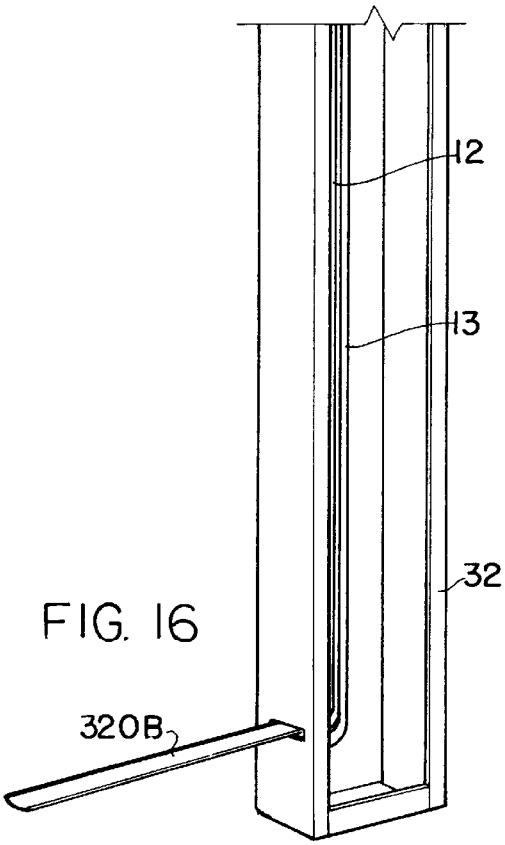
FIG. 16 is a partial perspective view of one of the vertical upright edge support members or housings of FIG. 13.

FIG. 17 depicts an alternative sprocket arrangement in which the toothed sprocket 9 is replaced by a non-toothed idler pulley 16. The controlled, equal velocity displacement of the top and bottom tapes 220T and 220B is maintained by fastening the tapes together at each end, for example, by means 14 such as a rivet or a screw.

Figure 18:
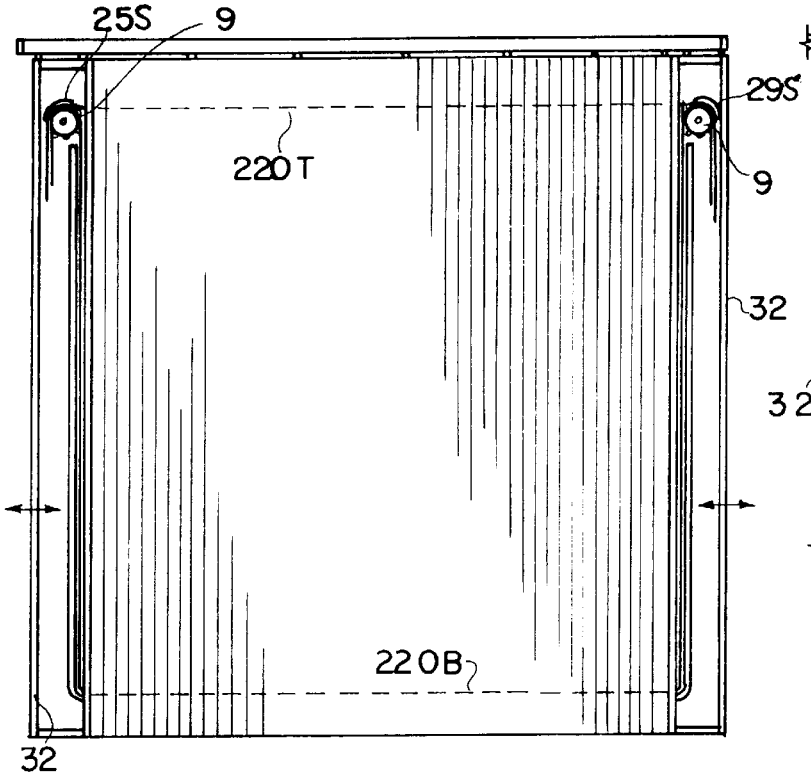
FIGS. 18 and 19 are respectively a front elevation view of the system of FIG. 13 showing the sprocket-controlled cover in the closed (drapery expanded) condition and a partial, front elevation view showing the sprocket-controlled cover in the open (drapery bunched) condition.
Figure 19:
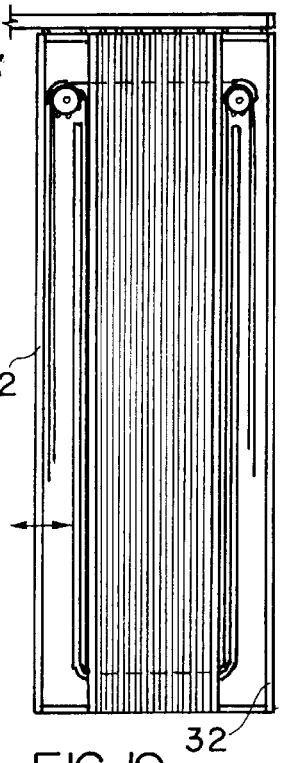

FIG. 18 depicts the cover 15 closed condition (drapery material open) while FIG. 19 depicts the cover open condition (drapery material closed or bunched) of the dual traversing system 8 depicted in FIGS. 13 through 17.

Figure 20:
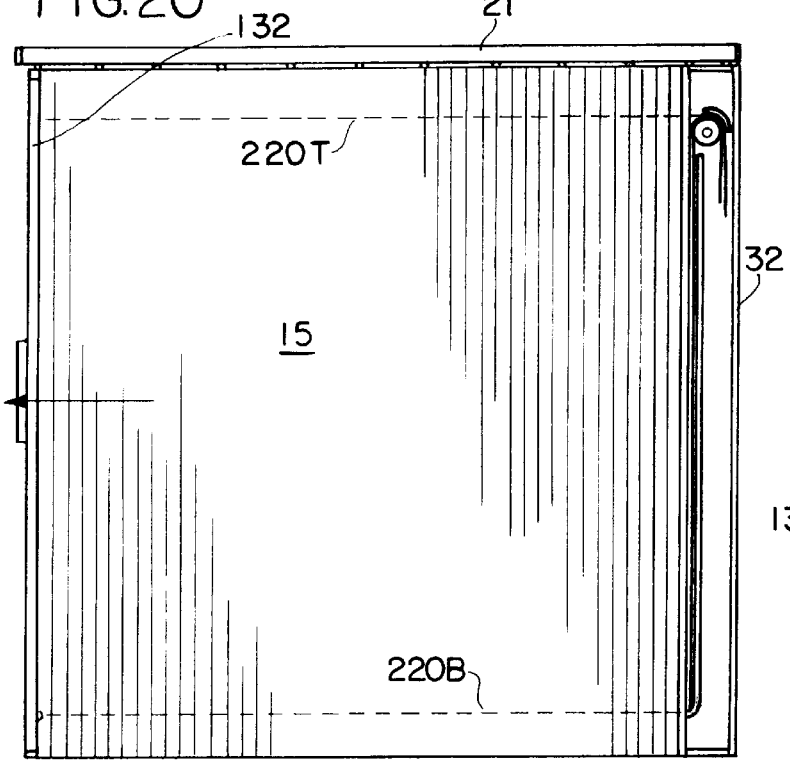
FIG. 20 is a front elevation view depicting the cover open condition of a single edge support member alternative to the arrangement of FIG. 13.
Figure 21:
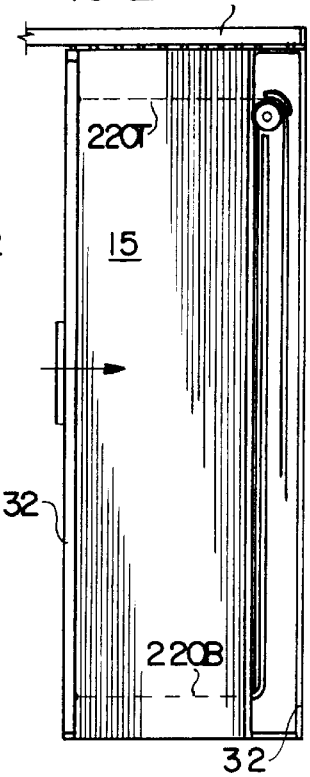
FIG. 21 is a partial front elevation view depicting the drapery closed condition of the system of FIG. 20.
Figure 22:
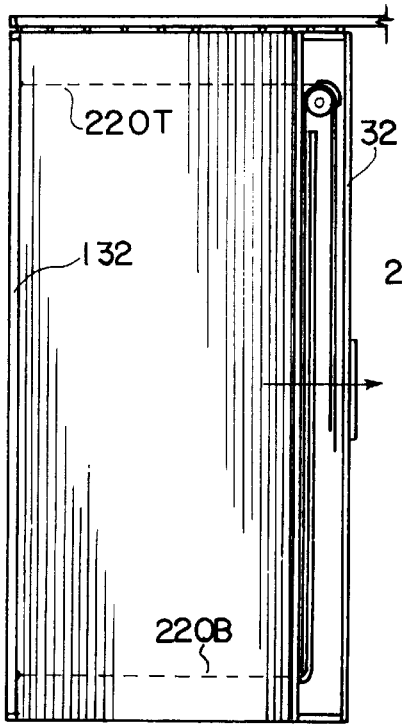
FIG. 22 is a partial front elevation view depicting the converse of the FIG. 20 arrangement, that is, a system in which the master or sprocket-containing upright is movable and the non-sprocket-containing upright is stationary.

FIGS. 20 through 22 depict various alternative embodiments of the sprocket-timed cover system 8. The toothed sprocket 9 is depicted in each of these alternatives. However, those of usual skill in the art will understand that the FIG. 17 pulley arrangement can be used as well, preferably with tied ends.

FIG. 20 depicts the cover closed condition (drapery material open) of a system comprising a fixed master end housing or upright 32 containing the idler sprocket arrangement and a bi-directionally traversing opposite end comprising, for example, a simple trolley 22-mounted upright member 132, such as a slat, to which the movable drapery end is attached.

FIG. 21 depicts the cover open condition (drapery material closed or bunched) of the cover arrangement of FIG. 20.

Finally, FIG. 22 depicts the converse of the arrangement of FIGS. 20 and 21. That is, the non-sprocket upright 132 is immobile and the master, sprocket-containing traversing upright 32 is supported on the traverse track by a pulley 22 or using the elongated, rigid platform system of FIG. 1. Various other alternatives will readily occur to those of usual skill in the art, including dual traversing systems which use an upright 32 to support one end of the cover material and upright 132 to support the opposite end.

d) Tape-Supported Pleated Covers in General

FIGS. 24 through 27 illustrate the use of my tape support depicted in FIGS. 2–12 in combination with various pleated covers. FIG. 24 depicts the use of a horizontal tape to support a hollow pleated fabric cover 115 such as the DUETTE cover. FIG. 25 depicts a horizontal tape and a dual hollow pleated cover 215 such as that available from Graber, Inc. under the tradename CRYSTAL PLEAT. FIG. 26 illustrates a vertical tape and a seamed pleated cover 315 such as the FINALE cover available from Verosol, USA, Inc. FIG. 27 depicts a vertical tape and a cover 415 comprising a back to back, semi-hollow arrangement of FINALE covers. As alluded to above, a horizontal tape can be substituted for vertical tape in most relatively narrow pleat covers (such as those shown in FIGS. 16 and 27) by using a correspondingly relatively narrow, relatively thick or plural ply tape.

e) Tape-Supported Vertical Pleated Fabric & Blind System 218

FIGS. 28 through 30 are, respectively, a front elevation view, a rear elevation view, and a partial rear elevation view, partially cut away, illustrating a tape-supported vertical pleat SILHOUETTE blind window cover system 218. This system combines a tape support system 20 with a vertical single pleated drape 15 and a vertical venetian blind assembly 50. The system is adapted so that movement of the drapery during pivotal opening and closing movement of the associated blind slats is accommodated without interfering with the opening and closing movement. The conventional blind assembly 50 comprises vertical slats 52 suspended by rotatable hangers 54 from a drive means 57 mounted within the traverse track 21. Conventionally, a gear wheel 56 is mounted at the upper end of the hangers 54 and engages drive means 57 so that the gears and blinds are reversibly rotated open and closed by pulling on the opposite sides of the chain pull 58. Traverse cord assembly 60 is mounted at the traversing free end of the blind and is used to pull the blind and attached drape open and closed.

The system 218 is a single traverse system in which the left drapery end (FIG. 28) is free to traverse. The system incorporates a three section tape 20 (or 120), and tape containment means 24 comprising three corresponding containment means 25, 26 and 27. Alternatively, the system can be arranged to move at the right end, at either end, and/or at the middle.

In the illustrated system 218, the blinds at the ends are replaced by generally elliptical, double convex vertical edge support members 62. The curvature of the edge support members approximates that of the slats 52, thereby providing a pleasing uniform appearance. In the illustrated single traverse system, the left end member 62 serves as the containment means 26 for the free left end of the drapery 15. Also, both ends of the drapery are wrapped around the associated members 62 and 62 to provide an enclosed, pleasing appearance.

As shown in FIG. 37, the slats 52 are pivotally suspended and supported by off-center supports such as the aforementioned trolleys. Hinges 64 are attached to the slats 52 for supporting the drapery 15. The hinges 64 comprise a snap-on slotted member 66 having a tab 67 therein which mates with a vertical slot 68 or a hole 70 in the slat. A fabric hinge 69 is adhered to the member 66 on the end opposite the slot 68 for attachment by means such as adhesive to the pleated fabric 15. Illustratively, three snap-on hinges 64 are mounted at spaced positions along the slat and the associated drape. The two bottom hinges attach to a slot 68 thereby permitting vertical self-adjustment between the slat and drapery.

Referring primarily to FIGS. 30 and 36, the containment means 27 comprises snap-on sleeve members 72 mounted on the bottom edge of the slats 52. The tape 20 is supported and routed through the sleeves 72 similar to the manner in which the fabric slots 31 depicted in FIGS. 3 and 14 support the tape.

Referring further to FIG. 30, the containment means 26 comprises the left end housing 62 which has a tube 75 mounted therein having slits 73 and 74 formed in the opposite sides at its bottom and top for routing the tape 20. Containment means 25 comprises magnet strips 33 attached to the bottom of the traverse track 21. The end 76 of the tape 20 extends through a slit 77 formed in the end panel of the traverse track 21 and is secured in slidable fashion by a finger guide 78 to the slot. When the drape 15 is closed (free end at the far left in FIGS. 30 and 37) and the blinds are being rotated open or closed, slits 73 and 77 allow rotational movement of the tape end 76 about the pivot axis 79 of the end stabilizer housing 62 and thus allows opening and closing movement of the blind.

FIGS. 31–34 illustrate various positions of the system 218. Specifically, FIG. 21 illustrates the drape in the closed position with the slats 52 open. FIG. 32 illustrates the blind open condition with the slats 52 pivoted closed. FIG. 33 illustrates the blind open condition with the slats pivoted partially closed. Finally, FIG. 34 illustrates the blinds open with the slats 54 open to permit close packing.

As shown for example in FIG. 31 and 37, preferably the tape 20 is routed along the slats' pivot axis 79 defined by the gear drive and pivoting hangers. Preferably this pivot axis is positioned off-center along the transverse width of the slat, toward the front or drapery 15 side thereof, concentrating the weight of the slats on the side of the pivot axis opposite the drape. The greater weight of the blind on the free end offsets the weight of the fabric and facilitates smooth pivotal movement of the blind assembly. Also, the relatively short pivot radius on the blind side decreases the transverse displacement of the drapery between the open and closed positions of the blind. compare, for example, the blind position in FIG.s 21 and 22. The counterbalancing and short pivot radius allow pivotal closing and opening of the slants without interference by the attached drapery. The end slats 54E are relatively short to facilitate closing without interference from housing 62. See FIG. 32.

f) Tape-Supported Vertical Pleated Fabric & Blind System 318

FIGS. 38 through 45 depict a tape-supported drapery/blind system 318 in which pivotal movement of the blind does not move the vertical edge support member. Preferably, the axially off-center slat mounting arrangement discussed above is used, that is, the slats are suspended from the traverse track by hangers or trolleys such as those shown at 54, FIG. 3. The primary difference between the above system 218 and the system 318 is the use of pivoting tape containment housings 82. Referring primarily to FIGS. 41 through 44, the pivotal frame housing 82 comprises a generally C-shaped frame 83 having grooves 84—84 in the top edge for mounting in a slot 85 formed in the front/drapery side of the slat 54. The pivot housing 82 is substituted for the bottom hinge 64, FIG. 37. A slotted pivot arm 87 is mounted for rotation about a pivot pin 88, preferably about a pivot axis which coincides with the slat pivot axis 79. The tape, illustratively a concave tape 120 (a flat tape can be used), is routed through the containment slot 86 in each pivot arm. A fabric or plastic hinge 89 pivot arm is mounted to, adhered to, or formed integrally with the pivot arm 87 at the front/drapery end of the frame for attachment to the drape, using adhesive or other suitable attachment means. Unlike the FIG. 37 arrangement, here the fabric drapery is attached to the slat only by the hinges 89. The top of the drapery is also supported by hinges 89.

Referring to FIGS. 45 and 46, the C-shaped frames 83 are mounted to the individual slats 52 of the blind system, such that the pivot arm axes coincide with the pivot axes 79 of the slats (hangers 54) and so that the pivot arms form the containment means 27. The hinges 89 are attached to and are spaced at the top of the drapery along with others if needed. With this independent mounting arrangement of the slats and the drapery, pivotal opening and closing of the slats does not move the drapery transversely (compare FIGS. 31 and 32 with FIG. 45) or pivot the vertical edge stabilizer/containment means 62. Please note, similar to the embodiment 218, the end slats 52E are shorter than the intermediate slats 52 to facilitate closing the off-center mounted slats used in this counter-balanced arrangement.

Although the various vertical edge support members can be used in the arrangement 318, the lack of pivotal movement permits very simple and thus light weight units which need not supply significant support and need only be of sufficient rigidity to contain the tape. As shown in FIGS. 39 and 40, one suitable vertical edge stiffener 92 comprises a pair of elongated mating panels 93—93 of flexible material such as plastic which are of elongated C-shaped horizontal cross-section. The ends of the panels snap together to from the vertical edge stiffener 92.

g) Tape-Supported Vertical Blind System 418

FIGS. 47 through 54 depict a tape-supported vertical blind system 418 in which pivotal movement of the slats is independent of, that is does not move, the vertical edge support or stiffener member. Preferably, the above-discussed axially off-center slat mounting arrangement of 318 is incorporated. The primary difference between the above system 318 and the present system 418 is the absence in the present system of a drape such as 15 and the use of a link system 95 to control the slat-to-slat spacing. Referring primarily to FIGS. 37 through 39, the pivotal frame housing comprises a generally C-shaped frame 83 having grooves 84—84 in the top and bottom edges for mounting onto a slot 85, FIG. 49, which is formed in the front side of the slat 52. See also FIG. 51. A double slotted, T-shaped pivot arm 97 is mounted for rotation about a pivot pin 88, preferably about a pivot axis which coincides with the slat pivot axis 79. Referring to FIG. 49, the C-shaped frames 83 are mounted to the individual slats 52 of the blind system, such that the pivot axes of the pivot arm coincide with the pivot axes 79 of the slats and the pivot arms 97 form the containment means 27. The tape, illustratively a flat tape 20 (a curved tape 120 can be used), is routed through the horizontal containment slot 96 in each pivot arm 97. The second, vertical slot 98 supports one of a group of co-operating links 99—99. Each link 99 is an elongated S of length which spans two adjacent pivot arms and establishes the maximum desired spacing between the slats 54—54, as shown in FIGS. 52 and 53.

Referring to FIGS. 47 and 48, the links 95—95 hide the tape. Referring also to FIG. 52, as the blind array is translated closed (slats 52 at maximum spacing, permitting pivotal closing or opening of the slats) the ends of each link 99 engage the adjacent two frame arms 83—83, thereby establishing a uniform between-slat spacing and a pleasing appearance.

As shown in FIG. 53, pivotal opening and closing of the slats does not move the vertical edge stabilizer 92 or the containment means 26/28. Please note, similar to the embodiment 218 and 318, the end slats 52E are shorter than the intermediate slats 52 to facilitate closing the off-center mounted slats used in the counter-balanced arrangement. As shown in FIG. 54, when the blind is open (slats in the closed condition), the telescoping links 99—99 slide over one another to permit close packing.

Although the various vertical edge stabilizers can be used in the arrangement 418, the lack of pivotal movement permits very simple and thus light weight units which need be only of sufficient rigidity to contain the tape. As shown in FIG. 52 through 54 the vertical edge stiffener 92 described in FIGS. 29 and 29A can be used.

FIGS. 47 and 48 depict a two tape system (one tape at the bottom and one at the top of the blind) and two associated link systems 95. However, a single tape/single link system can be used, preferably with the tape and link system routed along the bottom of the slats to maximize the ability to control the tendency of the blind to bunch at the bottom.

h) Vertical Shufter Drapes In General (Vertical Shutter Hinge Drape and Vertical Shutter Pleatuoette Drape)

Turning now to the drawings, wherein like components are designated by like reference numerals, FIGS. 56–70 illustrate embodiment(s) 121 of vertical shutter drape cover systems in accordance with the present invention, for cover an opening such as a window, doorway or other passageway, or simply for cover or decorating a space, for example, along a wall. The systems include an array of (1) slats 160 and (2) front edge strips or edge members 122 which are pivotally attached along one edge to the slats, along with (3) automatically adjusting spacer means or hinges 130 attached between adjacent edge members for aligning and spacing the slats, and/or (4) a pleated blind attached to the edge of the front edge strips opposite the one edge and/or (5) one or more vertically spaced tapes as described in my co-pending patent application which support the shutter drape. In general, for convenient reference, in this section "vertical shutter drape" includes "vertical shutter hinge drapes" and "vertical shutter Pleatuoette drapes". "Vertical shutter drape" system refers to a system comprising slats, edge members, and spacing control means in the form of hinges. "Vertical shutter pleatuoette drape" system refers to a system comprising slats, edge members and vertically pleated or folding covers, typically vertically pleated fabric drape which also are spacing control means.

Preferred embodiments of the vertical shutter drape, discussed more fully below, include an arrangement (FIG. 58) in which spacer hinges are mounted between edge strips or members supported by slats that are suspended from a traverse track, for example hanger means 28, 29 shown in FIG. 57. The hanger means attach to the slats at off-center locations (off-center along the horizontal width of the slats) for the purposes of (1) counterbalancing the weight of the front edge strip member (and the fabric drape where used) and (2) allowing the slats to pivot without moving the front edge strip (hinge-to-edge strip function).

The preferred push-pull tape is the type described above, one which is longitudinally rigid, transversely rigid along an axis orthogonal to the longitudinal axis and the plane of the drape, and transversely flexible along an axis in the plane of the drape orthogonal to the other axes. The tape is routed through or along the drape, preferably through slots in the front edge strips, for the purposes of (1) overcoming the resistance of the hinge means and/or the pleated fabric (depending upon whether one or both are used) and pushing and pulling the blind and cover open and closed, and (2) maintaining the alignment of the blind ends parallel and keeping the ends square. The tape also maintains the alignment sufficient to allow the exterior use of the system.

The front edge strips function as extensions of the slats which counterbalance the slats. Also, the front edge strips provide access and support for the tape(s) 180, 182. In combination with the front edge strips, the hinge members can be used without the fabric cover. Here the hinge members substitute for the pleated fabric cover in maintaining the spacing of the system. Also, this off center slat/hinge member/front edge strip system may be used without a tape—the weight of the slats and front edge strip keeps the slats aligned and the push and pull power of the tape may not be needed. Preferably, in systems which are mounted outside a building or are otherwise subject to wind or other strong air currents, a support tape 180, 182 is used. The combined off center slat/hinge member/front edge strip/tape cover system is particularly useful in maintaining position and alignment in windy conditions and, like the non-tape hinge system, is very sturdy.

The system 120 includes a plurality of front edge-members or edge strips 122. Edge-members 122 are preferably designed to be light yet rigid, and include means for attaching a window cover material thereto. Exemplary window cover attachments are discussed in further detail below.

The illustrated edge members are elongated rectangular cross-section members or plastic or lightweight metal such as aluminum. The combined slat and drape array may be suspended vertically, and conventionally, via either the slats or the edge members from a traverse track (not visible in FIG. 56). As discussed above, the traverse track may be any well-known type of traverse track, one preferred example of which is illustrated in FIG. 57, wherein traverse track 124 has a box shaped cross-section and includes a slot 125 in lower portion1 26 thereof. Illustratively, hanger means in the form of hooks or slide-members 128 extend downward through the slot from dollies 129 which ride along the track;

illustratively, the hooks 128 engage holes 127 near the upper edges of the edge members (or the slats). As shown in FIGS. 63 and 66, typically the holes 127 are off-center along the horizontal or transverse width of the slats, that is, are located relatively closer to the associated edge member rather than at the center of the slat, for effecting the above-described weight counter-balancing and the hinge means-to-edge strip function. The shutter drape may incorporate and be opened and closed by conventional gear and chain drive hardware for slat assemblies which traverse and pivot the dollies 129 and hangers 128 and slats 160 open and closed. As applied to my shutter drape system, the traversing and pivoting hardware means (1) traverses the slats and the associated edge members and drapery along the associated window or other covered area between a shutter drape system open condition (shutter drape compacted together, exposing all or part of the associated area) and a closed condition (shutter drape extended, cover the associated area) and (2) with the shutter drape in the closed condition, pivots the slats open or closed. Thus, using conventional mounting and traversing hardware, my system and its dual opening and closing action uniquely provide selection of (1) complete privacy and blockage of light (system and slats closed), (2) privacy with light penetration (system closed with slats open (at approximately a 90 degree angle to the plane of the system, permitting light penetration through the translucent drapery, with privacy, or selectively angled off-normal between 0 degrees and 90 degrees to control light direction) and (3) maximum light penetration (system open).

Figure 1:
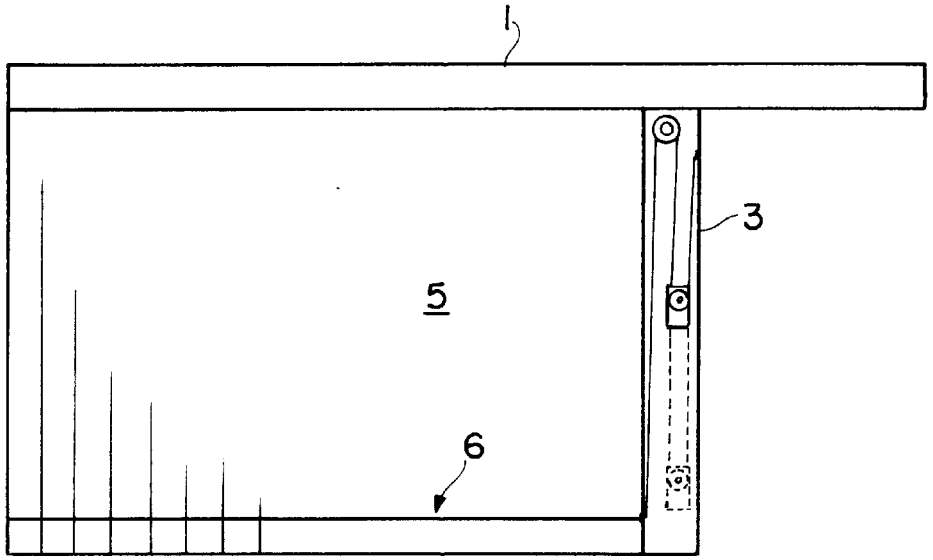
FIG. 1 PRIOR ART
Figure 55:
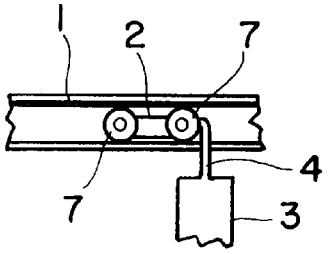
FIG. 55 PRIOR ART

A particularly important aspect of this embodiment of the present invention is the provision of automatically adjusting spacer means, preferably foldable or hinged spacer members 130, FIG. 1. The spacer hinges effect equal spacing between the drapery folds or pleats and between the slats, and promote a uniform appearance. Preferably, at least two spacer hinges 130 are provided between adjacent ones of the plurality of edge members 122. A first of the spacer hinge pairs is preferably attached to an upper portion 122A of the associated spacer members and the second spacer hinge is attached to a lower portion 122B of the edge-members.

FIGS. 58 and 59 illustrate a preferred arrangement for a spacer-member 130. Here, spacer-member 130 comprises two plate-members 132A and 132B. The plate-members 132A and 132B are attached together, at respectively first edges 134A and 134B thereof, by a hinge 135. The hinge 135 is arranged such that the plate-members may be folded together in a generally face-to-face relationship for opening the window cover system, and opened to a predetermined maximum angle theta to each other for closing the window cover system.

In a preferred hinge arrangement for hinge spacer member 130, a hook-shaped slot 136 is formed on edge 134A of plate-member 132A and a bead 138 is formed on edge 134B of plate-member 132B. The plate-members are attached together simply by pressing bead 138 into hook-shaped slot 136. Slot 136 effectively provides a stop which limits angle theta to which the hinge member 130 may be opened, but may be arranged such that plate-members 132A and 132B may be closed together in a face to face relationship for opening the window cover system.

Preferably, means are provided for preventing vertical movement of bead 38 in hook-shaped slot 138, i.e., for retaining bead 38 in slot 36. This may effected conveniently by making plate 32B slightly shorter than plate 32A and crimping the top and bottom of ends 36A and 36B of slot 36 as illustrated in FIG. 2C.

Each hinge member 30 is attached to a pair of edge members 122 by another hinge arrangement 142, see, for example, FIGS. 58–60. In one aspect of the present invention edge-members 122 are preferably hollow or flat (FIG. 68) and formed from a light but rigid material such as aluminum or vinyl which is easily worked into extrusions. Referring now in particular to FIG. 60, in a preferred method, hinge 142 is provided by forming one or more longitudinal spaced slots 144 along opposite sides 122A, 122B of adjacent ends of each edge-member 122. One or more tabs 146 corresponding to slots 144 are provided on edges 140A and 140B of the hinged hinge member and, preferably, as shown, snap into the slots 144 and are retained by a friction fit. Tabs 146 are inserted into slots 144 to form hinge 142. Please note, for economy of drawing space, FIG. 60 illustrates hinges 146, 146A, and 146B, although obviously hinges 146, 146A, 146B can be used alone as well as in combination. Preferably, for economy of manufacture, one or the other will be used in a given window cover assembly.

In a preferred arrangement tabs for insertion into slots 144 are provided with means to retain the tabs in the slots after they are inserted therein, while still allowing freedom of movement of the tabs in the slots to form a hinge.

Continuing with reference to FIG. 60, a tab 46A, here shown on edge 40B of plate-member 132B, is provided with a tooth-member. This may be effected by forming the hinge with a tooth member 148 or by making two incisions 150 and one incision 152 in tab 146 and pressing the portion of tab surrounded by the incisions inward to form tooth-member 148. When tab 146A is pressed into a slot 144 the slot and the outward extending tooth member will yield to allow passage of tab 146B. However, once inserted, tooth-member 148 will retain tab 146A in the slot.

Another method of forming a tooth-member on a tab is illustrated in FIG. 60, with reference to tab 146B. Here, a tooth-member is formed by forming a slot 154 in the tab to isolate a narrow portion 156 thereof. Portion 156 is provided with a rolled edge 158 which forms the tooth member. Edge/tooth 158 may be compressed during and to permit insertion into slot 144, then expands to prevent (accidental) removal.

As shown in FIG. 68, flat (non-boxlike) front edge strips 222 can be used. FIG. 69 depicts a hinge spacer member 230 suitable for a non-boxlike flat front edge member 222. The hinge is constructed generally the same as the version depicted in FIG. 60, except that hinges 246C and 246D in 232A and 232B are offset vertically to preclude interference along the narrow mounting end of the receiving front edge strip.

Referring again to FIG. 1 and FIG. 58, in one aspect of the present invention, window system 20 may take the form of a vertically oriented slatted vertical blind. Slats 160 of a suitable material such as vinyl or aluminum are attached to one edge of each of edge-members 122 by a hinge 162 (see FIG. 58) and may be varied in inclination, with respect to the edge-members, for controlling light admitted or excluded by the blind.

A preferred method of attaching a slat 160 to an edge member 122 is illustrated in FIGS. 61, 62, and 63. Here, hinge 62 (see FIG. 61) is formed from a flexible hinge-strip 64 (see FIG. 62) having a generally dumbbell-shaped cross-section. The hinge-strip 164 may be conveniently formed by two generally parallel beaded portions 168, preferably of a moldable resilient material such as a plastic or a rubber. The beaded portions 168 are molded onto and separated by a flat portion 170, which is preferably formed from strip of a fabric, preferably a durable synthetic fabric such as nylon.

The hinge 164 includes a generally cylindrical member 172 extending along an edge 122C (see FIG. 63) of edge-member 122, and another generally cylindrical member 174 extending along one edge 160A of slat 160 (see FIG. 63). Cylindrical members 172 and 174 have a slots 172A and 174A respectively extending completely (see FIG. 60) therealong. Edge-member 122, slat 160, and cylindrical members 172 and 174 are arranged such that slots 172 and 174 are generally aligned with each other. One beaded portion 168 of hinge-strip 164 is inserted in cylindrical member 172, and the other beaded portion 168 of the hinge-strip is inserted in cylindrical member 174, with flat portion 170 of the hinge strip inserted in slots 172A and 174A (see FIG. 61).

The above-described method of constructing hinge 162 allows for rapid and convenient assembly of slat 160 on edge member 122, and also provides a hinge sufficiently free to permit adjustment of the inclination of slats 160 by any of the well-known methods, for example cord-operated methods, of adjusting window blind slats.

Please note, FIG. 63 depicts holes/slits 127 adjacent the upper edges of the slats by which the combined blind and slat system is traversingly mounted to the traverse track. Specifically, rollers or gliders are attached at their bottom end to the slats and at the top are mounted to or captured by the traverse track for sliding, rolling, etc. movement along the track. The holes are located off-center along the horizontal width of the slat for the purpose of providing counterbalancing in which the weight of the slat 160 balances the weight of the edge strip.

It has been determined that provision of hinge members 132, because of the elongated edges 140A and 140B thereof attached to edge-members 122, is very effective in maintaining precise spacing and parallelism of the edge members and fabric attached thereto. This parallelism and spacing may be maintained, even if the system is exposed in an open window in breezy conditions.

Additional spacing and parallelism maintenance can be provided by traverse tapes, which also provide resistance to in-and-out motion (toward or away from a window), to fluttering and swaying of the cover system, and to the resistance of pleated fabric drapery when such is included in the cover system 121. This enhances stability and appearance, even in the event the cover system is exposed in an open window or mounted exteriorly, for example, on exterior walls. A preferred method of incorporating the traverse tapes is set forth below with reference to FIGS. 1 and FIGS. 64 and 65.

Referring now to FIG. 56, window cover system 121 can be provided with at least one traverse tape 180 extending along a lower portion of window cover system 121 and preferably with a second traverse tape 182 extending along an upper portion of window cover system 121. Traverse tapes 180 and 182 are preferably metal or plastic tapes which are rigid in longitudinal and lateral directions in the plane of the tape, and flexible in a direction perpendicular to the plane of the tape. Maximum rigidity for the tapes in the lateral and longitudinal planar directions is achieved when the tapes are constrained as much as possible against perpendicular flexure in regions where perpendicular flexure is not desirable. Thus, in a preferred U configuration, the tape(s) are routed through the blind or drape, then vertically upward through both opposite edge support mambers, then to and along the traverse track. Preferably the tapes are magnetic (attached to magnets), to keep them together over common runs along the end member(s) and along the track. Preferably, the track has magnet means, illustratively magnet strips mounted on the bottom of the track, for normally holding the tape(s) against the track, yet permitting ease of "peeling" away action and recovery of the tape(s) during traversal of the blind. The action of the tape and magnet support, along with various alternative configurations (for example, L-configurations attached to one end member and routed through the blind or drape, up the opposite end member and along the track) apply here.

One preferred method of providing effective constraint of traverse tapes 180 and 182 is to pass the tapes through slots, not only in edge-members 122, but also in plate members 132A and 132B of spacer-members 132. Accordingly, the preferred arrangement for tapes is that traverse tape 182 extends horizontally through edge-members 122 and hinge members 132 via horizontal slots 184 therein, at the upper portion 122A of edge-members 122, (see FIGS. 64 and 65), and tape 180 extends horizontally through edge-members 122 and spacer-members 132 via horizontal slots 184 therein, at the lower portion 122B of edge-members 122.

Turning now to FIG. 70, yet another embodiment of the of the present invention is illustrated. Here, a window cover system 221 includes edge members 122, slats 160, and traverse tapes 180 and 182 (as described above for window system 121), but does not include hinge members disposed between the edge-members. Window cover system 221 includes a panel 190 of a flexible window cover material arranged in the form of a series of accordion-like vertical pleats 192.

It is preferable, although not necessary, that panel 190 be attached in removable fashion to window cover system 221. This provides that the window cover system may be more easily transported to a desired installation location, and also provides that the panel may be easily removed and reinstalled as may be required, for example, for cleaning and maintenance of the panel. A slat 160 is preferably attached to one edge of edge-member 122 by cylindrical members 172 and 174 and hinge strip 64 as described above for window cover system 120.

Referring now to FIGS. 66 and 67, a preferred method of removable attachment of the drapery panel 190 is to fabricate the panel such that each of pleats 192 is formed such that a lip-portion 194, formed from a single or double thickness of the fabric of panel 190, extends from the pleat. The lip-portion 194 is then conveniently attached on edge-member 122, proximate the edge of the edge-member opposite slat 160, by a plurality of snap fasteners 196, which are disposed at intervals along edge-member 122. Alternatively, the drape can be formed and attached without lips. Preferably snap fasteners are disposed top, bottom and center. As mentioned above, the individual slats have preferably off-center holes or slots 193 for traversing attachment by hanging means such as rollers or gliders to the traverse track. Lip-portions 94 of pleats 192 are provided with open ended slots 198 through which tape 182 (and correspondingly tape 180) may pass. The width of lip-portion 194 of a pleat 192 is preferably selected such that tapes 180 and 182 are constrained against vertical motion by the slot in the lip-portion, even when window cover system 221 is fully closed, i.e., when edge members 122 have a maximum spacing therebetween. Clearly, the width of lip portion 94 should be wide enough such that slot 198 may be sufficiently deep to accommodate tape 182 when window cover system 221 is fully open, without undue, if any, distortion of panel 190. An arrangement in which an edge-member 122 is attached to every third pleat in panel 190 has been found to provide an aesthetically pleasing cover system.

When the vertical pleated drape is included, as per FIGS. 66 and 67, preferably the tape is included to overcome the resistance of the fabric drape and to open the pleats (close the drape) and hold the pleated fabric in the opened position.

It has been found that, even without hinge members between edge-members 122, window cover system 221 is constrained effectively against side-to-side motion, albeit perhaps not as effectively as if hinge members were present. The absence of spacer-members, however, may provide a more pleasing appearance for the window cover system which may be preferable for more formal applications.

To reiterate and expand upon the above-described combinations, such combinations include (1) an off center slat/hinge spacer member/counterbalanced front edge strip cover system (flat or hollow front edge strips can be used); (2) off center slat/hinge spacer member/front edge strip/tape system; (3) off center slat/hinge spacer member/front edge strip/tape/front cover; (4) off center slat/front edge strip/front cover of pleated material. As suggested by examples (3) and (4), typically the pleated material substitutes for the spacing function of the hinge member and vice versa.

i) Vertical Box Blind

Referring now to FIGS. 71–74, still another embodiment 223 of the present invention is illustrated. The illustrated system incorporates a "box" pleat blind (which typically is used by its manufacturer in a horizontal orientation) in a vertical orientation. The illustrated system uses, but is not limited to blinds such as the SILHOUETTE blind available from Hunter Douglas, Inc, having U.S. headquarters in Pittsburgh, Pa.

Here, although the illustrated window cover system 223 includes a generally rectangular frame 100, it will be understood from the following discussion that a frame 100 is not required--the system 223 requires only that the track be mounted in place, over an opening such as a window or a door, or simply over an are to be covered, for example, for decorative purposes. The illustrated frame has an upper horizontal frame-member 102 and vertical frame-members 104 and 106.

A roller arrangement 108 is attached to upper horizontal frame-member 102 proximate vertical frame-member 106, and extends vertically downward from the upper horizontal frame-member.

An elongated traverse track 110, is pivotally attached, at one end 110A thereof to upper frame member 102, for example, by bolt 112 which is attached proximate vertical frame member 106. The bolt 112 is attached proximate vertical frame-member 106. Traverse track is attached in translatable fashion, proximate end 110B thereof, to upper horizontal frame-member 102 by means of a hanger 116 attached to the traverse track and a C-shaped bracket 114 attached to the upper horizontal frame-member. The bracket 114 is preferably attached to the upper horizontal frame-member at a second point between the point of attachment of bolt 112 (the pivot point) and roller arrangement 108. This arrangement allows pivotal movement along the direction indicated by arrow A, FIG. 73.

As discussed above, in one preferred embodiment, the cover material or blind 220 is in the form of a pattern of joined box-pleats, which comprise generally rectangular fabric panels 222A and 222B. Referring to FIG. 74, the panels are attached together in a face-to-face relationship and separated by a plurality of vertically-oriented soft fabric strips or vanes 222. The blind 220 is attached, at one end thereof, to edges 232A and 232A of a rigid vertical edge-member 230. The edge-member 230 is suspended in slidable and rotatable fashion from traverse track 110 (shown in phantom in FIG. 74) by a first slide-member 236. Slide member 236 includes a shaft 237 which is secured in a receiving hole or cylinder 239 in edge-member 230 by a screw 241 (see FIG. 74). Fabric panels 222A and 222B are attached to roller arrangement 108 at the end of the panels opposite edge-member 230.

Fabric panels 222A and 222B, and hence box pleated blind 220, are suspended from traverse track 110 by a plurality of second slide-members 238, each thereof free to slide in the traverse track, and each thereof attached to a particular one of fabric strips 224, for example, to every third fabric-strip 224.

A magnetic alignment or spacer 240 extends horizontally, partially in the traverse track 110, see FIG. 74. As is preferred for traverse tapes and as is discussed previously herein, alignment tape 240 is substantially rigid in lateral and longitudinal directions in the plane of the tape, and flexible in a direction perpendicular to the plane of the tape. Tape 240 is attached at one end thereof to first slide-member 236, see FIG. 74 (or to associated shaft 237), at the other end thereof to roller arrangement 108, and attached at intervals therealong, preferably generally regular intervals, to each of second slide-members 238.

Referring again to FIGS. 71, 73, 74 and 75C–75F, in the preferred embodiment, the cover system 223 is provided with at least one traverse tape 180. Similar to the arrangement described above relative to the vertical shutter drape depicted in FIG. 56, the tape 180 extends along (through slots in) a lower portion of the box blind and preferably a second traverse tape 182 extends along an upper portion of the blind. Traverse tapes 180 and 182 preferably are metal or plastic tapes which are rigid in longitudinal and lateral directions in the plane of the tape, and flexible in a direction perpendicular to the plane of the tape. Maximum rigidity for the tapes in the lateral and longitudinal planar directions is achieved when the tapes are constrained as against perpendicular flexure in regions where perpendicular flexure is not desirable. Thus, in a preferred U configuration, the tape(s) are routed through the blind, then vertically upward through both opposite end members 230, then to and along the track 110. Preferably the tapes are magnetic, to keep them together over common runs along the end member(s) and along the track 110. Preferably, the track has magnet means, illustratively magnet strips 111—111 mounted on opposite sides of the bottom of the track 110, see FIGS. 73 and 74, for normally holding the tape(s) against the track, yet permitting easy "peeling" away action and recovery of the tape(s) during traversal of the blind. The action of the tape and magnet support, along with various alternative configurations (for example, L-configurations attached to one end member and routed through the blind or drape, up the opposite end member and along the track apply here.

Window cover system 223 is opened and closed by driving roller 108 and traversing slide edge-member 230, such that box-pleated panel 220 is rolled onto roller arrangement 108 for opening the cover system and unrolled from roller arrangement 108 for closing the cover system. As blind 220 is rolled onto the roller together with tape 240 and slide members 238, traverse track 110 pivots on bolt 112 and translates outward in the direction of arrow B (see FIG. 72) to accommodate an increasing diameter of rolled panel on roller arrangement 108.

Continuing with reference to FIGS. 71, 72, 73, and 74, a preferred method of driving roller arrangement 108 and edge member 230 is a continuous-loop chain-drive, preferably a ball-chain-drive 250. Ball chain-drive 250 comprises a continuous loop of cord 252 having beads or balls 254 attached thereto at regular intervals therealong. Ball chain-drive 250 is looped around a sprocket 260 which is attached to an upper end of roller arrangement 108. Edge member 230 is attached to ball-chain-drive 250 by means of a bell-crank 262 which is integral with a bracket 264 (see FIG. 74). Bracket 264 is attached to cord 252 and a ball 254 by a clamp 266.

Ball-chain-drive 250 is preferably extended through an aperture 270 in vertical frame-member 104 to provide convenient access for operation of the drive system (see FIG. 71).

A useful feature of the drive arrangement and panel suspension arrangement of window cover system 223 is that the drive may be used for adjusting separation of panels 222A and 222B, and thus adjusting the inclination of vanes 224 with respect to the panels. If the panels and vanes are from a lightweight light diffusing fabric, altering the spacing of the panels 222A and 222B, and vanes 224 therebetween, provides a means of varying attenuation of light transmitted, by diffusion, through the panels and vanes. This feature of the drive is explained below with reference to FIGS. 75A through 75F.

Figure 75:
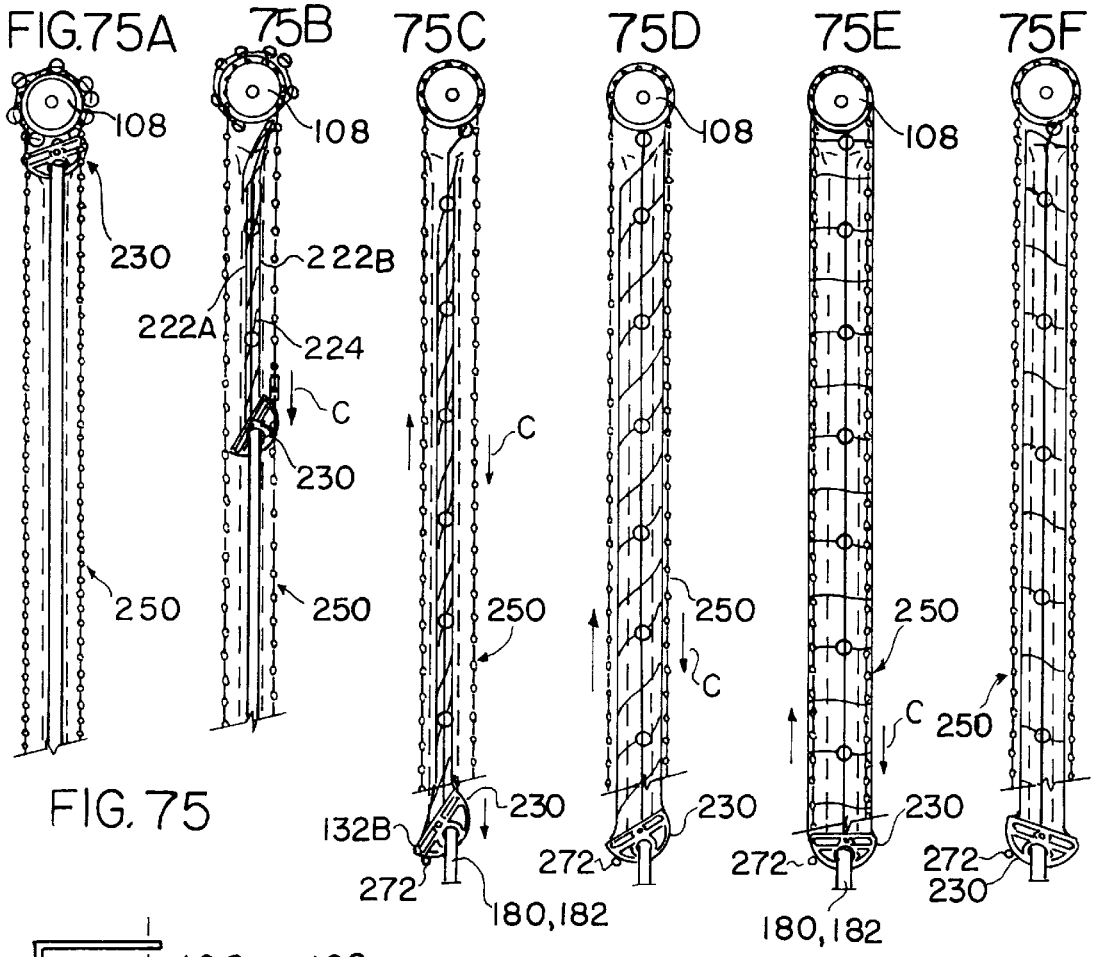

FIG. 75A illustrates the window system in a fully open position, i.e., with edge-member 230 in an open position. FIG. 75B shows edge-member 230 in a traversing attitude between open and closed positions. In this attitude, edge member 230 is rotated such that separation between fabric panels 222A and 222B is minimized, and such that vanes 224 are inclined, almost parallel the plane of the blind. In this attitude, three thicknesses of fabric impede passage of light through panel 120.

Now, referring to FIG. 75C, and also to FIG. 71, an elongated, downward-extending stop-member is attached to upper horizontal frame-member 102, proximate vertical frame member 104. Stop-member 272 is configured and positioned such that when edge-member 230 is traversed in a direction towards a closed position (see FIG. 75B arrows C), edge 232B thereof eventually contacts stop-member 272 as a closed position is approached (see FIG. 75C). As edge-member 230 is traversed further in the direction of arrows C, the edge-member is caused to rotate, thereby rotating the panels and sections 224 such that the separation between the panels is increased (see FIG. 75D), up to the point (see FIG. 75E) where the separation between panels 222A and 222B and the resulting light transmission through the blind are at a maximum, and where vanes 224 are inclined generally perpendicular to the plane of the panels. As illustrated in FIG. 75F, further traversal of edge-member 230 in the direction of arrows C causes separation of the panels to decrease.

The above-described drive mechanism and arrangement of window cover system 223 provides a single drive for opening and closing the window cover, and varying light transmission through the system when it is closed. This saves manufacturing cost associated with more common separate drives for opening and closing, and for attenuation. The single-drive arrangement also reduces confusion for a user, as the user is no longer required to remember or guess which of two drives serves what purpose.

j) Horizontal Pleated SILHOUETTE Blind

FIGS. 76–79 depict yet another embodiment of my invention, in the form of a unique horizontal roller blind system 225. This system comprises a horizontally-oriented box blind 280, such as the above-described SILHOUETTE blind (identified by numeral 220 in FIGS. 71 and 72), mounted to track means 282, and a horizontally-oriented pleated blind 284, such as the FINALE blind, mounted for raising and lowering in unison with the box blind. Compared to a conventional box blind alone, the combined blinds provide additional light absorption (blocking) and privacy, along with the decorative appearance of pleated blinds.

Specifically, the exemplary roller blind system 225 comprises conventional track means 282, illustratively an elongated, generally C-shaped cross-section box structure which is mounted to a wall or ceiling, etc. A roller 286 is rotatably mounted to the track, for example via brackets (not shown) at the ends of the track. Conventional means such as a pull (not shown) or a motor mechanism (not shown) is provided for raising and lowering the box blind 280 by rotating the roller 286.

The exemplary box blind 280 typically is of translucent flexible fabric material formed into box pleats 325—325 defined by opposite panels 222A and 222B and spaced transverse vanes 224. The exemplary pleated blind 284 typically comprises translucent fabric material which is formed into generally sawtooth-shaped pleats 302—302. As shown in FIG. 77, the box 280 blind is mounted at top end 296 thereof to the roller 286 and the pleated blind 284 is mounted at its top end 292 independently of the box blind, preferably to a horizontal bottom lip 290 of the track 282. An elongated rail 288 of or containing metal or other heavy material, is mounted to the bottom end 298 of the box blind and the bottom end 294 of the pleated blind. As a consequence of this mounting arrangement, the blinds are oriented horizontally (with their box and sawtooth pleats extending horizontally), the pleated blind is side by side the box blind, preferably at both the top and bottom, and the plane of the pleated blind is generally parallel to that of the box blind.

Referring in particular to FIGS. 77 and 78, consider now the means 300 for raising and lowering the two blinds in unison. Means 300 such as the illustrated cord or a tape (for example, tape 180) is routed through or along the pleated blind 284, typically through apertures 304—304 in the pleats 302 and is attached at one end thereof to the roller 286 and at the opposite end to the rail 288, adjacent the pleated blind 284. During rotation of the roller 286, the cord is retracted upward (wound) around the roller 286 (counterclockwise rotation) or extended downward (unwound; clockwise rotation), and in cooperation with wrapping and unwrapping of the box blind on the roller 286, raises and lowers the pleated blind 284 in unison with the side-by-side box blind. Specifically, and considering raising operation, initially during raising of the pleated blind 284 by cord 300, the cord pulls the pleated blind end of the rail 288 upwardly, pivoting or rotating the rail as shown in FIG. 78 and translating upward the panel 222B of the box blind adjacent the pleated blind 284 relative to the panel 222A. Flexible vanes 224—224 pivot and crumple, allowing panels 222B and 222A to flatten against one another, flattening the box drape transversely for storage on the counterclockwise-rotating roller 286. At the same time, the pleated blind 284 is flattened or compacted longitudinally (horizontally) and is stored against the track lip 290. Lowering operation is the opposite of the above process and, assisted by weight/rail 288, the box and pleated binds unfold to the normal box and sawtooth configurations shown in FIG. 77. The rail is of, or mounts, sufficient weight that during the unwinding of the cord, gravity pulls the two blinds downward in unison, facilitates orienting the vanes in an open, generally horizontal orientation and facilitates uniform hanging of the two blinds. In short, the side-by-side mounting of the blinds, independently at the top and by the pivoting or hinge action rail at the bottom, and the co-operative operation of the cord and roller combine to effect joint opening and closing operation of the two-blind system.

Alternatively, a flexible rail 288 which bends can be used. For convenience, we use "pivoting" to include both rotation and bending or hinging action.

Various alternatives and substitutions readily come to mind. For example, instead of a single pleat sawtooth blind, the blind 284 can be a "hollow" pleat blind, such as the DUETTE blind available from Hunter Douglas, Inc. Also the FINALE elongated edge, single pleat sawtooth blind available from Verosol, USA, Inc. can be used, in which case the cord can be routed through the pleats or the elongated edges.

Although one or more cords 300 or other means can be used for raising and lowering the blinds, preferably at least two cords, spaced apart along the horizontal length of the blinds, are used, to raise and lower the blinds without tilting.

k) Dual Tape-Drive Blind System

FIGS. 80–87 depict dual tape alternatives to the sprocket-driven, tape-supported cover system.

Figure 82:
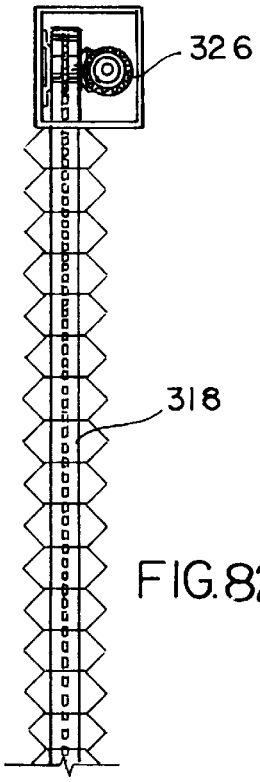

FIG. 80, 81 and 82 depict a dual bevel gear drive system 310 comprising top and bottom support means in the form of sprockets 312 and 314 at each side of the window cover means. The exemplary sprockets have teeth which mesh with notches in the associated top and bottom tapes 316 and 318. The teeth are of appropriate size and pitch such that reversible rotation of the sprockets advances and retracts the top and bottom tapes in unison, at the same speed. Illustratively, the top and bottom sockets are driven, respectively, by bevel gears 320 and 322. These gears are coupled together and driven together by mating bevel gears 324 and 326 mounted on rotatable vertical shaft 328, thereby advancing and retracting the tapes in unison. The shaft 328 can be driven manually, or by a motor, such as electric motor 329, which drives shaft 328 through gear arrangement 331, for driving the associated right or left side, upper and lower tapes 316 and 318 in unison.

Figure 83:
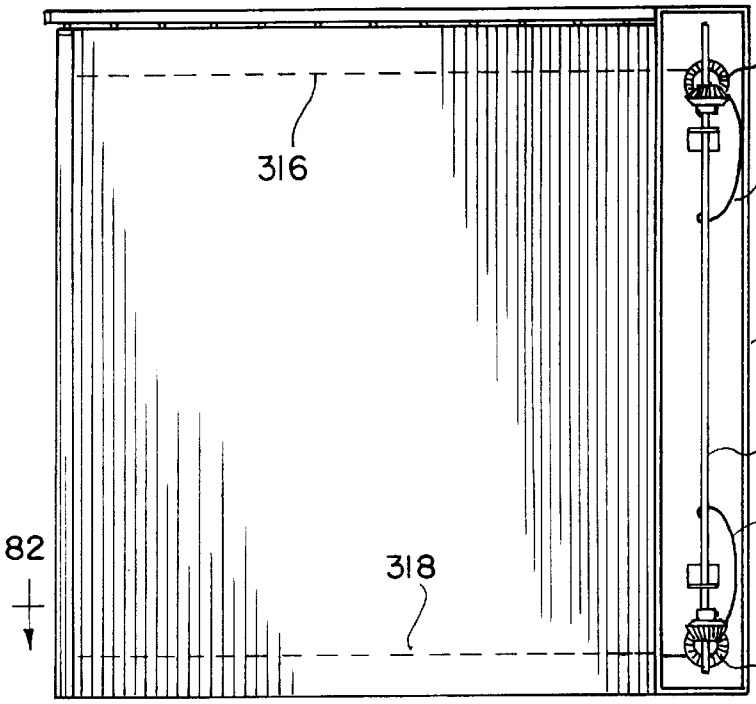
Figure 84:
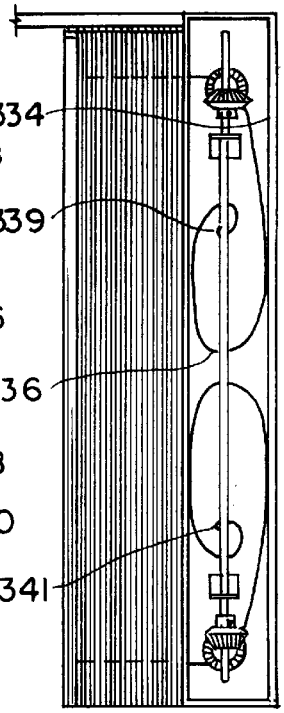

FIGS. 83 and 84 depict one preferred apparatus for storing elongated tapes 316 and 318 to permit window covers which range in width from very narrow to very wide, limited practically only by the size and resistance of the coil and the size and weight of the associated end support member and contents. The gear drive is mounted in the compartment 334 within vertical end support member 336. The tapes 316 and 318 are coiled within the compartment and because of the in-unison sprocket drive arrangement, can have free ends. Alternatively, the ends can be pinned or otherwise fastened together as shown at 339 and 341. The coils 338 and 340 wind up and unwind in unison as the blind traverses between the closed condition shown in FIG. 83 and the open condition shown in FIG. 84.

Figure 85:
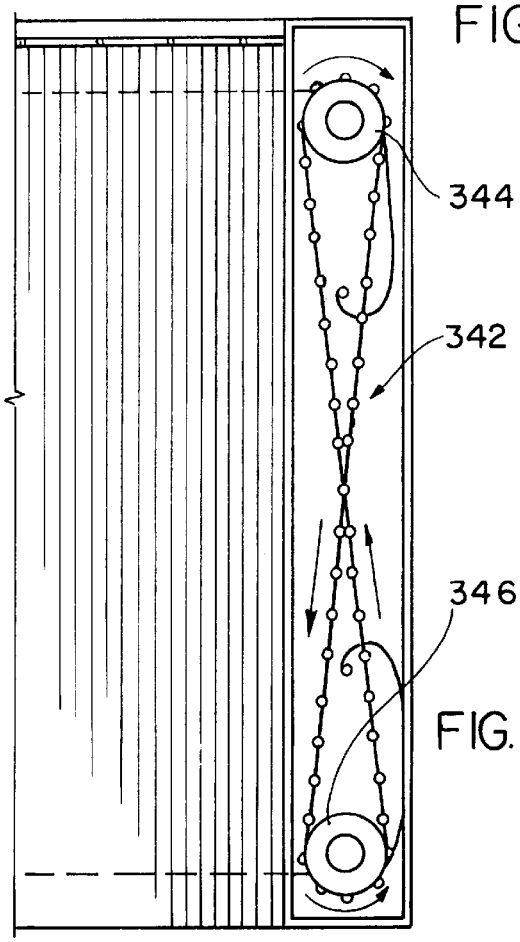

FIG. 85 depicts another alternative drive which includes an endless sprocket belt or chain drive 342 which is mounted over upper and lower tape drive sprockets 344 and 346 in the end support member's compartment 334 and drives the upper and lower sprockets together and the associated tapes in unison.

FIGS. 86 and 87 depict another dual tape arrangement 348 which permits large blind displacement. Here, the top and bottom tapes are routed together, illustratively at each end of the blind, over top wheels 350, then over a bottom vertical traveler unit 352 and vertically (or horizontally) up the compartment 334 to the location 351 where the tapes are pinned together. Although, as described previously, a sprocket drive can be used, here the illustrated support means such as 350 and 360 are non-toothed rollers or wheels.

The traveler 352 comprises a bracket 354 or plate having main idler wheel 356 around which the tapes are routed and two associated guide sprockets 358 and 360. The traveler 352 moves vertically (or horizontally) as the drape traverses open and closed, accommodating winding and unwinding of the tapes. Alternatively, and preferably, to facilitate control of the tapes, a magnetic, vertically (or horizontally) oriented containment/hold down strip 362 is mounted within the compartment and magnetically releasably secures the tapes thereto, in the manner of the magnet containment and hold down arrangement disclosed above herein. That is, as the top and bottom tapes are withdrawn from their compartment (and the associated vertical left end support member 336 traverses left in FIG. 87 across the associated window or space), closing the window cover means, the traveler 352 is moved upward, peeling the tapes away from the magnet containment means 362. Conversely, when the left edge support member 336 traverses or is traversed to the right, opening the window cover means, the weight of the traveler moves the traveler downward and the tapes are recaptured by the magnetic containment means 362. In short, as the blind traverses and the tape unwinds or pays out, the tape readily peels off the magnetic containment means 362. When the blind traverses back, the magnet strips recaptures the tape.

The stability of the system is such that both end support members can be free to traverse, and traversal of either end is easily effected by hand, as well as by drive means such as an electric motor. Also, because of the light weight (the end support members, sprockets/rollers and travelers can be light weight plastic) and the resistance or light braking action provided by the containment means 362 which resists unintended movement, the system possesses positional stability and the end support members tend to remain in the selected position to which they are moved. This positional stability and the ease of movement allow the system to be mounted vertically (as indicated by "Bottom 1" in FIG. 86 which indicates the bottom side of the system) or horizontally (rotated ninety degrees to the "Bottom 2" orientation, FIG. 86) or at intermediate orientations.

The present invention has been described in terms of a preferred embodiment and a number of other embodiments. The invention however is not limited to the embodiments described and depicted. Rather, the scope of the invention is defined by the appended claims.

What is claimed is:

1. A window cover system, comprising: a track; a window cover; means for mounting the window cover to the track wherein at least one end of the window cover is free to traverse open and closed along the track; tape means having longitudinal rigidity routed through the window cover for maintaining alignment of the window cover relative to the track; and means for containing the tape means against transverse movement, to effect push and pull action by the tape and provide positive displacement of the cover at the end thereof.

2. A pivot hinge, comprising:

a flexible elongated strip having transversely spaced, longitudinally-extending first and second edges; and first and second beads extending along and joined respectively over the first and second edges of the flexible strip, each said bead comprising two semi-cylindrical half bead portions, each half bead portion of each bead being separated by a respective said edge of the flexible strip, the transverse cross-section of at least a selected one of the beads being configured for capturing the selected bead within an associated support member, thereby allowing the flexible elongated strip to fold or pivot back and forth relative to the selected bead.

3. The pivot hinge of claim 2 wherein the flexible elongated strip comprises a strip of fabric.

4. A pivot hinge, comprising:

first and second elongated relatively inflexible members having respective first and second slots extending generally along the direction of elongation thereof;

a flexible elongated strip having first and second transversely spaced apart, longitudinally-extending edges; and first and second beads extending along and joined respectively over the first and second edges of the flexible elongated strip, each said bead comprising two semi-cylindrical half bead portions, each half bead portion of each bead being separated by a respective said edge of the flexible strip, the transverse cross-section of the first and second beads being configured for capturing the first and second beads within the respective first and second slots of the elongated relatively inflexible members, thereby allowing the flexible elongated strip to fold or pivot back and forth relative to the first and second beads.

5. The pivot hinge of claim 4 wherein the flexible elongated strip comprises a strip of fabric.

6. A window cover system, comprising: a horizontal traverse track; an assembly of elongated vertically oriented slats having longitudinal front and rear edges; a drape formed of flexible material having front and rear vertical folds; a plurality of trolleys suspended from the track for traversing movement along the traverse track; the slats being mounted to the trolleys for pivotal movement about vertical axes to rotatably open and close the slats and for traversing movement with the trolleys along the track to open and close the slat assembly; and hinge members mounting the drape at the rear folds thereof to the slats along the front edges thereof for traversing movement with the slats to open and close the drape.

7. The window cover system of claim 6, wherein the hinge members comprise a plurality of hinge members mounted at spaced positions along the front edge of a slat and the rear fold of the associated blind.

8. The window cover system of claim 6, wherein the hinge members comprise a plurality of hinge members associated with a plurality of pairs of slats and folds, each hinge member extending along substantially the length of the front edge of the slat and the rear fold of the drape of one of said pairs of slats and folds.

9. The window cover system of claim 6, further comprising slots formed along the front edges of the slats and beads extending along and joined to the rear folds of the flexible drape; the hinge members comprising the slots, the beads and the flexible drape; and the transverse cross sections of the slots and of the beads being configured for capturing the beads within the slots, thereby allowing the flexible drape to fold back and forth relative to the slats.

10. A window cover system, comprising:

a horizontal traverse track;

an assembly of elongated vertically oriented slats having longitudinal front and rear edges;

a drape formed of flexible material having front and rear vertical folds;

a plurality of trolleys suspended from the track for traversing movement along the traverse track;

the slats being mounted to the trolleys for pivotal movement about vertical axes of the slats to rotatably open and close the slats and for traversing movement with the trolleys along the track to open and close the slat assembly;

each slat having a slot extending along the longitudinal front edge;

an elongated bead extending along and captured within each slot, the transverse cross-sections of the slot and the bead configured for releasably capturing the bead within the slot;

a plurality of pairs or rear pleats of the drape being paired with a plurality of pairs of slats which are adjacent, one slat of a pair to the other slat of the pair;

a first rear pleat of each pair of rear pleats being joined to the bead of a first slat of each pair of slats; and the second rear pleat of each pair of rear pleats being joined to the bead of the second slat of each pair of slats.

* * * * *